US009456938B2

(12) United States Patent
Blickensderfer et al.

(10) Patent No.: US 9,456,938 B2
(45) Date of Patent: Oct. 4, 2016

(54) POWERED AMBULANCE COT WITH AN AUTOMATED COT CONTROL SYSTEM

(71) Applicants: Colleen Q. Blickensderfer, Springboro, OH (US); Brian M. Magill, Mainville, OH (US); Tim R. Wells, Hillsboro, OH (US); Preeti Sar, Wilmington, OH (US); Derick C. Robinson, Hillsboro, OH (US); Nicholas V. Valentino, Springboro, OH (US); Michael D. Clark, Dayton, OH (US)

(72) Inventors: Colleen Q. Blickensderfer, Springboro, OH (US); Brian M. Magill, Mainville, OH (US); Tim R. Wells, Hillsboro, OH (US); Preeti Sar, Wilmington, OH (US); Derick C. Robinson, Hillsboro, OH (US); Nicholas V. Valentino, Springboro, OH (US); Michael D. Clark, Dayton, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 10 days.

(21) Appl. No.: 14/538,164

(22) Filed: Nov. 11, 2014

(65) Prior Publication Data

US 2016/0128880 A1 May 12, 2016

(51) Int. Cl.

| | |
|---|---|
| ***A61G 1/02*** | (2006.01) |
| ***A61G 1/013*** | (2006.01) |
| ***A61G 1/056*** | (2006.01) |

(52) U.S. Cl.

CPC ..... *A61G 1/013* (2013.01); *A61G 1/025* (2013.01); *A61G 1/0212* (2013.01); *A61G 1/0237* (2013.01); *A61G 1/0256* (2013.01); *A61G 1/0262* (2013.01); *A61G 1/0287* (2013.01); *A61G 1/0562* (2013.01); *A61G 1/0243* (2013.01); *A61G 2203/12* (2013.01); *A61G 2203/16* (2013.01); *A61G 2203/20* (2013.01); *A61G 2203/40* (2013.01); *A61G 2203/42* (2013.01); *A61G 2203/726* (2013.01)

(58) Field of Classification Search

CPC .... A61G 1/013; A61G 1/0237; A61G 1/025; A61G 2203/16; A61G 1/0212; A61G 1/0243; A61G 1/0256; A61G 1/0262; A61G 1/0287; A61G 1/0562; A61G 2203/12; A61G 2203/20; A61G 2203/40; A61G 2203/42; A61G 2203/726

See application file for complete search history.

(56) References Cited

U.S. PATENT DOCUMENTS

| | | | |
|---|---|---|---|
| 2,944,401 | A | 7/1960 | Beck |
| 4,037,871 | A | 7/1977 | Bourgraf et al. |
| 4,921,295 | A | 5/1990 | Stollenwerk |
| 6,976,696 | B2 | 12/2005 | O'Krangley et al. |
| 7,389,552 | B1 | 6/2008 | Reed et al. |
| 7,398,571 | B2 | 7/2008 | Souke et al. |
| 8,056,950 | B2 | 11/2011 | Souke et al. |
| 2009/0165208 | A1 | 7/2009 | Reed et al. |
| 2010/0176618 | A1 | 7/2010 | Souke et al. |

FOREIGN PATENT DOCUMENTS

| | | | |
|---|---|---|---|
| WO | 01/70161 | A1 | 9/2001 |
| WO | 2014/134321 | A1 | 9/2014 |

OTHER PUBLICATIONS

International Search Report and Written Opinion dated Jul. 16, 2015 pertaining to International Application No. PCT/US2015/017419.

*Primary Examiner* — Lori L Lyjak
(74) *Attorney, Agent, or Firm* — Dinsmore & Shohl LLP

(57) ABSTRACT

A powered ambulance cot and methods of raising and lowering the cot as well as loading and unloading the cot are disclosed. The cot includes a support frame and legs, each leg having a wheel. An actuator of an actuation system interconnects the frame and legs, and is configured to effect changes in elevation of the frame relative to the wheel of each of the legs. A control system controls activation of the actuation system, and detects both the actuator at a first location relative to the frame, where the first location is remote from a second location and which situates an end of the actuator that is remote from each wheel closer to the frame, and a presence of a signal requesting a change in elevation of said support frame to thereby cause the legs to move relative to the support frame.

15 Claims, 28 Drawing Sheets

| | INPUT CODE VALUE | | | | 63-36 | 35 | 34 | 33 | 32 | 31-24 | 23 | 22 | 21 | 20 | 19 | 18 | 17 | 16 | 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|---|---|---|---|---|---|---|---|---|---|---|---|---|---|---|---|---|---|---|
| | DPMODE BOTH LEGS | 1 | 0 | 0 | X | X | X | X | X | X | X | X | X | X | X | X | X | X | X | X | X | X | X | X | X | X | X | X | X | X | X | X | X | X | X |
| | DPMODE OP LEG | X | 1 | 0 | X | X | X | X | X | X | X | X | X | X | X | X | X | X | X | X | X | X | X | X | X | X | X | X | X | X | X | X | X | X | X |
| | DPMODE LD LEG | X | X | 1 | X | X | X | X | X | X | X | X | X | X | X | X | X | X | X | X | X | X | X | X | X | X | X | X | X | X | X | X | X | X | X |
| BIT 5 | A2 && A1 > 99% LEVELED RANGE | X | X | X | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| BIT 4 | A2-A1 > 37% LEVELED RANGE && A1 < 5% PHYSICAL RANGE (LOADING ANGLE) | X | X | X | - | 0 | 0 | 0 | 0 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 |
| BIT 3 | C2 SEES FLOOR && A1 < 1% PHYSICAL RANGE && A2 <5% PHYSICAL RANGE (C2 FLOOR CONDITIONS) | X | X | X | - | 0 | 0 | 0 | 0 | 1 | 0 | 0 | 0 | 0 | 0 | 0 | 0 | 0 | 1 | 1 | 1 | 1 | 1 | 1 | 1 | 1 | 0 | 0 | 0 | 0 | 0 | 0 | 0 | 0 | 0 |
| BIT 2 | C1 SEES FLOOR && A1 < 5% PHYSICAL RANGE (C1 FLOOR CONDITIONS) | X | X | X | - | 0 | 0 | 0 | 0 | X | 1 | 1 | 1 | 1 | 0 | 0 | 0 | 0 | 1 | 1 | 1 | 1 | 0 | 0 | 0 | 0 | 1 | 1 | 1 | 1 | 0 | 0 | 0 | 0 | 0 |
| BIT 1 | D2 POSITION | X | X | X | X | 1 | 1 | 0 | 0 | X | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 0 |
| BIT 0 | D1 POSITION | X | X | X | X | 1 | 0 | 1 | 0 | X | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 0 |
| | MOTOR STATE | 6 | 5 | 7 | 0 | 0 | 0 | 0 | 0 | 0 | 2- | 2- | 2 | 2 | 1 | 1 | 2 | 8 | 3 | 1 | 3- | 3- | 3 | 1 | 2 | 3- | 3 | 1 | 2 | 2 | 3 | 1 | 2 | 8 | 0 |

FIG. 21

POWERED AMBULANCE COT WITH AN AUTOMATED COT CONTROL SYSTEM

TECHNICAL FIELD

The present disclosure generally relates to emergency patient transporters, and specifically to a powered ambulance cot with an automated cot control system.

BACKGROUND

There are a variety of emergency patient transporters in use today. Such emergency patient transporters may be designed to transport and load bariatric patients into an ambulance. For example, the PROFlexX® cot, by Ferno-Washington, Inc. of Wilmington, Ohio U.S.A., is one such patient transporter embodied as a manually actuated cot that may provide stability and support for loads of about 700 pounds (about 317.5 kg). The PROFlexX® cot includes a patient support portion that is attached to a wheeled undercarriage. The wheeled under carriage includes an X-frame geometry that can be transitioned between nine selectable positions. One recognized advantage of such a cot design is that the X-frame provides minimal flex and a low center of gravity at all of the selectable positions. Another recognized advantage of such a cot design is that the selectable positions may provide better leverage for manually lifting and loading bariatric patients.

Another example of an emergency patient transporter designed for bariatric patients, is the POWERFlexx+ Powered Cot, by Ferno-Washington, Inc. The POWERFlexx+ Powered Cot includes a battery powered actuator that may provide sufficient power to lift loads of about 700 pounds (about 317.5 kg). One recognized advantage of such a cot design is that the cot may lift a bariatric patient up from a low position to a higher position, i.e., an operator may have reduced situations that require lifting the patient.

A further variety of an emergency patient transporter is a multipurpose roll-in emergency cot having a patient support stretcher that is removably attached to a wheeled undercarriage or transporter. The patient support stretcher when removed for separate use from the transporter may be shuttled around horizontally upon an included set of wheels. One recognized advantage of such a cot design is that the stretcher may be separately rolled into an emergency vehicle such as station wagons, vans, modular ambulances, aircrafts, or helicopters, where space and reducing weight is a premium. Another advantage of such a cot design is that the separated stretcher may be more easily carried over uneven terrain and out of locations where it is impractical to use a complete cot to transfer a patient. Example of such cots can be found in U.S. Pat. Nos. 4,037,871, 4,921,295, and International Publication No. WO2001/070161.

Although the foregoing emergency patient transporters have been generally adequate for their intended purposes, they have not been satisfactory in all aspects. For example, the foregoing emergency patient transporters are loaded into ambulances according to loading processes that require at least one operator to support the load of the cot for a portion of the respective loading process.

SUMMARY

The embodiments described herein are directed to a powered ambulance cot with an automated cot control system which provides improved versatility to multipurpose roll-in emergency cot designs by providing improved management of the cot weight, improved balance, and/or easier loading at any cot height, while being loaded via rolling into various types of rescue vehicles, such as ambulances, vans, station wagons, aircrafts and helicopters.

These and additional features provided by the embodiments of the present disclosure will be more fully understood in view of the following detailed description, in conjunction with the drawings.

DETAILED DESCRIPTION OF THE DRAWINGS

The following detailed description of specific embodiments of the present disclosures can be best understood when read in conjunction with the following drawings, where like structure is indicated with like reference numerals and in which.

Figure 3:
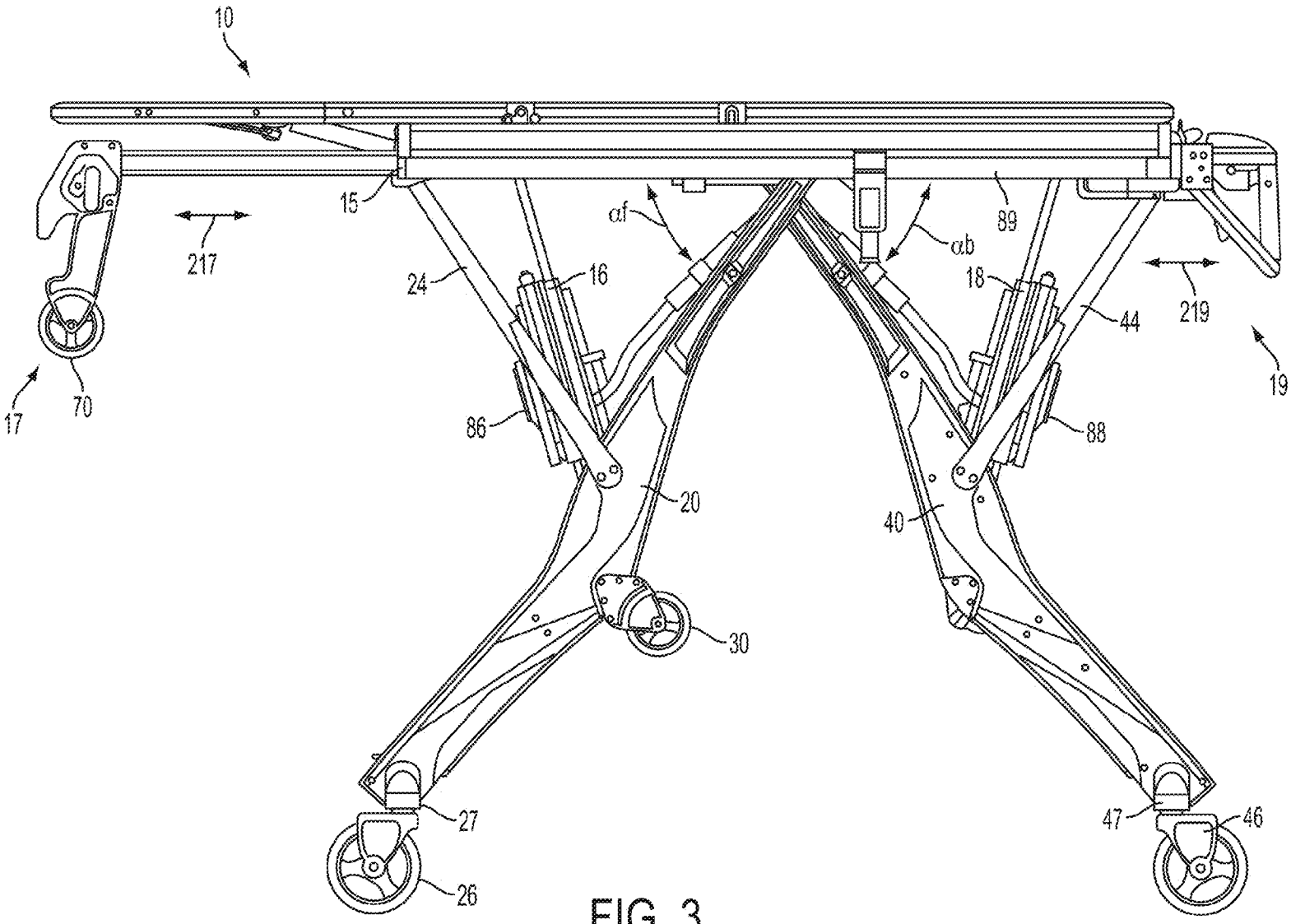
FIG. 3 is a side view depicting a roll-in, self-actuating, powered ambulance cot according to one or more embodiments described herein.
Figure 6:
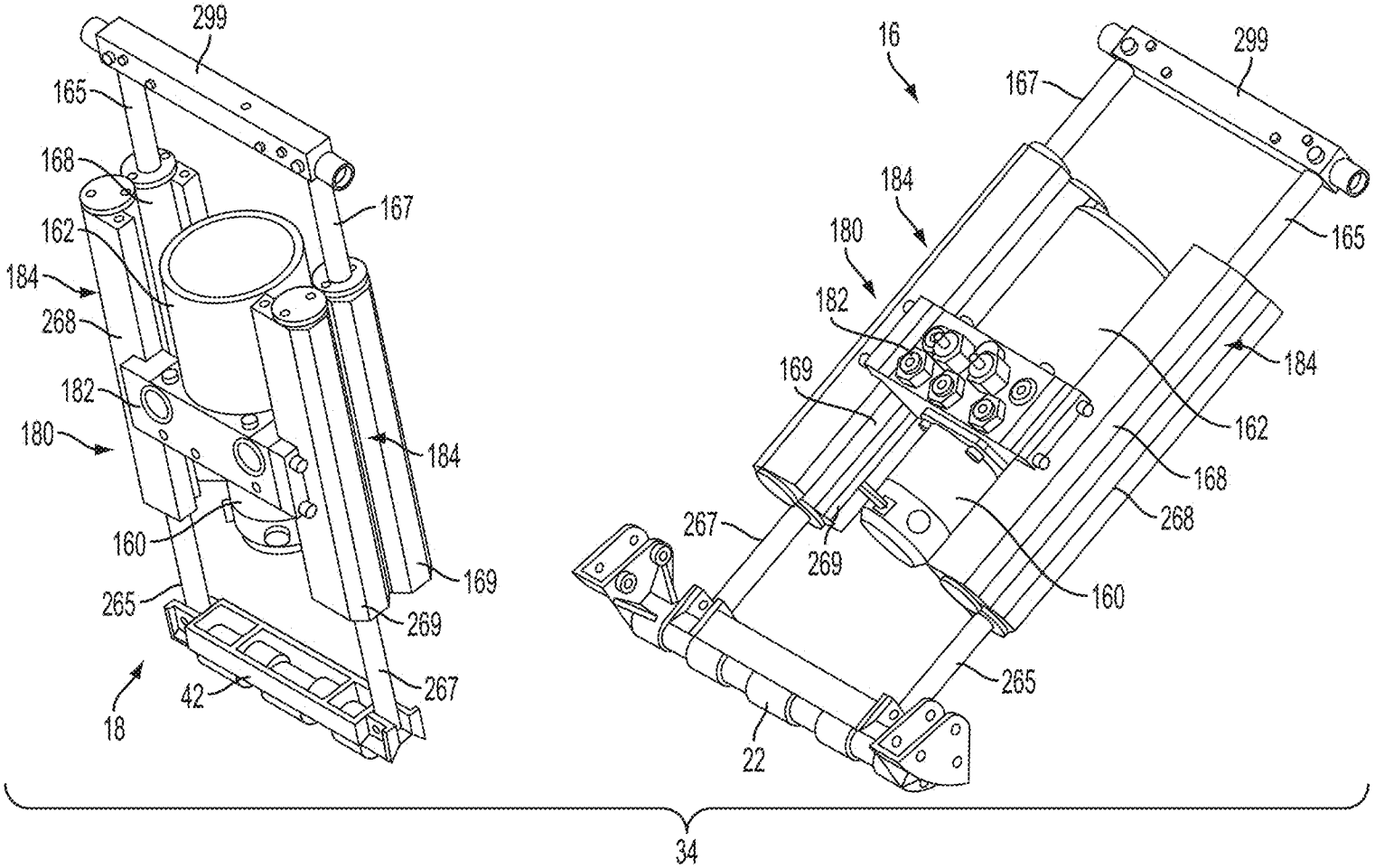
Figure 7:
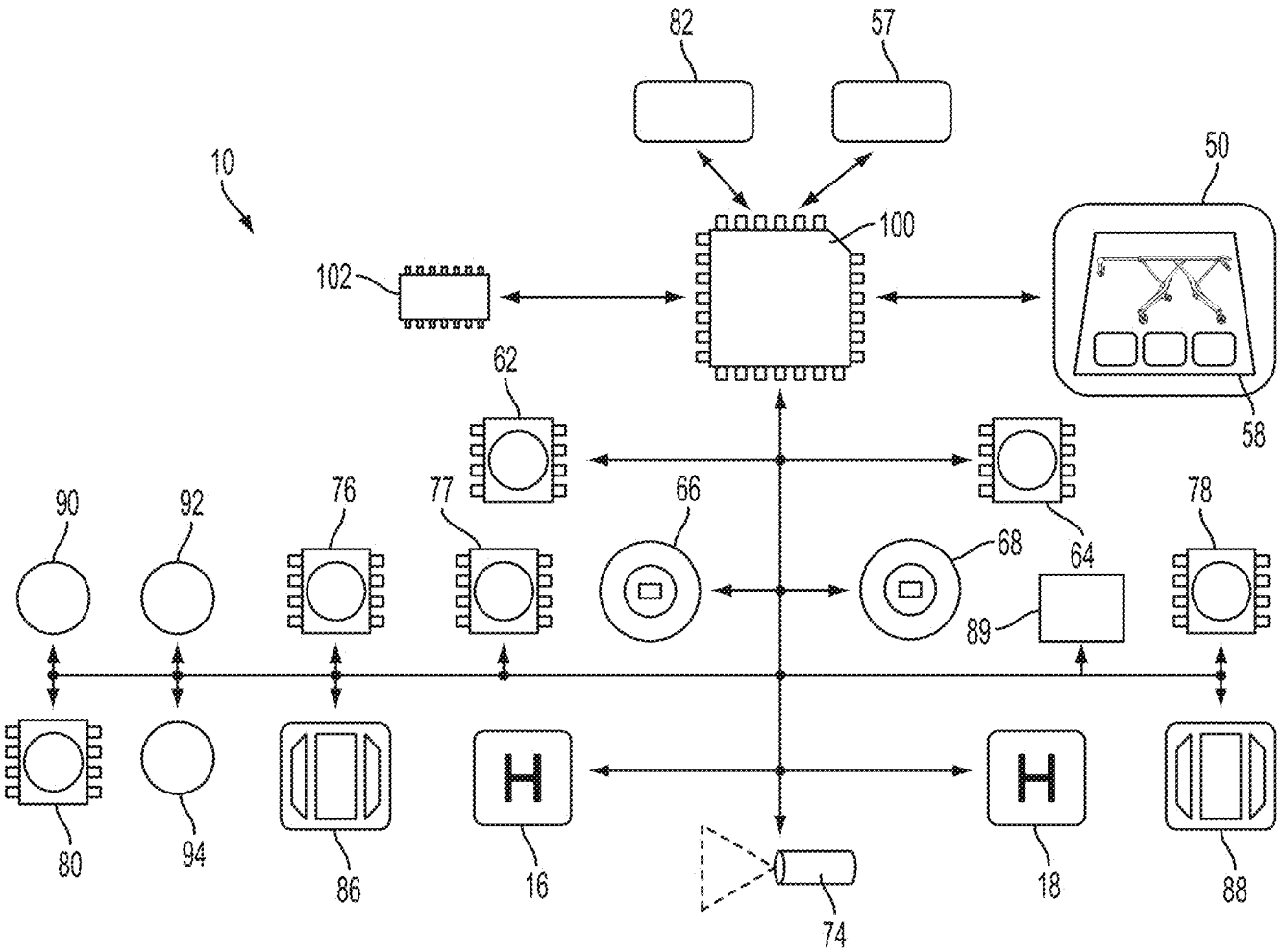
Figure 8:
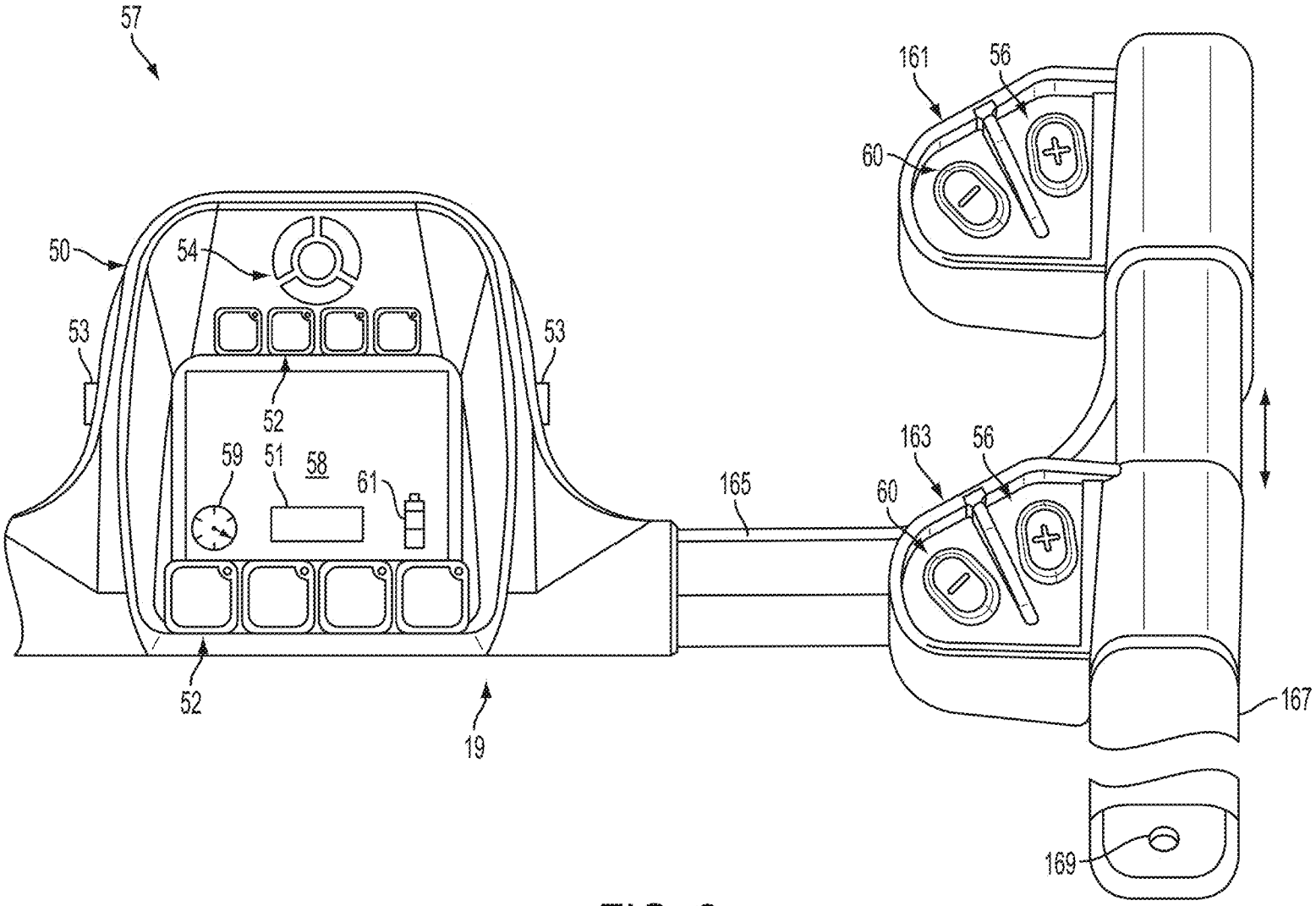
Figure 9:
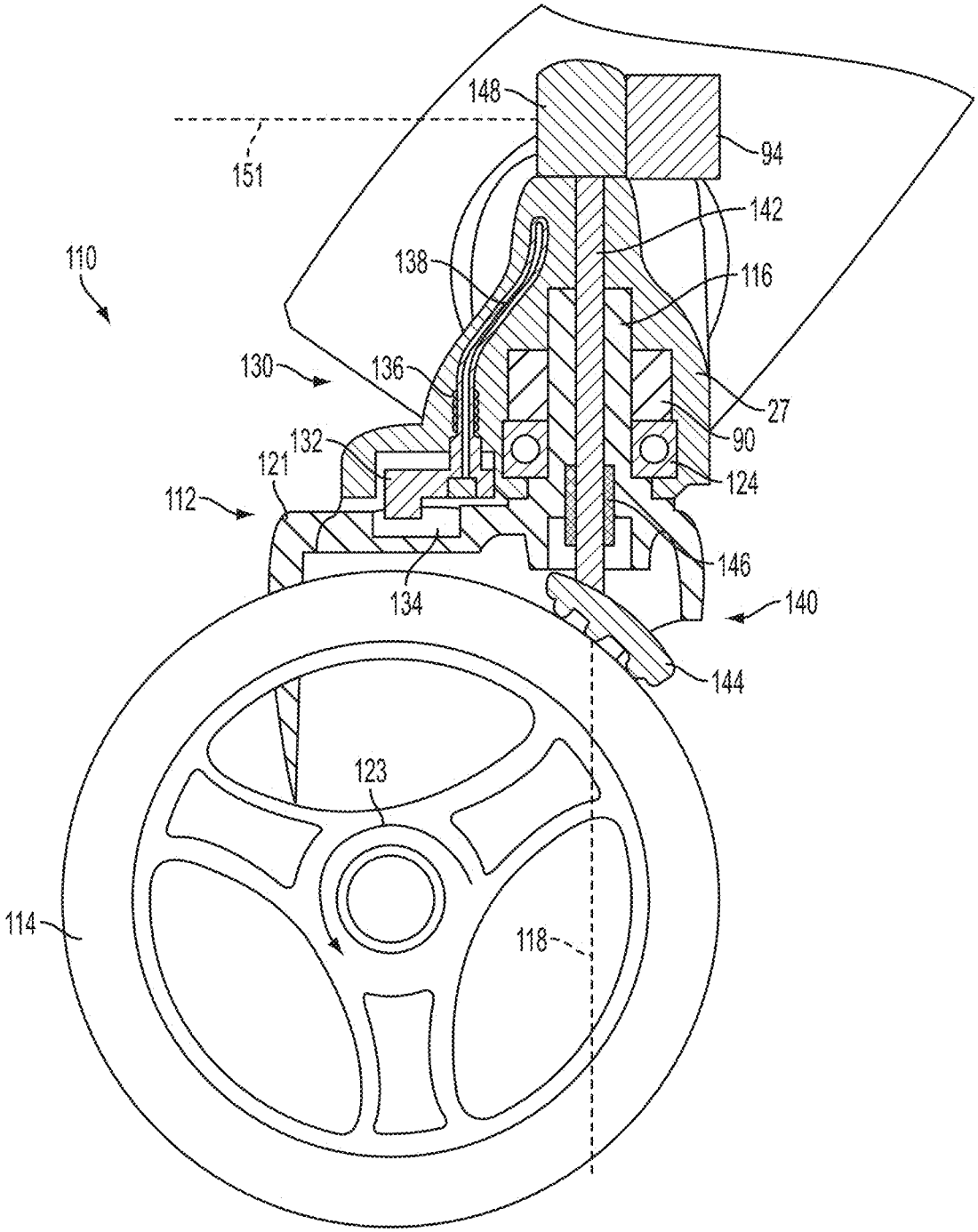
Figure 10:
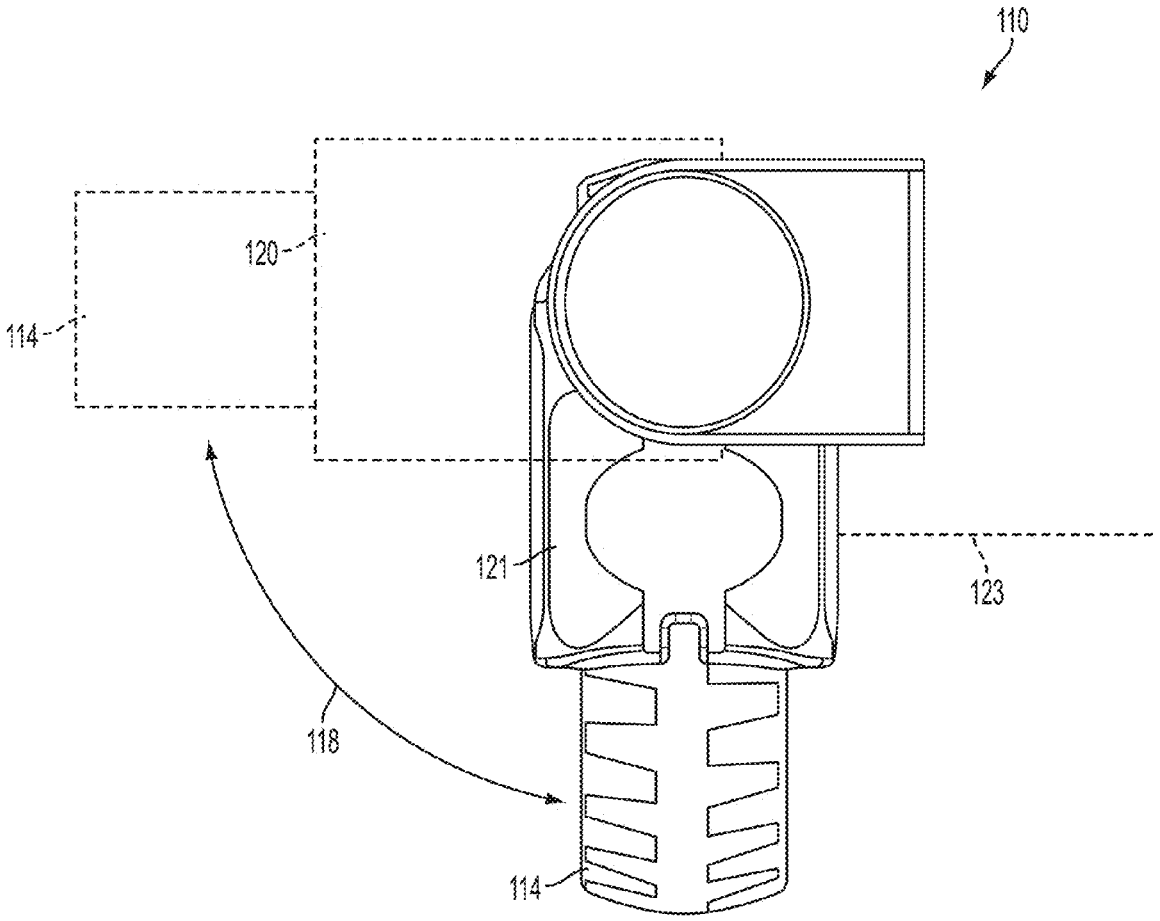
Figure 11:
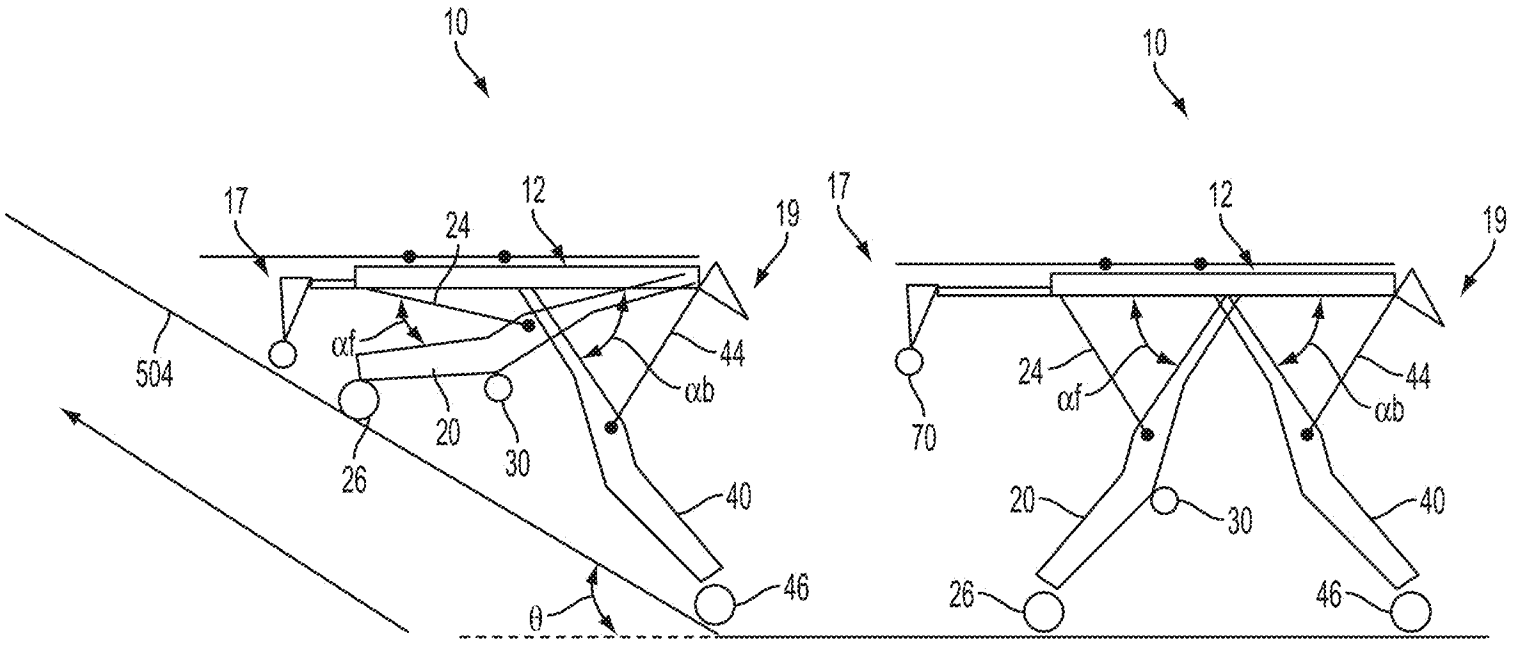
Figure 12:
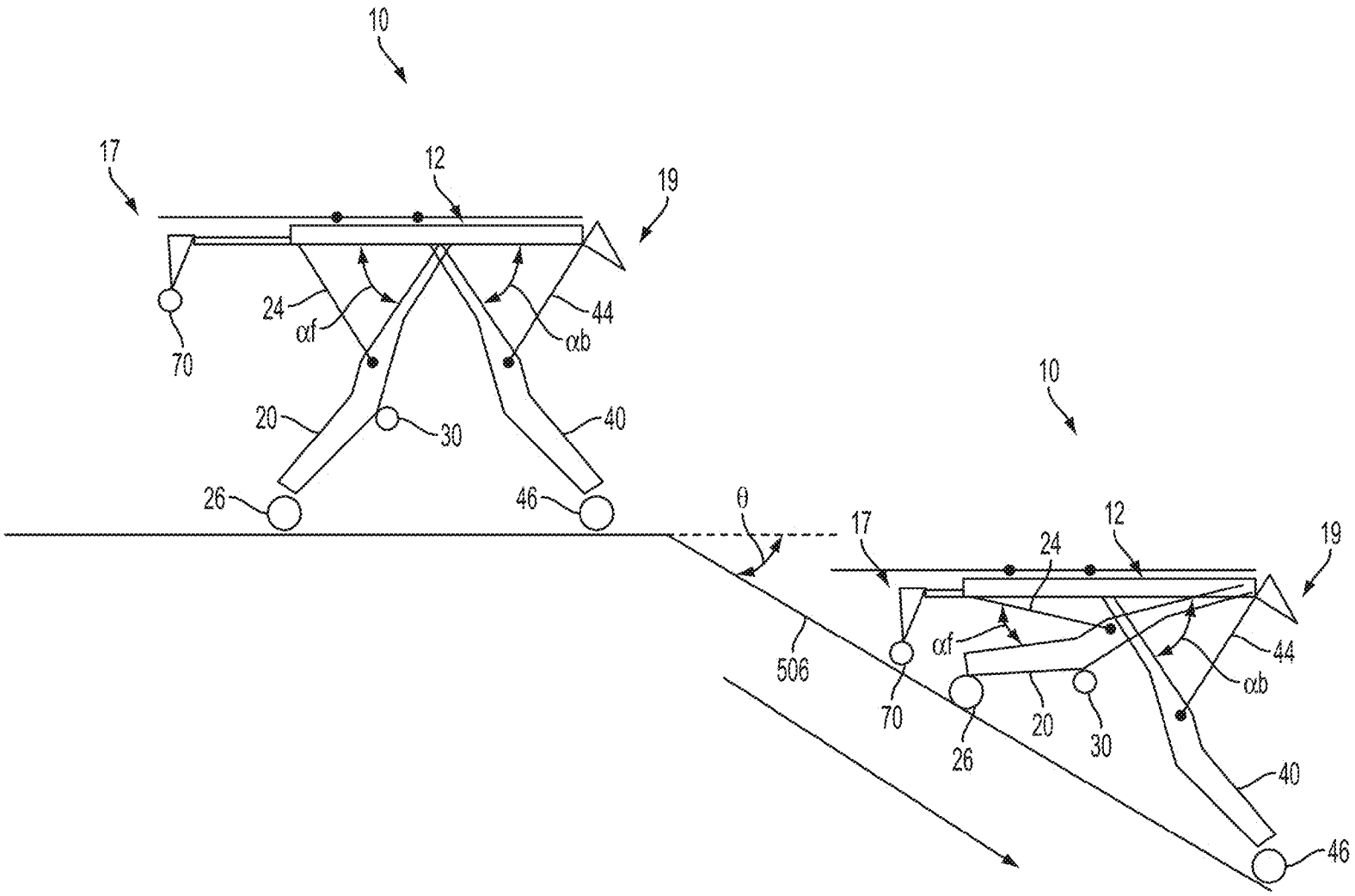
Figure 13:
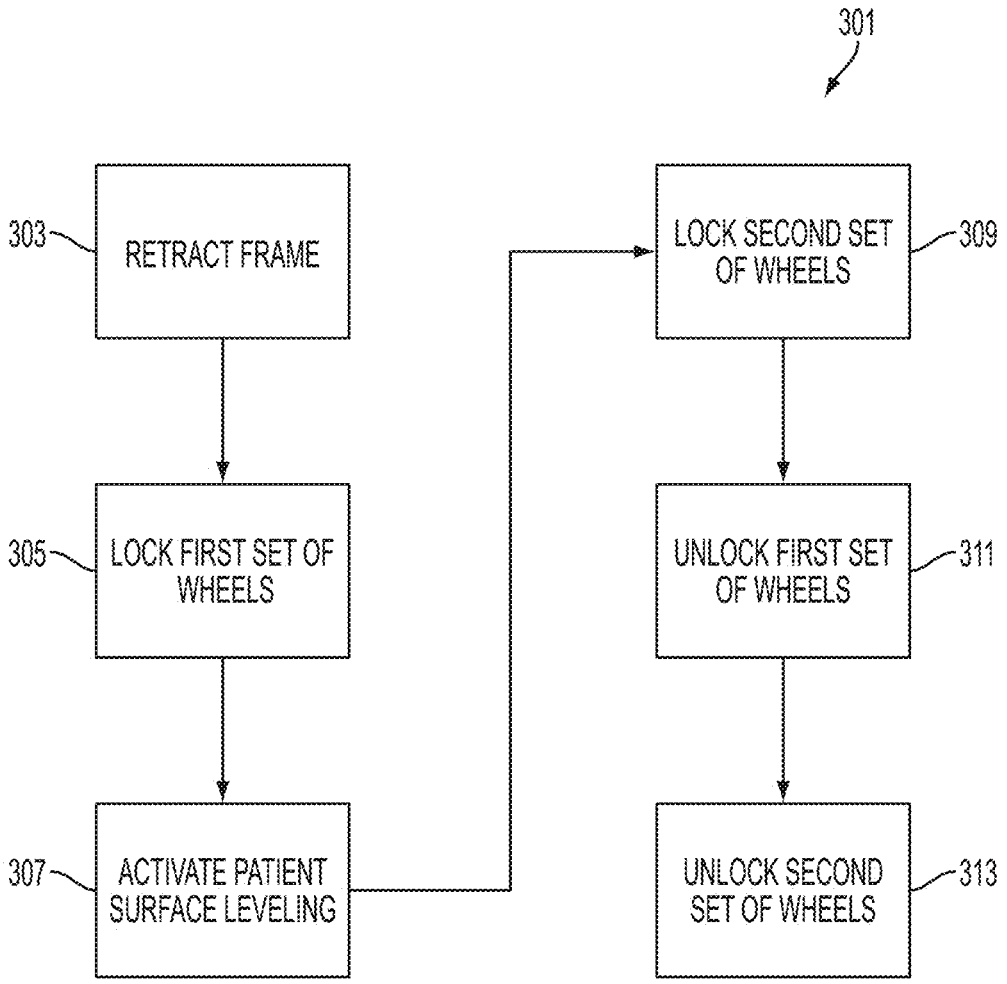
Figure 14A:
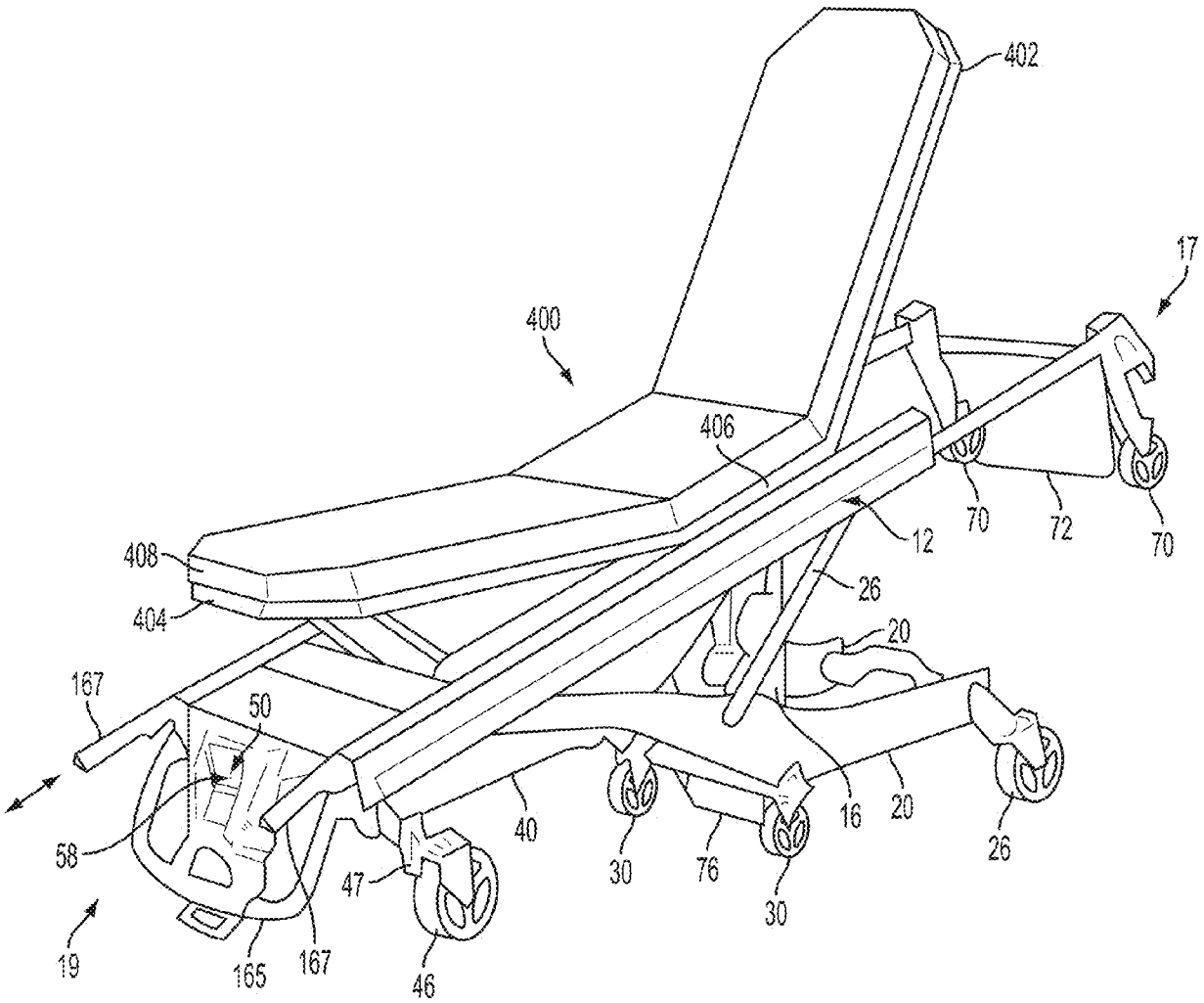
Figure 14B:
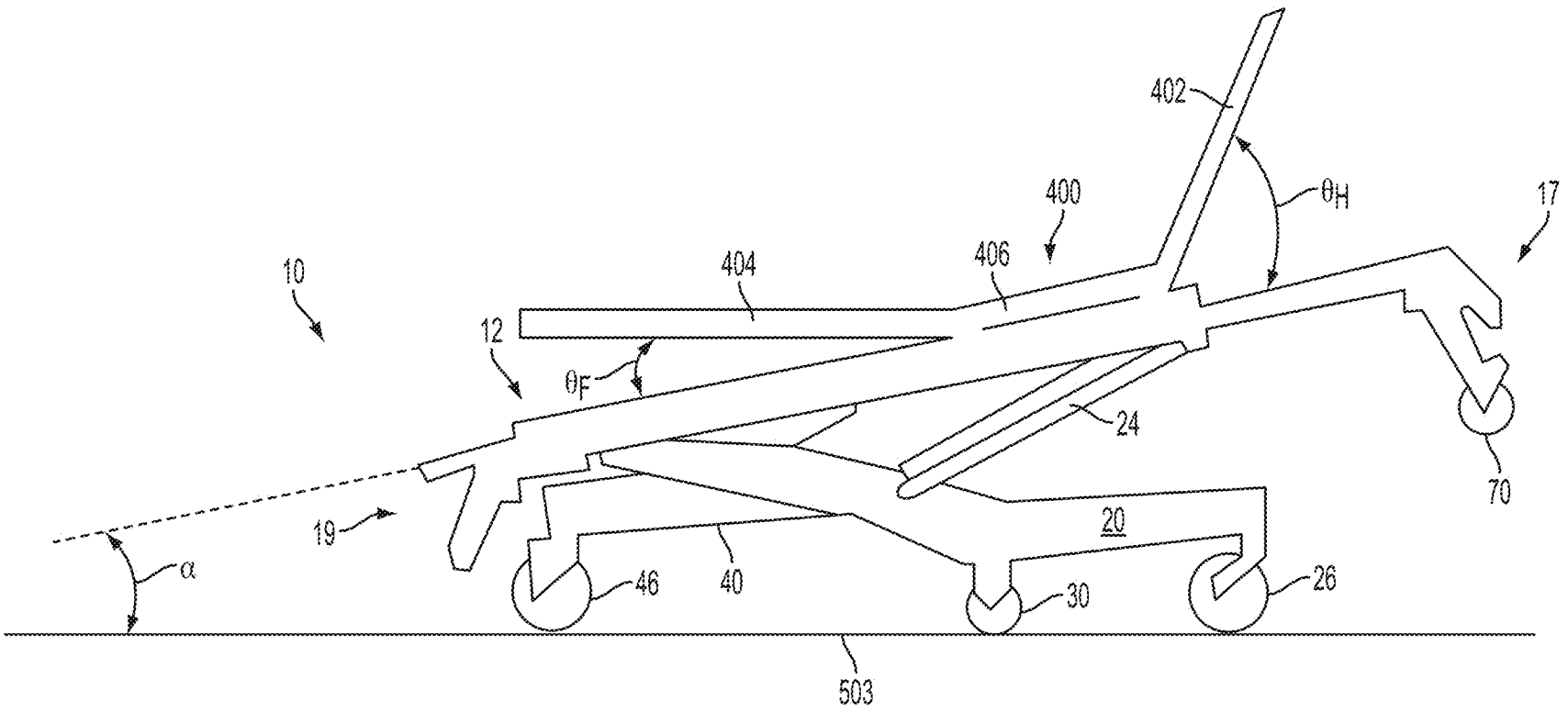
Figure 15:
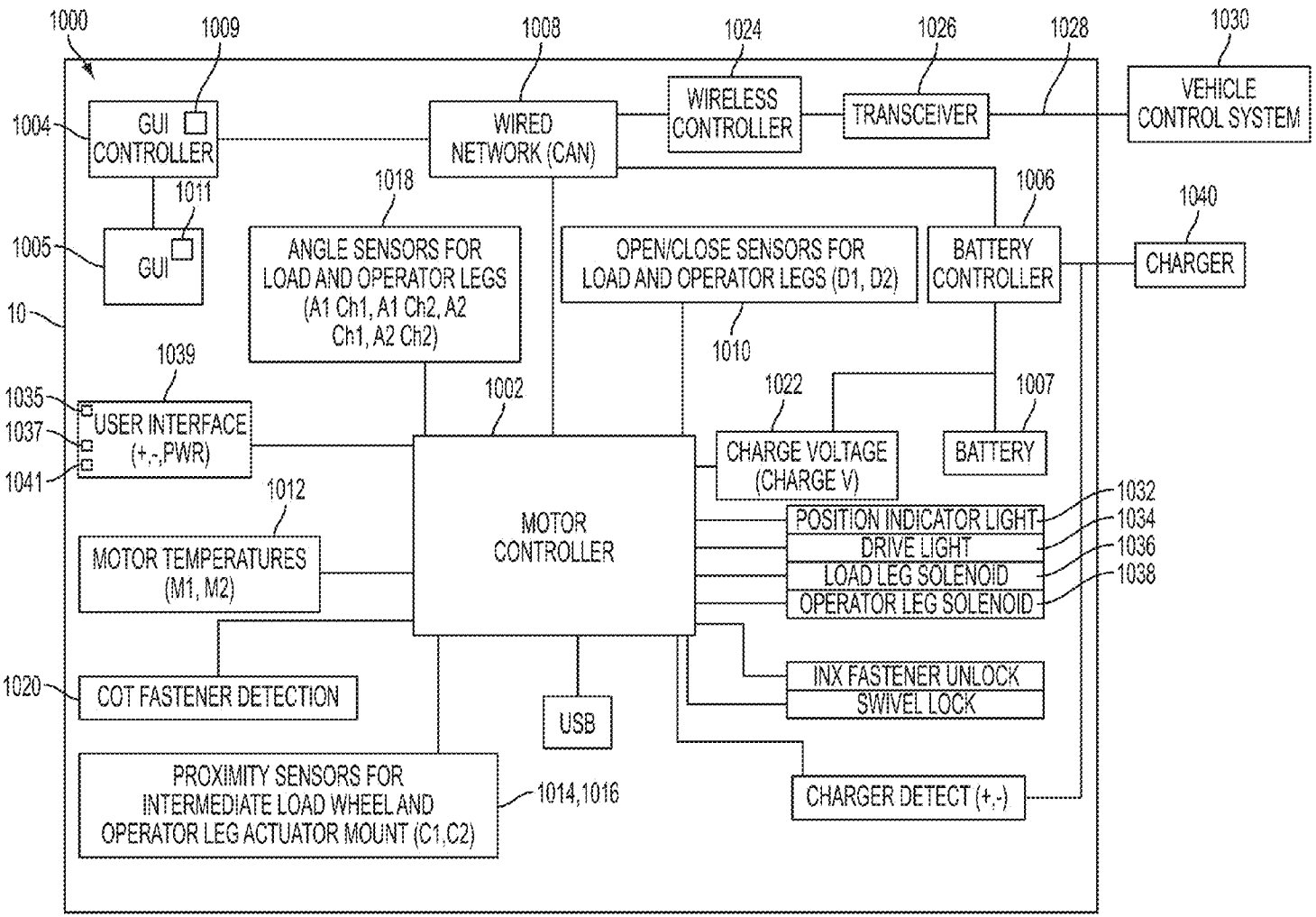
Figure 16:
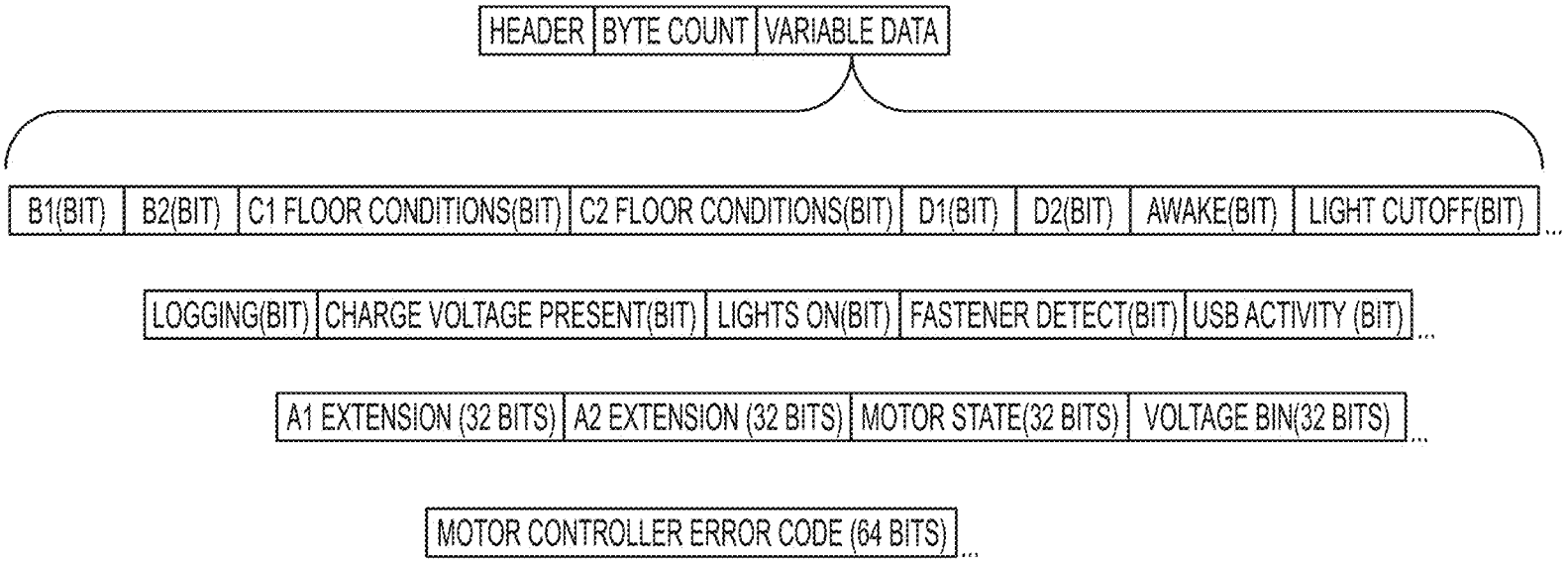
Figure 17:
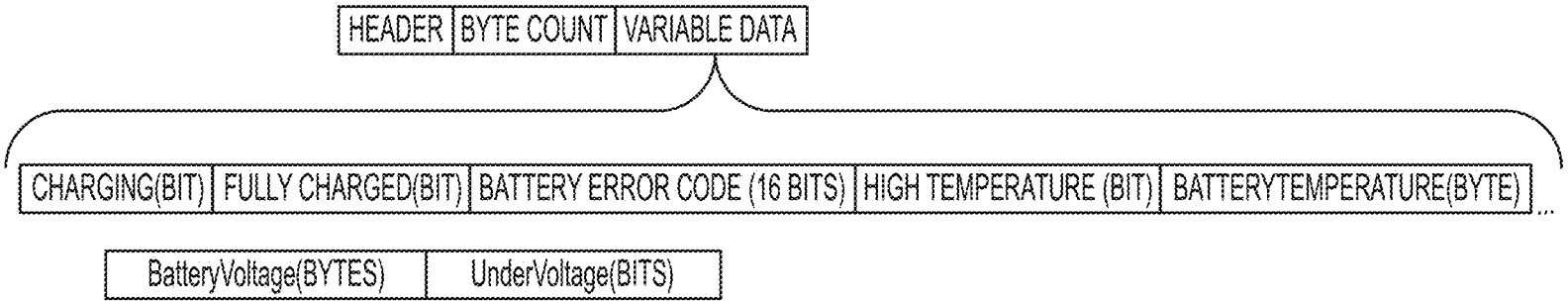
Figure 18:
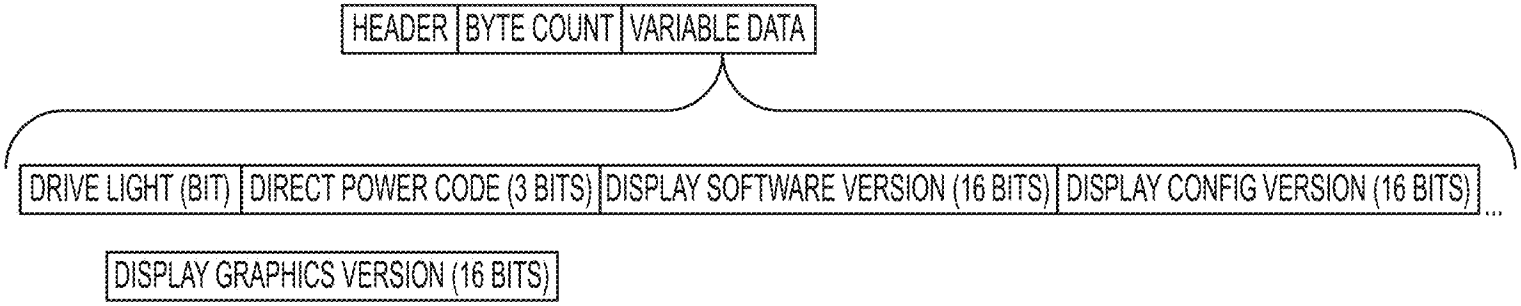
Figure 19:
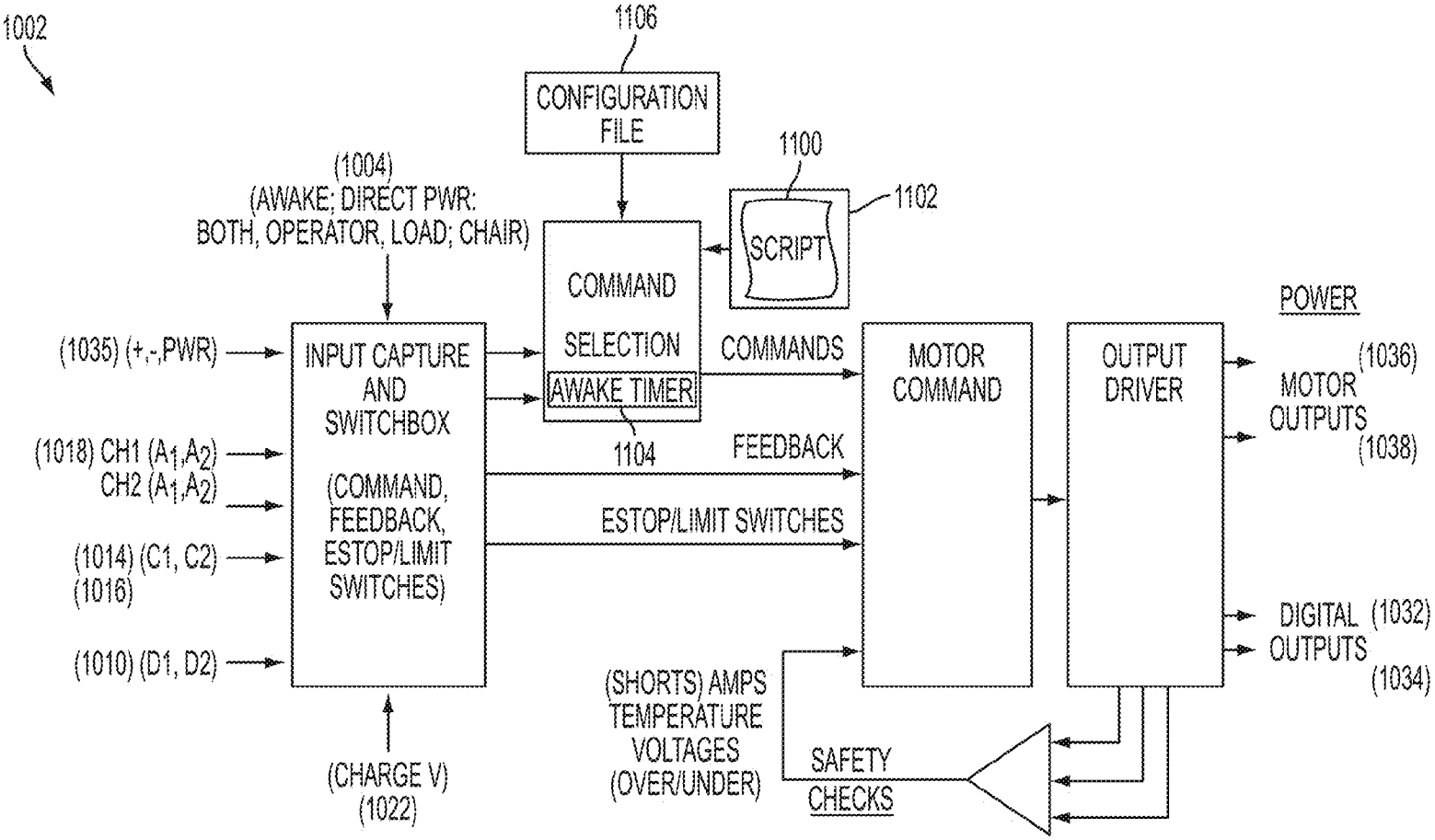
Figure 20:
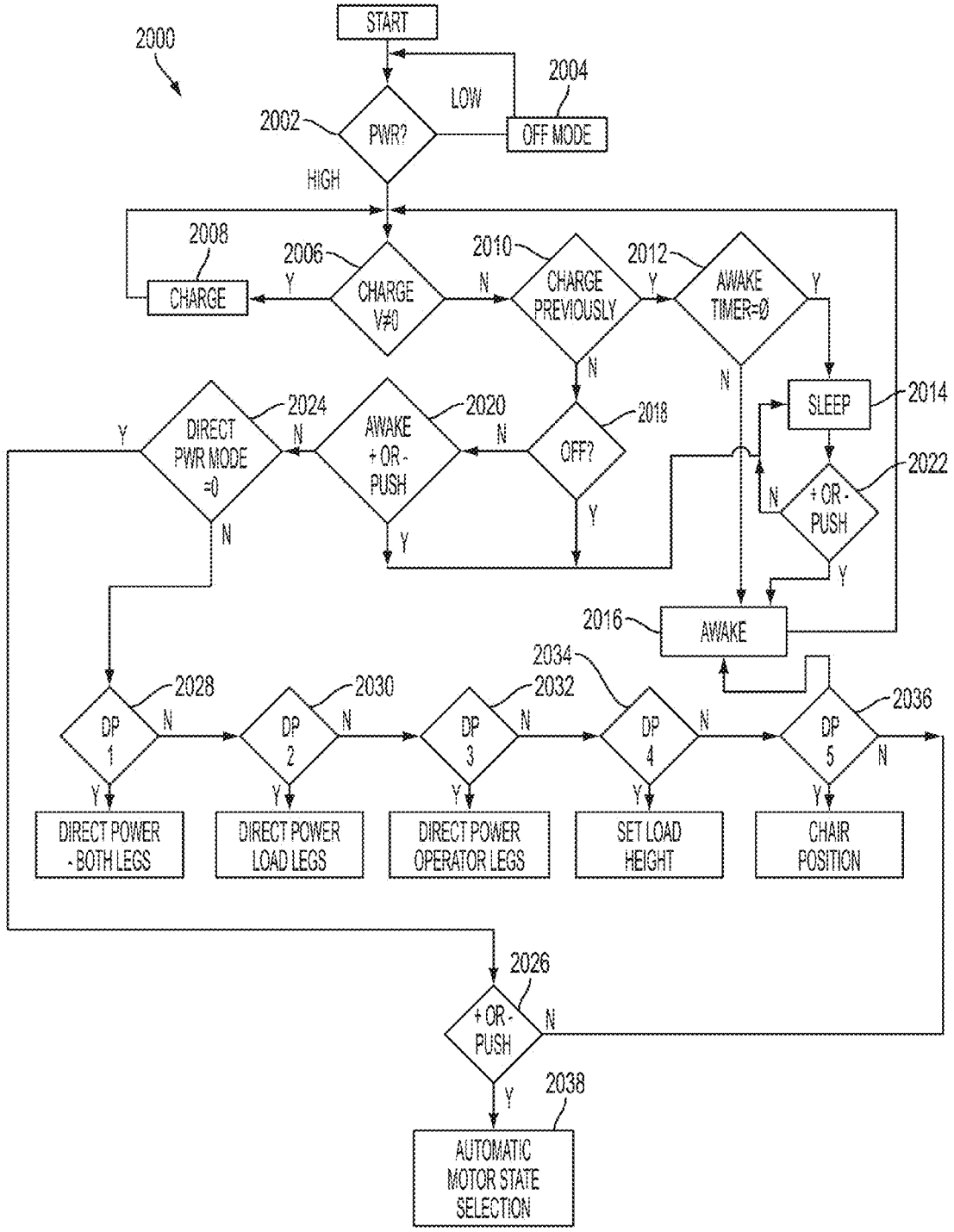
Figure 22:
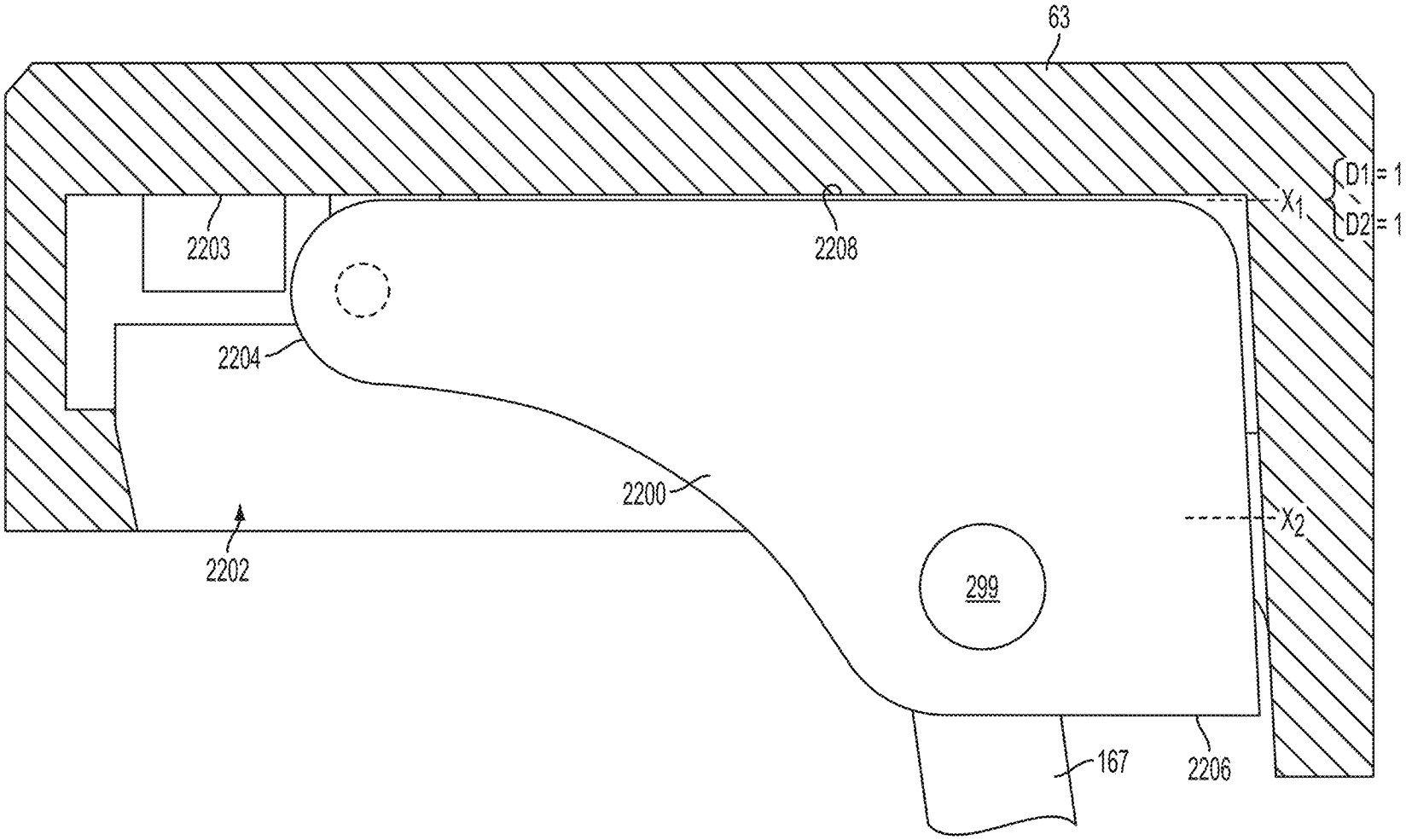
Figure 23:
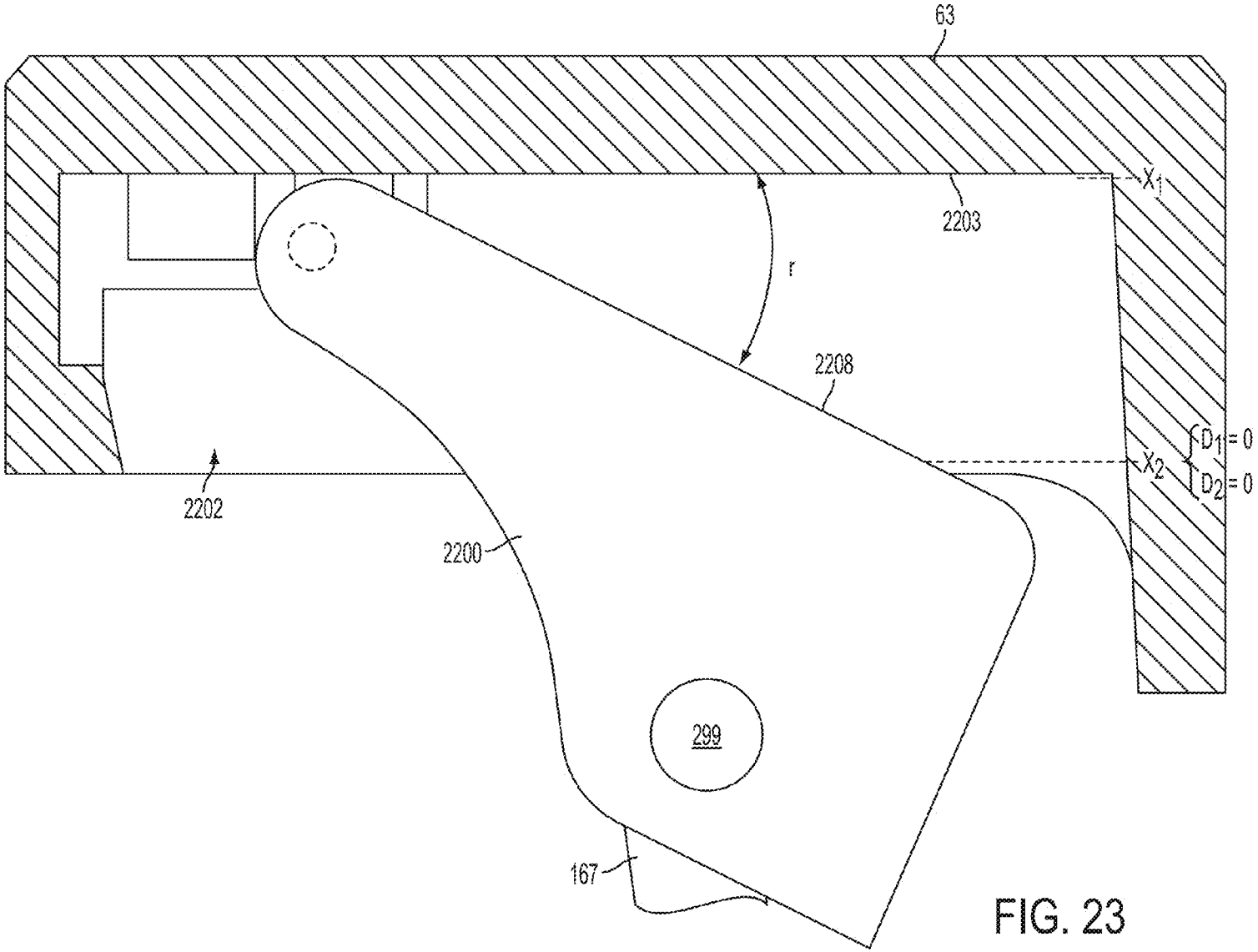

FIG. 6 schematically depicts an actuator system of a roll-in, self-actuating, powered ambulance cot according to one or more embodiments described herein;

FIGS. 6A-6D schematically depict a hydraulic circuit according to one or more embodiments described herein utilized by a roll-in, self-actuating, powered ambulance cot according to one or more embodiments described herein;

FIG. 7 schematically depicts a roll-in, self-actuating, powered ambulance cot having an electrical system according to one or more embodiments described herein;

FIG. 8 schematically depicts a portion of a back end of a roll-in, self-actuating, powered ambulance cot, sectioned for ease of illustration, according to one or more embodiments described herein;

FIG. 9 schematically depicts a wheel assembly utilized by a roll-in, self-actuating, powered ambulance cot according to one or more embodiments described herein;

FIG. 10 schematically depicts a wheel assembly utilized by a roll-in, self-actuating, powered ambulance cot according to one or more embodiments described herein;

FIG. 11 schematically depicts an up escalator function utilized by a roll-in, self-actuating, powered ambulance cot according to one or more embodiments described herein;

FIG. 12 schematically depicts a down escalator function utilized by a roll-in, self-actuating, powered ambulance cot according to one or more embodiments described herein;

FIG. 13 schematically depicts method for performing an escalator function utilized by a roll-in, self-actuating, powered ambulance cot according to one or more embodiments described herein;

FIG. 14A schematically depicts a perspective view of a roll-in, self-actuating, powered ambulance cot in a seated loading or chair position according to one or more embodiments described herein;

FIG. 14B schematically depicts a side view of a roll-in, self-actuating, powered ambulance cot in a seated loading or chair position according to one or more embodiments described herein;

FIG. 15 schematically depicts a cot control system utilized by a roll-in, self-actuating, powered ambulance cot according to one or more embodiments described herein;

FIG. 16 is a diagram which illustrates a communication message sent by a motor controller of the cot control system of FIG. 15 according to one or more embodiments described herein;

FIG. 17 is a diagram which illustrates a communication message sent by a battery controller of the cot control system of FIG. 15 according to one or more embodiments described herein;

FIG. 18 is a diagram which illustrates a communication message sent by a graphical user interface controller of the cot control system of FIG. 15 according to one or more embodiments described herein;

FIG. 19 schematically depicts a motor controller of the cot control system of FIG. 15 according to one or more embodiments described herein;

FIG. 20 is a program flow chart of conditions checked and operations conducted automatically by the cot control system of FIG. 15 according to one or more embodiments described herein;

FIG. 21 is a diagram which illustrates a correlation to an Input Code signal and motor state selection performed by the motor controller of the cot control system of FIG. 19 according to one or more embodiments described herein;

FIG. 22 schematically depicts a cross section view taken along section line A-A in FIG. 3 of a pivot plate of the roll-in, self-actuating, powered ambulance cot in a first position according to one or more embodiments described herein;

FIG. 23 schematically depicts a cross section view taken along section line A-A in FIG. 3 of a pivot plate of the roll-in, self-actuating, powered ambulance cot in a second position according to one or more embodiments described herein; and FIGS. 24A-24D are depictions of a graphical user interface each showing an image representing a different selected mode of operation of the roll-in, self-actuating, powered ambulance cot.

The embodiments set forth in the drawings are illustrative in nature and not intended to be limiting of the embodiments described herein. Moreover, individual features of the drawings and embodiments will be more fully apparent and understood in view of the detailed description.

DETAILED DESCRIPTION

Figure 1:
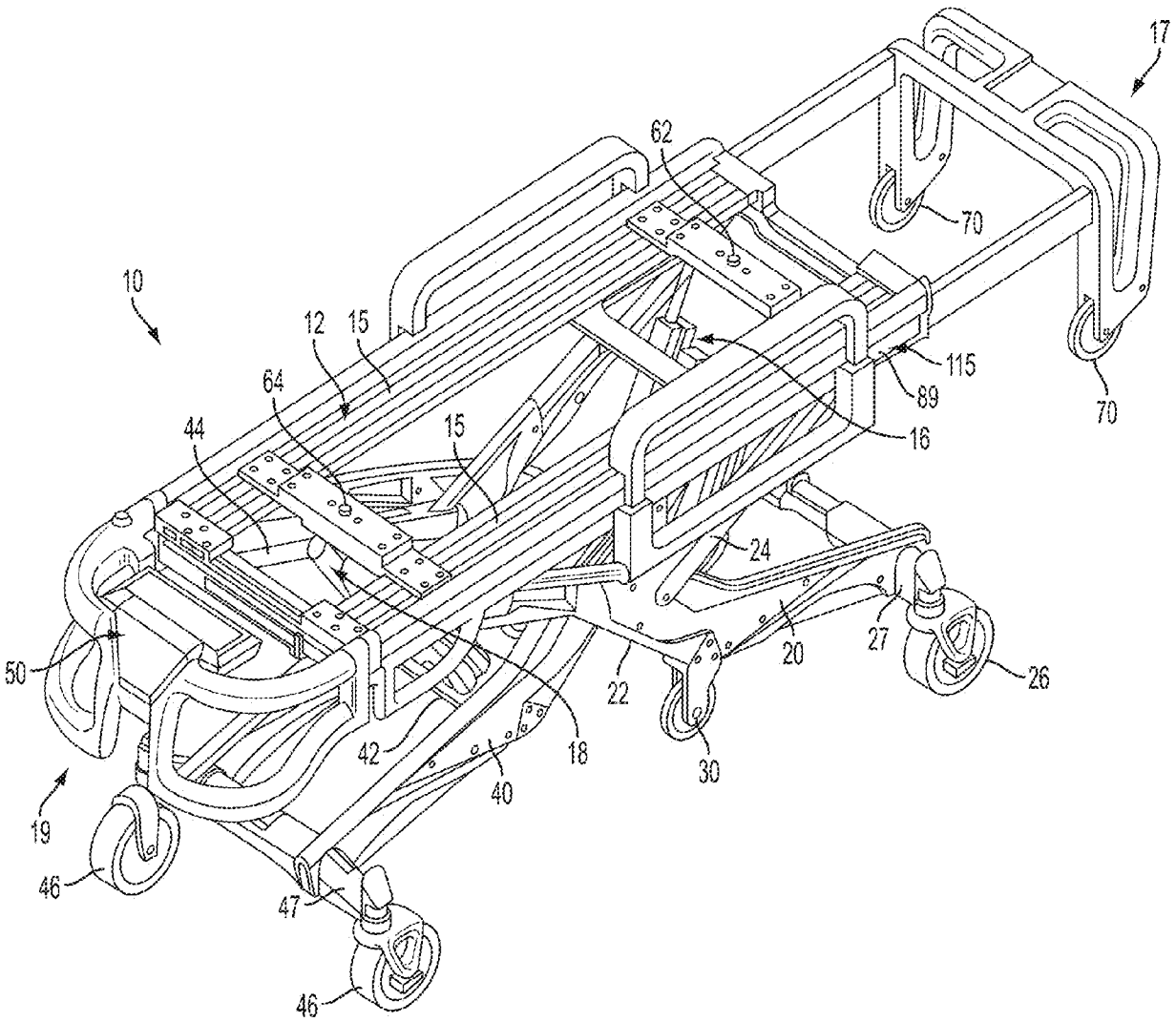
FIG. 1 is a perspective view depicting a roll-in, self-actuating, powered ambulance cot according to one or more embodiments described herein.

Referring to FIG. 1, a roll-in, self-actuating, powered ambulance cot 10 for transporting a patient thereon and loading into an emergency transport vehicle is shown. The cot 10 comprises a support frame 12 comprising a front end 17, and a back end 19. As used herein, the front end 17 is synonymous with the term "loading end", i.e., the end of the cot 10 which is loaded first onto a loading surface. Conversely, as used herein, the back end 19 is the end of the cot 10 which is loaded last onto a loading surface, and is synonymous with the term "control end" which is the end providing a number of operator controls as discussed herein. Additionally it is noted, that when the cot 10 is loaded with a patient, the head of the patient may be oriented nearest to the front end 17 and the feet of the patient may be oriented nearest to the back end 19. Thus, the phrase "head end" may be used interchangeably with the phrase "front end," and the phrase "foot end" may be used interchangeably with the phrase "back end." Furthermore, it is noted that the phrases "front end" and "back end" are interchangeable. Thus, while the phrases are used consistently throughout for clarity, the embodiments described herein may be reversed without departing from the scope of the present disclosure. Generally, as used herein, the term "patient" refers to any living thing or formerly living thing such as, for example, a human, an animal, a corpse and the like.

Figure 2:
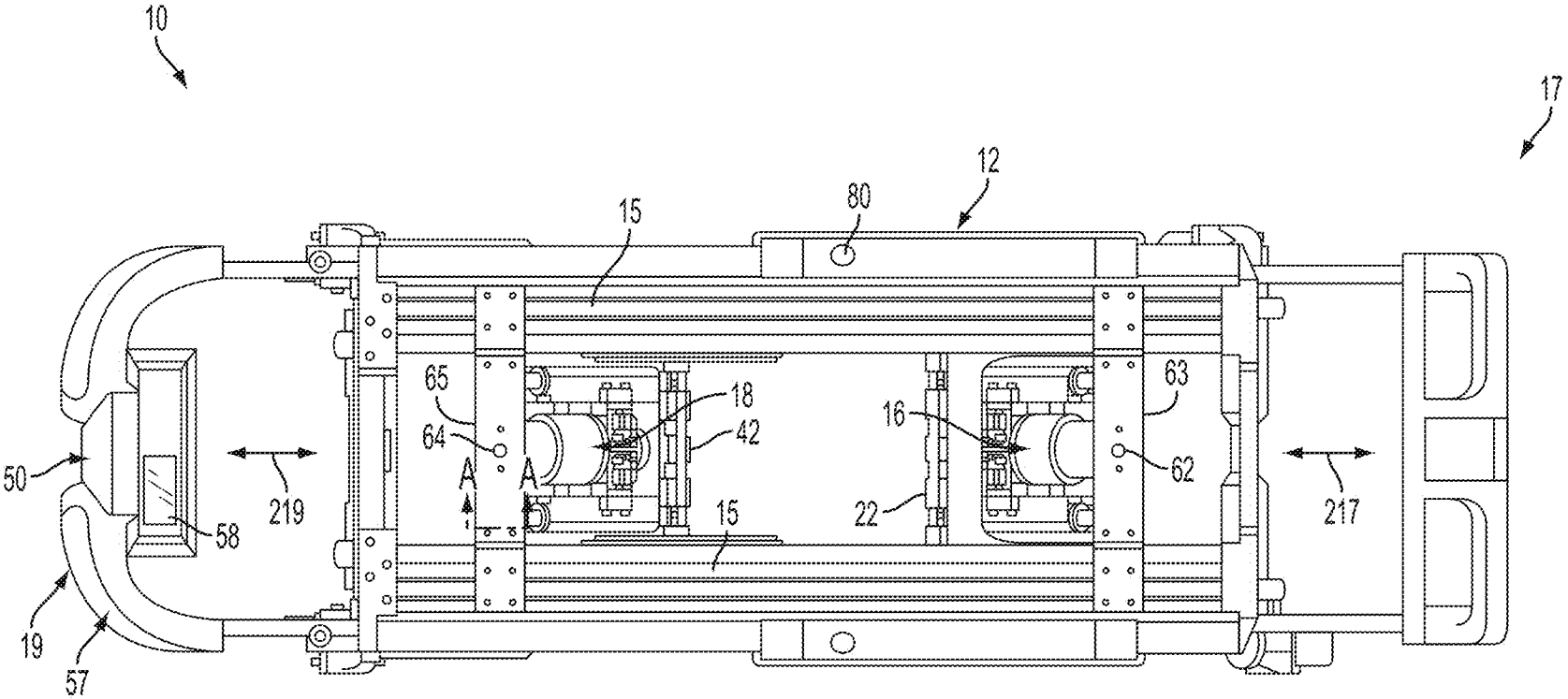
FIG. 2 is a top view depicting a roll-in, self-actuating, powered ambulance cot according to one or more embodiments described herein and showing a section line A-A.

Referring to FIG. 2, the front end 17 and/or the back end 19 may be telescoping. In one embodiment, the front end 17 may be extended and/or retracted (generally indicated in FIG. 2 by arrow 217). In another embodiment, the back end 19 may be extended and/or retracted (generally indicated in FIG. 2 by arrow 219). Thus, the total length between the front end 17 and the back end 19 may be increased and/or decreased to accommodate various sized patients.

Referring collectively to FIGS. 1 and 2, the support frame 12 may comprise a pair of substantially parallel lateral side members 15 extending between the front end 17 and the back end 19. Various structures for the lateral side members 15 are contemplated. In one embodiment, the lateral side members 15 may be a pair of spaced metal tracks. In another embodiment, the lateral side members 15 comprise an undercut portion 115 that can be engaged with an accessory clamp (not depicted). Such accessory clamps may be utilized to removably couple patient care accessories such as a pole for an IV drip to the undercut portion 115. The undercut portion 115 may be provided along the entire length of the lateral side members to allow accessories to be removably clamped to many different locations on the cot 10.

Referring again to FIG. 1, the cot 10 also comprises a pair of retractable and extendible loading end legs 20 coupled to the support frame 12, and a pair of retractable and extendible control end legs 40 coupled to the support frame 12. The cot 10 may comprise any rigid material such as, for example, metal structures or composite structures. Specifically, the support frame 12, the loading end legs 20, the control end legs 40, or combinations thereof may comprise a carbon fiber and resin structure. As is described in greater detail herein, the cot 10 may be raised to multiple heights by extending the loading end legs 20 and/or the control end legs 40, or the cot 10 may be lowered to multiple heights by retracting the loading end legs 20 and/or the control end legs 40. It is noted that terms such as "raise," "lower," "above," "below," and "height" are used herein to indicate the distance relationship between objects measured along a line parallel to gravity using a reference (e.g. a surface supporting the cot).

In specific embodiments, the loading end legs 20 and the control end legs 40 may each be coupled to the lateral side members 15. As shown in FIGS. 4A-5E, the loading end legs 20 and the control end legs 40 may cross each other, when viewing the cot from a side, specifically at respective locations where the loading end legs 20 and the control end legs 40 are coupled to the support frame 12 (e.g., the lateral side members 15 (FIGS. 1-3)). As shown in the embodiment of FIG. 1, the control end legs 40 may be disposed inwardly of the loading end legs 20, i.e., the loading end legs 20 may be spaced further apart from one another than the control end legs 40 are spaced from one another such that the control end legs 40 are each located between the loading end legs 20. Additionally, the loading end legs 20 and the control end legs 40 may comprise front wheels 26 and back wheels 46 which enable the cot 10 to roll.

In one embodiment, the front wheels 26 and back wheels 46 may be swivel caster wheels or swivel locked wheels. As the cot 10 is raised and/or lowered, the front wheels 26 and back wheels 46 may be synchronized to ensure that the plane of the lateral side members 15 of the cot 10 and the plane of the wheels 26, 46 are substantially parallel.

Referring to FIGS. 1-3 and 6, the cot 10 may also comprise a cot actuation system 34 comprising a front actuator 16 configured to move the loading end legs 20 and a back actuator 18 configured to move the control end legs 40. The cot actuation system 34 may comprise one unit (e.g., a centralized motor and pump) configured to control both the front actuator 16 and the back actuator 18. For example, the cot actuation system 34 may comprise one housing with one motor capable to drive the front actuator 16, the back actuator 18, or both utilizing valves, control logic and the like. Alternatively, as depicted in FIG. 1, the cot actuation system 34 may comprise separate units configured to control the front actuator 16 and the back actuator 18 individually. In this embodiment, the front actuator 16 and the back actuator 18 may each include separate housings with individual motors to drive each of the front actuator 16 and the back actuator 18.

The front actuator 16 is coupled to the support frame 12 and configured to actuate the loading end legs 20 and raise and/or lower the front end 17 of the cot 10. Additionally, the back actuator 18 is coupled to the support frame 12 and configured to actuate the control end legs 40 and raise and/or lower the back end 19 of the cot 10. The cot 10 may be powered by any suitable power source. For example, the cot 10 may comprise a battery capable of supplying a voltage of, such as, about 24 V nominal or about 32 V nominal for its power source.

The front actuator 16 and the back actuator 18 are operable to actuate the loading end legs 20 and control end legs 40, simultaneously or independently. As shown in FIGS. 4A-5E, simultaneous and/or independent actuation allows the cot 10 to be set to various heights. The actuators described herein may be capable of providing a dynamic force of about 350 pounds (about 158.8 kg) and a static force of about 500 pounds (about 226.8 kg). Furthermore, the front actuator 16 and the back actuator 18 may be operated by a centralized motor system or multiple independent motor systems.

In one embodiment, schematically depicted in FIGS. 1-3 and 6, the front actuator 16 and the back actuator 18 comprise hydraulic actuators for actuating the cot 10. In one embodiment, the front actuator 16 and the back actuator 18 are dual piggy back hydraulic actuators, i.e., the front actuator 16 and the back actuator 18 each forms a master-slave hydraulic circuit. The master-slave hydraulic circuit comprises four hydraulic cylinders with four extending rods that are piggy backed (i.e., mechanically coupled) to one another in pairs. Thus, the dual piggy back actuator comprises a first hydraulic cylinder with a first rod, a second hydraulic cylinder with a second rod, a third hydraulic cylinder with a third rod and a fourth hydraulic cylinder with a fourth rod. It is noted that, while the embodiments described herein make frequent reference to a master-slave system comprising four hydraulic cylinders, the master-salve hydraulic circuits described herein can include any even number of hydraulic cylinders.

Referring to FIG. 6, the front actuator 16 and the back actuator 18 each comprises a rigid support frame 180 that is substantially "H" shaped (i.e., two vertical portions connected by a cross portion). The rigid support frame 180 comprises a cross member 182 that is coupled to two vertical members 184 at about the middle of each of the two vertical members 184. A pump motor 160 and a fluid reservoir 162 are coupled to the cross member 182 and in fluid communication. In one embodiment, the pump motor 160 and the fluid reservoir 162 are disposed on opposite sides of the cross member 182 (e.g., the fluid reservoir 162 disposed above the pump motor 160). Specifically, the pump motor 160 may be a brushed bi-rotational electric motor with a peak output of about 1400 watts. The rigid support frame 180 may include additional cross members or a backing plate to provide further rigidity and resist twisting or lateral motion of the vertical members 184 with respect to the cross member 182 during actuation.

Each vertical member 184 comprises a pair of piggy backed hydraulic cylinders (i.e., a first hydraulic cylinder and a second hydraulic cylinder or a third hydraulic cylinder and a fourth hydraulic cylinder) wherein the first cylinder extends a rod in a first direction and the second cylinder extends a rod in a substantially opposite direction. When the cylinders are arranged in one master-slave configuration, one of the vertical members 184 comprises an upper master cylinder 168 and a lower master cylinder 268. The other of the vertical members 184 comprises an upper slave cylinder 169 and a lower slave cylinder 269. It is noted that, while master cylinders 168, 268 are piggy backed together and extend rods 165, 265 in substantially opposite directions, master cylinders 168, 268 may be located in alternate vertical members 184 and/or extend rods 165, 265 in substantially the same direction.

Referring now to FIGS. 6A-6D, the cylinder housing 122 can comprise an upper cylinder 168 and a lower cylinder 268. An upper piston 164 can be confined within the upper cylinder 168 and configured to travel throughout the upper piston 164 when acted upon by hydraulic fluid. The upper rod 165 can be coupled to the upper piston 164 and move with the upper piston 164. The upper cylinder 168 can be in fluidic communication with a rod extending fluid path 312 and a rod retracting fluid path 322 on opposing sides of the upper piston 164. Accordingly, when the hydraulic fluid is supplied with greater pressure via the rod extending fluid path 312 than the rod retracting fluid path 322, the upper piston 164 can extend and can urge fluid out of the upper piston 164 via the rod retracting fluid path 322. When the hydraulic fluid is supplied with greater pressure via the rod retracting fluid path 322 than the rod extending fluid path 312, the upper piston 164 can retract and can urge fluid out of the upper piston 164 via the rod extending fluid path 312.

Similarly, a lower piston 264 can be confined within the lower cylinder 268 and can be configured to travel throughout the lower piston 264 when acted upon by hydraulic fluid. The lower rod 265 can be coupled to the lower piston 264 and move with the lower piston 264. The lower cylinder 268 can be in fluidic communication with a rod extending fluid path 314 and a rod retracting fluid path 324 on opposing sides of the lower piston 264. Accordingly, when the hydraulic fluid is supplied with greater pressure via the rod extending fluid path 314 than the rod retracting fluid path 324, the lower piston 264 can extend and can urge fluid out of the lower piston 264 via the rod retracting fluid path 324. When the hydraulic fluid is supplied with greater pressure via the rod retracting fluid path 324 than the rod extending fluid path 314, the lower piston 264 can retract and can urge fluid out of the lower piston 264 via the rod extending fluid path 314.

In some embodiments, the hydraulic actuator 120 actuates the upper rod 165 and the lower rod 265 in a self-balancing manner to allow the upper rod 165 and the lower rod 265 to extend and retract at different rates. It has been discovered by the applicants that the hydraulic actuator 120 can extend and retract with greater reliability and speed when the upper rod 165 and the lower rod 265 self-balance. Without being bound to theory, it is believed that the differential rate of actuation of the upper rod 165 and the lower rod 265 allows the hydraulic actuator 120 to respond dynamically to a variety of loading conditions. For example, the rod extending fluid path 312 and the rod extending fluid path 314 can be in direct fluid communication with one another without any pressure regulating device disposed there between. Similarly, the rod retracting fluid path 322 and the rod retracting fluid path 324 can be in direct fluid communication with one another without any pressure regulating device disposed there between. Accordingly, when hydraulic fluid is urged through the rod extending fluid path 312 and the rod extending fluid path 314, contemporaneously, the upper rod 165 and the lower rod 265 can extend differentially depending upon difference in the resistive forces acting upon each of the upper rod 165 and the lower rod 265 such as, for example, applied load, displaced volume, linkage motion, or the like. Similarly, when hydraulic fluid is urged through the rod retracting fluid path 322 and the rod retracting fluid path 324, contemporaneously, the upper rod 165 and the lower rod 265 can retract differentially depending upon the difference in resistive forces acting upon each the upper rod 165 and the lower rod 265.

Referring still to FIGS. 6A-6D, the hydraulic circuit housing 150 can form a hydraulic circuit 300 for transmitting fluid through the extending fluid path 310 and the retracting fluid path 320. In some embodiments, the hydraulic circuit 300 can be configured such that selective operation of the pump motor 160 can push or pull hydraulic fluid at each of the extending fluid path 310 and the retracting fluid path 320. Specifically, the pump motor 160 can be in fluidic communication with the fluid reservoir 162 via a fluid supply path 304. The pump motor 160 can also be in fluidic communication with the extending fluid path 310 via a pump extend fluid path 326 and the retracting fluid path 320 via a pump retract fluid path 316. Accordingly, the pump motor 160 can pull hydraulic fluid from the fluid reservoir 162 and urge the hydraulic fluid through the pump extend fluid path 326 or the pump retract fluid path 316 to extend or retract the hydraulic actuator 120. It is noted that, while the embodiments of the hydraulic circuit 300 described herein with respect to FIGS. 6A-6D detail the use of certain types of components such as solenoid valves, check valves, counter balance valves, manual valves, or flow regulators, the embodiments described herein are not restricted to the use of any particular component. Indeed the components described with respect to the hydraulic circuit 300 can be replaced with equivalents which in combination perform the function of the hydraulic circuit 300 described herein.

Figure 6A:
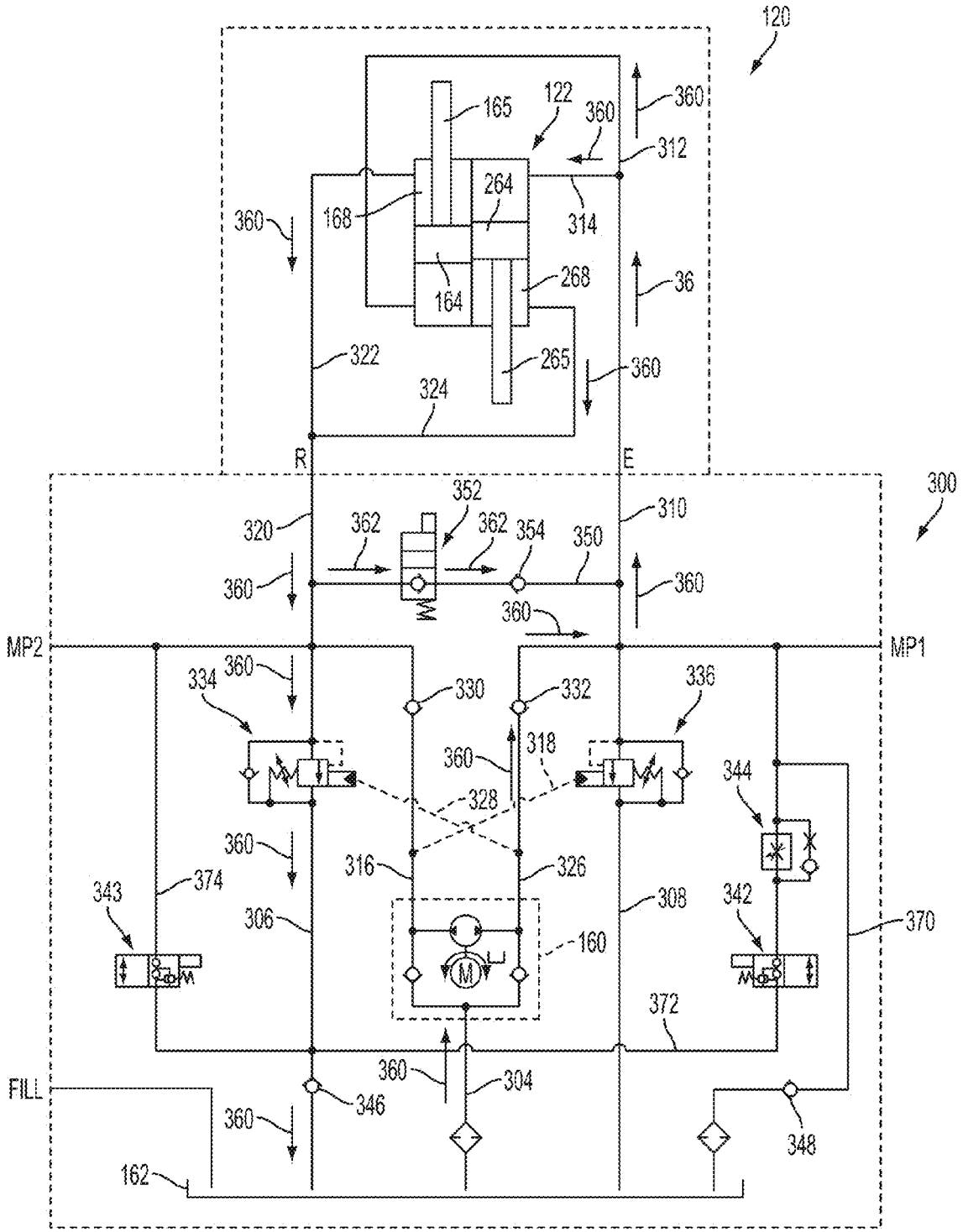

Referring to FIG. 6A, the pump motor 160 can urge hydraulic fluid along the extending route 360 (generally indicated by arrows) to extend the upper rod 165 and the lower rod 265. In some embodiments, the extending fluid path 310 can be in fluid communication with the rod extending fluid path 312 and the rod extending fluid path 314. The retracting fluid path 320 can be in fluid communication with the rod retracting fluid path 322 and the rod retracting fluid path 324. The pump motor 160 can pull hydraulic fluid from the fluid reservoir 162 via the fluid supply path. Hydraulic fluid can be urged towards the extending fluid path 310 via the pump extend fluid path 326.

The pump extend fluid path 326 can comprise a check valve 332 that is configured to prevent hydraulic fluid from flowing from the extending fluid path 310 to the pump motor 160 and allow hydraulic fluid to flow from the pump motor 160 to the extending fluid path 310. Accordingly, the pump motor 160 can urge hydraulic fluid through the extending path into the rod extending fluid path 312 and the rod extending fluid path 314. Hydraulic fluid can flow along the extending route 360 into the upper cylinder 168 and the lower cylinder 268. Hydraulic fluid flowing into the upper cylinder 168 and the lower cylinder 268 can cause hydraulic fluid to flow into the rod retracting fluid path 322 and the rod retracting fluid path 324 as the upper rod 165 and the lower rod 265 extend. Hydraulic fluid can then flow along the extending route 360 into the retracting fluid path 320.

The hydraulic circuit 300 can further comprise an extending return fluid path 306 in fluidic communication with each of the retracting fluid path 320 and the fluid reservoir 162. In some embodiments, the extending return fluid path 306 can comprise a counterbalance valve 334 configured to allow hydraulic fluid to flow from the fluid reservoir 162 to the retracting fluid path 320, and prevent hydraulic fluid from flowing from the retracting fluid path 320 to the fluid reservoir 162, unless an appropriate pressure is received via a pilot line 328. The pilot line 328 can be in fluidic communication with both the pump extend fluid path 326 and the counterbalance valve 334. Accordingly, when the pump motor 160 pumps hydraulic fluid through pump extend fluid path 326, the pilot line 328 can cause the counterbalance valve 334 to modulate and allow hydraulic fluid to flow from the retracting fluid path 320 to the fluid reservoir 162.

Optionally, the extending return fluid path 306 can comprise a check valve 346 that is configured to prevent hydraulic fluid from flowing from the fluid reservoir 162 to the retracting fluid path 320 and allow hydraulic fluid to flow from the extending return fluid path 306 to the fluid reservoir 162. Accordingly, the pump motor 160 can urge hydraulic fluid through the retracting fluid path 320 to the fluid reservoir 162. In some embodiments, a relatively large amount of pressure can be required to open the check valve 332 compared to the relatively low amount of pressure required to open the check valve 346. In further embodiments, the relatively large amount of pressure required to open the check valve 332 can be more than about double the relatively low amount of pressure required to open the check valve 346 such as, for example, about 3 times the pressure or more in another embodiment, or about 5 times the pressure or more in yet another embodiment.

In some embodiments, the hydraulic circuit 300 can further comprise a regeneration fluid path 350 that is configured to allow hydraulic fluid to flow directly from the retracting fluid path 320 to the extending fluid path 310. Accordingly, the regeneration fluid path 350 can allow hydraulic fluid supplied from the rod retracting fluid path 322 and the rod retracting fluid path 324 to flow along a regeneration route 362 towards the rod extending fluid path 312 and the rod extending fluid path 314. In further embodiments, the regeneration fluid path 350 can comprise a logical valve 352 that is configured to selectively allow hydraulic fluid to travel along the regeneration route 362. The logical valve 352 can be communicatively coupled to a processor or sensor and configured to open when the cot is in a predetermined state. For example, when the hydraulic actuator 120 that is associated with a leg is in a second position relative to a first position, which, as described herein, can indicate an unloaded state, the logical valve 352 can be opened. It can be desirable to open the logical valve 352 during the extension of the hydraulic actuator 120 to increase the speed of extension. The regeneration fluid path 350 can further comprise a check valve 354 that is configured to prevent hydraulic fluid from flowing from the retracting fluid path 320 to the extending fluid path 310. In some embodiments, the amount of pressure required to open the check valve 332 is about the same as the amount of pressure required to open the check valve 354.

Figure 6B:
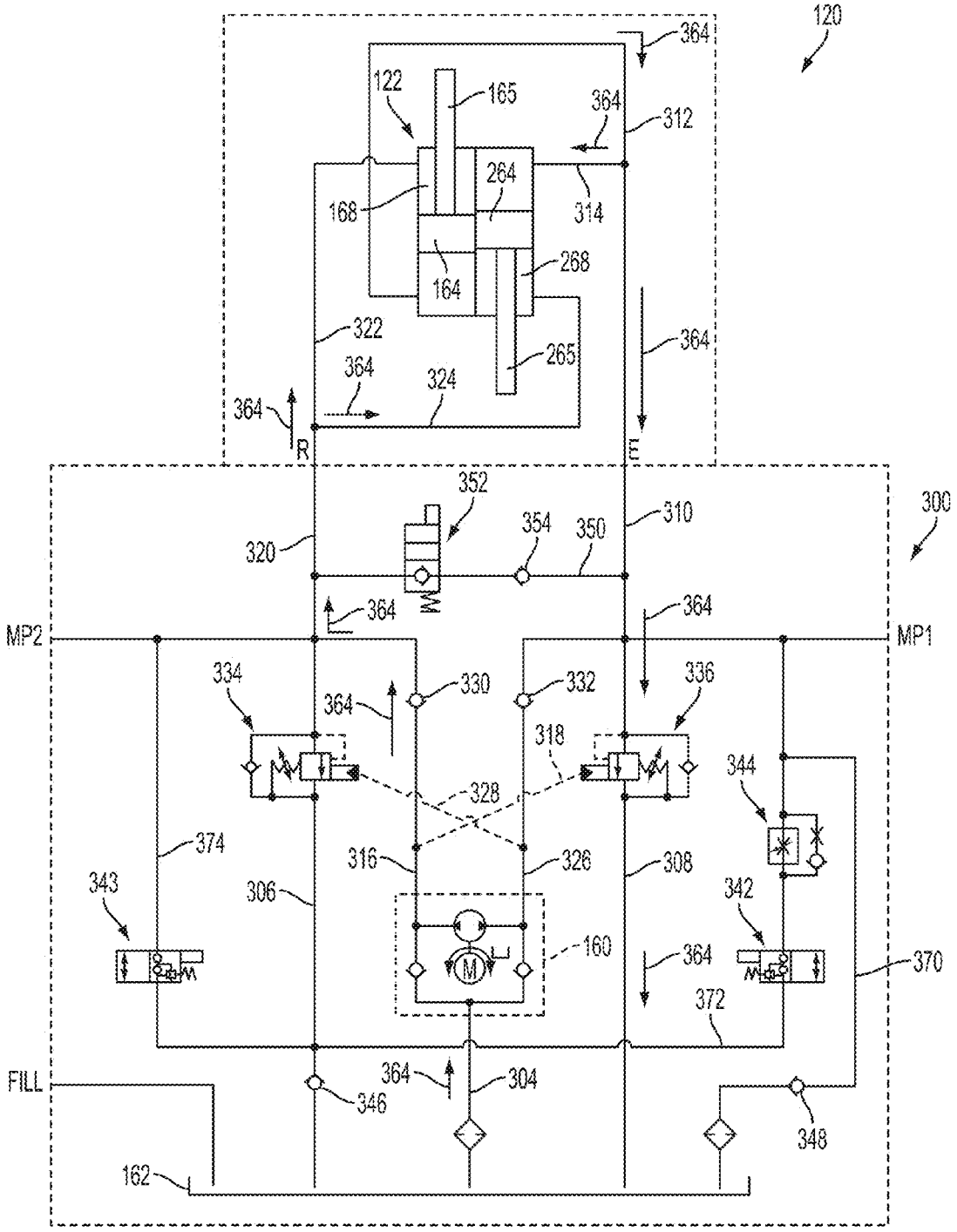

Referring to FIG. 6B, the pump motor 160 can urge hydraulic fluid along the retracting route 364 (generally indicated by arrows) to retract the upper rod 165 and the lower rod 265. The pump motor 160 can pull hydraulic fluid from the fluid reservoir 162 via the fluid supply path 304. Hydraulic fluid can be urged towards the retracting fluid path 320 via the pump retract fluid path 316. The pump retract fluid path 316 can comprise a check valve 330 that is configured to prevent hydraulic fluid from flowing from the retracting fluid path 320 to the pump motor 160 and allow hydraulic fluid to flow from the pump motor 160 to the retracting fluid path 320. Accordingly, the pump motor 160 can urge hydraulic fluid through the retracting fluid path 320 into the rod retracting fluid path 322 and the rod retracting fluid path 324.

Hydraulic fluid can flow along the retracting route 364 into the upper cylinder 168 and the lower cylinder 268. Hydraulic fluid flowing into the upper cylinder 168 and the lower cylinder 268 can cause hydraulic fluid to flow into the rod extending fluid path 312 and the rod extending fluid path 314 as the upper rod 165 and the lower rod 265 retract. Hydraulic fluid can then flow along the retracting route 364 into the extending fluid path 310.

The hydraulic circuit 300 can further comprise a retracting return fluid path 308 in fluidic communication with each of the extending fluid path 310 and the fluid reservoir 162. In some embodiments, the retracting return fluid path 308 can comprise a counterbalance valve 336 configured to allow hydraulic fluid to flow from the fluid reservoir 162 to the extending fluid path 310, and prevent hydraulic fluid from flowing from the extending fluid path 310 to the fluid reservoir 162, unless an appropriate pressure is received via a pilot line 318. The pilot line 318 can be in fluidic communication with both the pump retract fluid path 316 and the counterbalance valve 336. Accordingly, when the pump motor 160 pumps hydraulic fluid through the pump retract fluid path 316, the pilot line 318 can cause the counterbalance valve 336 to modulate and allow hydraulic fluid to flow from the extending fluid path 310 to the fluid reservoir 162.

Referring collectively to FIGS. 6A-6D, while the hydraulic actuator 120 is typically powered by the pump motor 160, the hydraulic actuator 120 can be actuated manually after bypassing the pump motor 160. Specifically, the hydraulic circuit 300 can comprise a manual supply fluid path 370, a manual retract return fluid path 372, and a manual extend return fluid path 374. The manual supply fluid path 370 can be configured for supplying fluid to the upper cylinder 168 and the lower cylinder 268. In some embodiments, the manual supply fluid path 370 can be in fluidic communication with the fluid reservoir 162 and the extending fluid path 310. In further embodiments, the manual supply fluid path 370 can comprise a check valve 348 that is configured to prevent hydraulic fluid from flowing from the manual supply fluid path 370 to the fluid reservoir 162 and allow hydraulic fluid to flow from the fluid reservoir 162 to the extending fluid path 310. Accordingly, manual manipulation of the upper piston 164 and the lower piston 264 can cause hydraulic fluid to flow through the check valve 348. In some embodiments, a relatively low amount of pressure can be required to open the check valve 348 compared to a relatively large amount of pressure required to open the check valve 346. In further embodiments, the relatively low amount of pressure required to open the check valve 348 can be less than or equal to about ½ of the relatively large amount of pressure required to open the check valve 346 such as, for example, less than or equal to about ⅕ in another embodiment, or less than or equal to about 1/10 in yet another embodiment.

The manual retract return fluid path 372 can be configured to return hydraulic fluid from the upper cylinder and the lower cylinder 268 to the fluid reservoir 162, back to the upper cylinder 168 and the lower cylinder 268, or both. In some embodiments, the manual retract return fluid path 372 can be in fluidic communication with the extending fluid path 310 and the extending return fluid path 306. The manual retract return fluid path 372 can comprise a manual valve 342 that can be actuated from a normally closed position to an open position and a flow regulator 344 configured to limit the amount of hydraulic fluid that can flow through the manual retract return fluid path 372, i.e., volume per unit time. Accordingly, the flow regulator 344 can be utilized to provide a controlled descent of the cot 10. It is noted that, while the flow regulator 344 is depicted in FIGS. 12A-12D as being located between the manual valve 342 and the extending fluid path 310, the flow regulator 344 can be located in any position throughout the hydraulic circuit 300 suitable for limiting the rate the upper rod 165, the lower rod 265, or both can retract.

The manual extend return fluid path 374 can be configured to return hydraulic fluid from the upper cylinder 168 and the lower cylinder 268 to the fluid reservoir 162, back to the upper cylinder 168 and the lower cylinder 268, or both. In some embodiments, the manual extend return fluid path 374 can be in fluidic communication with the retracting fluid path 320, the manual retract return fluid path 372 and the extending return fluid path 306. The manual extend return fluid path 374 can comprise a manual valve 343 that can be actuated from a normally closed position to an open position.

In some embodiments, the hydraulic circuit 300 can also comprise a manual release component (e.g., a button, tension member, switch, linkage or lever) that actuates the manual valve 342 and manual valve 343 to allow the upper rod 165 and the lower rod 265 to extend and retract without the use of the pump motor 160. Referring to the embodiments of FIG. 6C, the manual valve 342 and the manual valve 343 can be opened, e.g., via the manual release component. A force can act upon the hydraulic circuit 300 to extend the upper rod 165 and the lower rod 265 such as, for example, gravity or manual articulation of the upper rod 165 and the lower rod 265. With manual valves 342 and 343 opened, hydraulic fluid can flow along the manual extend route 366 to facilitate extension of the upper rod 165 and the lower rod 265. Specifically, as the upper rod 165 and the lower rod 265 are extended hydraulic fluid can be displaced from the upper cylinder 168 and the lower cylinder 268 into the rod retracting fluid path 322 and the rod retracting fluid path 324. Hydraulic fluid can travel from the rod retracting fluid path 322 and the rod retracting fluid path 324 into the retracting fluid path 320.

Hydraulic fluid can also travel through the manual extend return fluid path 374 towards the extending return fluid path 306 and the manual retract return fluid path 372. Depending upon the rate of extension of the upper rod 165 and the lower rod 265, or applied force, hydraulic fluid can flow through the extending return fluid path 306, beyond the check valve 346 and into the fluid reservoir 162. Hydraulic fluid can also flow through the manual retract return fluid path 372 towards the extending fluid path 310. Hydraulic fluid can also be supplied from the fluid reservoir 162 via the manual supply fluid path 370 to the extending fluid path 310, i.e., when the manual operation generates sufficient pressure for the hydraulic fluid to flow beyond check valve 348. Hydraulic fluid at the extending fluid path 310 can flow to the rod extending fluid path 312 and the rod extending fluid path 314. The manual extension of the upper rod 165 and the lower rod 265 can cause hydraulic fluid to flow into the upper cylinder 168 and the lower cylinder 268 from the rod extending fluid path 312 and the rod extending fluid path 314.

Referring again to FIG. 6D, when the manual valve 342 and the manual valve 343 are opened, hydraulic fluid can flow along the manual retract route 368 to facilitate retraction of the upper rod 165 and the lower rod 265. Specifically, as the upper rod 165 and the lower rod 265 are retracted, hydraulic fluid can be displaced from the upper cylinder 168 and the lower cylinder 268 into the rod extending fluid path 312 and the rod extending fluid path 314. Hydraulic fluid can travel from the rod extending fluid path 312 and the rod extending fluid path 314 into the extending fluid path 310.

Hydraulic fluid can also travel through the manual retract return fluid path 372 towards the flow regulator 344, which operates to limit the rate at which the hydraulic fluid can flow and the rate at which the upper rod 165 and the lower rod 265 can retract. Hydraulic fluid can then flow towards the manual extend return fluid path 374. The hydraulic fluid can then flow through the manual extend return fluid path 374 and into the retracting fluid path 320. Depending upon the rate of retraction of the upper rod 165 and the lower rod 265 and the permissible flow rate of the flow regulator 344, some hydraulic fluid may leak beyond the check valve 346 and into the fluid reservoir 162. In some embodiments, the rate of permissible flow rate of the flow regulator 344 and the opening pressure of the check valve 346 can be configured to substantially prevent hydraulic fluid from flowing beyond the check valve 346 during manual retraction. It has been discovered by the applicants that prohibiting flow beyond the check valve 346 can ensure that the upper cylinder 168 and the lower cylinder 268 remain primed with reduced air infiltration during manual retraction.

Figure 6C:
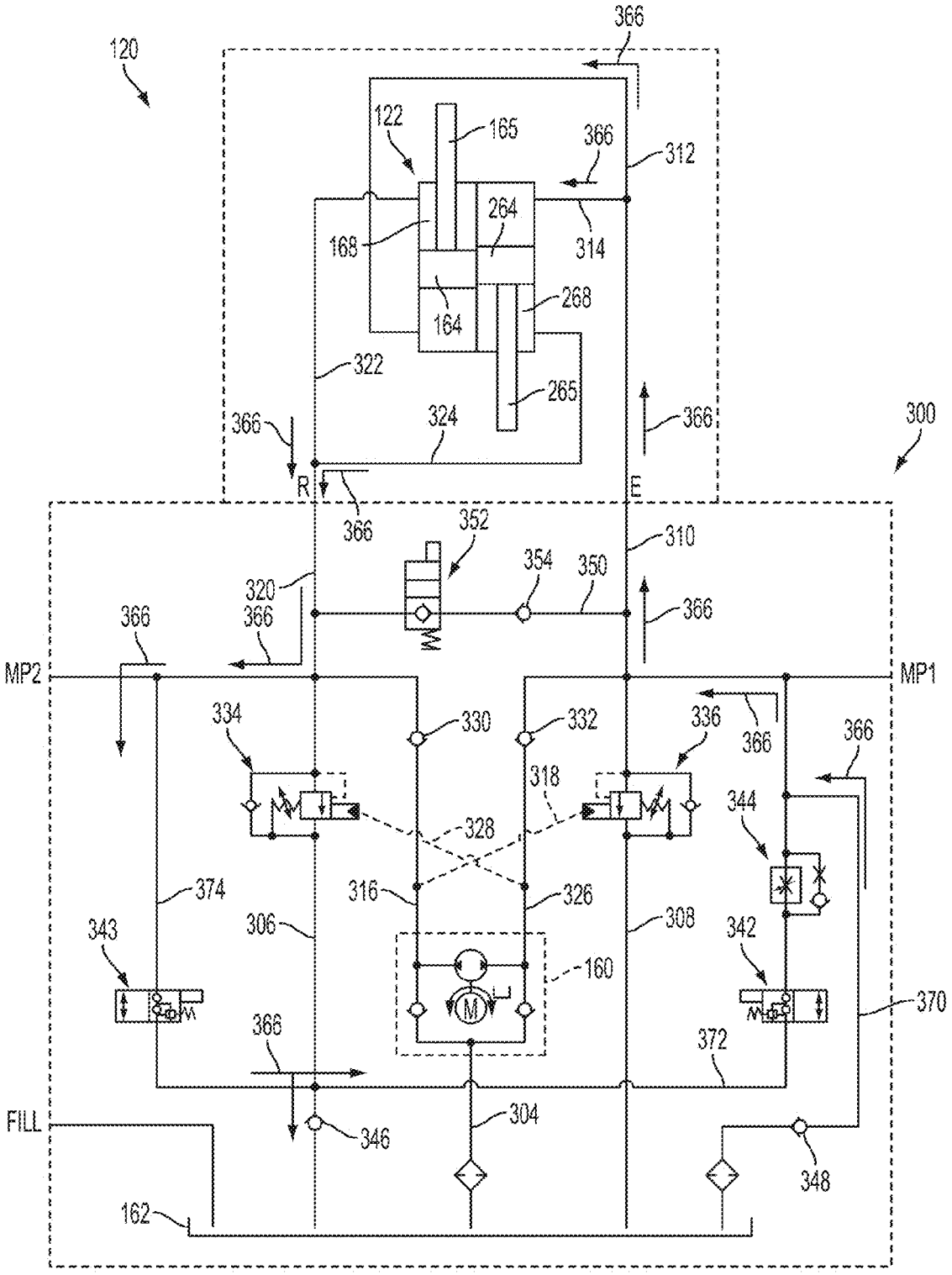
Figure 6D:
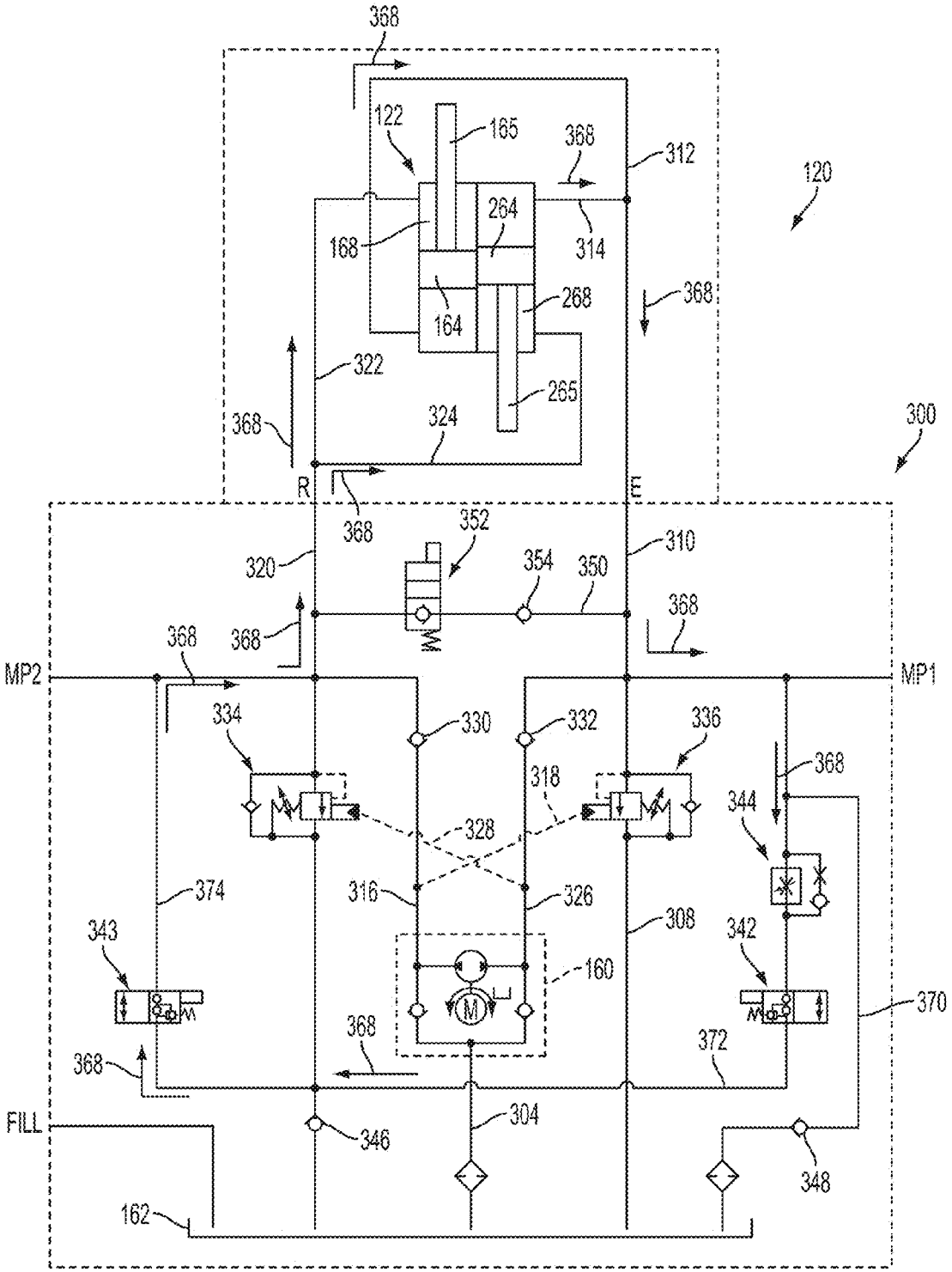

Hydraulic fluid at the retracting fluid path 320 can flow to the rod retracting fluid path 322 and the rod retracting fluid path 324. The manual retraction of the upper rod 165 and the lower rod 265 can cause hydraulic fluid to flow into the upper cylinder 168 and the lower cylinder 268 from the rod retracting fluid path 322 and the rod retracting fluid path 324. It is noted that, while the manual embodiments described with respect to FIGS. 6C and 6D depict extension and retraction as separate operations, it is contemplated that manual extension and manual retraction can be performed within a single operation. For example, upon opening the manual valve 342 and the manual valve 343, the upper rod 165 and the lower rod 265 can extend, retract, or both sequentially in response to an applied force.

Referring again to FIGS. 1 and 2, to determine whether the cot 10 is level, sensors (not depicted) may be utilized to measure distance and/or angle. For example, the front actuator 16 and the back actuator 18 may each comprise encoders which determine the length of each actuator. In one embodiment, the encoders are real time encoders which are operable to detect movement of the total length of the actuator or the change in length of the actuator when the cot is powered or unpowered (i.e., manual control). While various encoders are contemplated, the encoder, in one commercial embodiment, may be the optical encoders produced by Midwest Motion Products, Inc. of Watertown, Minn. U.S.A. In other embodiments, the cot comprises angular sensors that measure actual angle or change in angle such as, for example, potentiometer rotary sensors, Hall Effect rotary sensors and the like. The angular sensors can be operable to detect the angles of any of the pivotally coupled portions of the loading end legs 20 and/or the control end legs 40. In one embodiment, angular sensors are operably coupled to the loading end legs 20 and the control end legs 40 to detect the difference between the angle of the loading end legs 20 and the angle of the control end legs 40 (angle delta). A loading state angle may be set to an angle such as about 20° or any other angle that generally indicates that the cot 10 is in a loading state (indicative of loading and/or unloading). Thus, when the angle delta exceeds the loading state angle the cot 10 may detect that it is in a loading state and perform certain actions dependent upon being in the loading state.

Referring now to FIG. 7, a control box 50 in one embodiment is communicatively coupled (generally indicated by the arrowed lines) to one or more processors 100. Each of the one or more processors 100 can be any device capable of executing machine readable instructions such as, for example, a controller, an integrated circuit, a microchip, or the like. As used herein, the term "communicatively coupled" means that the components are capable of exchanging data signals with one another such as, for example, electrical signals via conductive medium, electromagnetic signals via air, optical signals via optical waveguides, and the like.

The one or more processors 100 can be communicatively coupled to one or more memory modules 102, which can be any device capable of storing machine readable instructions. The one or more memory modules 102 can include any type of memory such as, for example, read only memory (ROM), random access memory (RAM), secondary memory (e.g., hard drive), or combinations thereof. Suitable examples of ROM include, but are not limited to, programmable read-only memory (PROM), erasable programmable read-only memory (EPROM), electrically erasable programmable read-only memory (EEPROM), electrically alterable read-only memory (EAROM), flash memory, or combinations thereof. Suitable examples of RAM include, but are not limited to, static RAM (SRAM) or dynamic RAM (DRAM).

The embodiments described herein can perform methods automatically by executing machine readable instructions with the one or more processors 100. The machine readable instructions can comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored. Alternatively, the machine readable instructions may be written in a hardware description language (HDL), such as logic implemented via either a field-programmable gate array (FPGA) configuration or an application-specific integrated circuit (ASIC), or their equivalents. Accordingly, the methods described herein may be implemented in any conventional computer programming language, as pre-programmed hardware elements, or as a combination of hardware and software components.

Referring collectively to FIGS. 2 and 7, a front actuator sensor 62 and a back actuator sensor 64 are configured to detect whether the front and back actuators 16, 18 respectively are either located in a first position, which situates each actuator closer relatively to an underside of a respective one of a pair of cross members 63, 65 (FIG. 2) or a second position, which situates each actuator further away from the respective one of the cross members 63, 65 relative to the first position, and communicate such detection to the one or more processors 100. In one embodiment, the front actuator sensor 62 and the back actuator sensor 64 are coupled to a respective one of the cross members 63, 65; however, other locations on the support frame 12 or configurations are contemplated herein. The sensors 62, 64 may be distance measuring sensors, string encoders, potentiometer rotary sensors, proximity sensors, reed switches, hall-effect sensors, combinations thereof or any other suitable sensor operable to detect when the front actuator 16 and/or back actuator 18 are either at and/or passed a first position and/or second position. In further embodiments, other sensors may be used with the front and back actuators 16, 18 and/or cross members 63, 65 to detect the weight of a patient disposed on the cot 10 (e.g., via strain gauges). It is noted that the term "sensor," as used herein, means a device that measures a physical quantity, state, or attribute and converts it into a signal which is correlated to the measured value of the physical quantity, state or attribute. Furthermore, the term "signal" means an electrical, magnetic or optical waveform, such as current, voltage, flux, DC, AC, sinusoidal-wave, triangular-wave, square-wave, and the like, capable of being transmitted from one location to another.

Referring collectively to FIGS. 3 and 7, the cot 10 can comprise a front angular sensor 66 and a back angular sensor 68 that are communicatively coupled to the one or more processors 100. The front angular sensor 66 and the back angular sensor 68 can be any sensor that measures actual angle or change in angle such as, for example, a potentiometer rotary sensor, hall-effect rotary sensor and the like. The front angular sensor 66 can be operable to detect a front angle $\alpha_f$ of a pivotally coupled portion of the loading end legs 20. The back angular sensor 68 can be operable to detect a back angle $\alpha_b$ of a pivotally coupled portion of the control end legs 40. In one embodiment, front angular sensor 66 and back angular sensor 68 are operably coupled to the loading end legs 20 and the control end legs 40, respectively. Accordingly, the one or more processors 100 can execute machine readable instructions to determine the difference between the front angle $\alpha_f$ and back angle $\alpha_b$ (angle delta). A loading state angle may be set to an angle such as about 20° or any other angle that generally indicates that the cot 10 is in a loading state (indicative of loading and/or unloading). Thus, when the angle delta exceeds the loading state angle the cot 10 may detect that it is in a loading state and perform certain actions dependent upon being in the loading state. Alternatively, distance sensors can be utilized to perform measurements analogous to angular measurements that determine the front angle $\alpha_f$ and back angle $\alpha_b$. For example, the angle can be determined from the positioning of the loading end legs 20 and/or the control end legs 40 and relative to the lateral side members 15. For example, the distance between the loading end legs 20 and a reference point along the lateral side members 15 can be measured. Similarly, the distance between the control end legs 40 and a reference point along the lateral side members 15 can be measured. Moreover, the distance that the front actuator 16 and the back actuator 18 are extended can be measured. Accordingly, any of the distance measurements or angular measurements described herein can be utilized interchangeably to determine the positioning of the components of the cot 10.

Additionally, it is noted that distance sensors may be coupled to any portion of the cot 10 such that the distance between a lower surface and components such as, for example, the front end 17, the back end 19, the front load wheels 70, the front wheels 26, the intermediate load wheels 30, the back wheels 46, the front actuator 16 or the back actuator 18 may be determined Referring collectively to FIGS. 3 and 7, the front end 17 may comprise a pair of front load wheels 70 configured to assist in loading the cot 10 onto a loading surface (e.g., the floor of an ambulance). The cot 10 may comprise a loading end sensor 76 communicatively coupled to the one or more processors 100. The loading end sensor 76 is a distance sensor operable to detect the location of the front load wheels 70 with respect to a loading surface (e.g., distance from the detected surface to the front load wheels 70). Suitable distance sensors include, but are not limited to, ultrasonic sensors, touch sensors, proximity sensors, or any other sensor capable to detecting distance to an object. In one embodiment, loading end sensor 76 is operable to detect directly or indirectly the distance from the front load wheels 70 to a surface substantially directly beneath the front load wheels 70. Specifically, loading end sensor 76 can provide an indication when a surface is within a definable range of distance from the front load wheels 70 (e.g., when a surface is greater than a first distance but less than a second distance), and which also is referred herein as the loading end sensor 76 "seeing" or "sees" the loading surface. Accordingly, the definable range may be set such that a positive indication is provided by loading end sensor 76 when the front load wheels 70 of the cot 10 are in contact with a loading surface. Ensuring that both front load wheels 70 are on the loading surface may be important, especially in circumstances when the cot 10 is loaded into an ambulance at an incline.

The loading end legs 20 may comprise intermediate load wheels 30 attached to the loading end legs 20. In one embodiment, the intermediate load wheels 30 may be disposed on the loading end legs 20 adjacent a front cross beam 22 (FIG. 2) to which the front actuator 16 is mounted at a lower end (FIG. 6). As depicted by FIGS. 1 and 3, the control end legs 40 are not provided with any intermediate load wheels adjacent a back cross beam 42 to which the back actuator 18 is mounted at a lower end (FIG. 6). The cot 10 may comprise an intermediate load sensor 77 communicatively coupled to the one or more processors 100. The intermediate load sensor 77 is a distance sensor operable to detect the distance between the intermediate load wheels 30 and the loading surface 500. In one embodiment, when the intermediate load wheels 30 are within a set distance of the loading surface, the intermediate load sensor 77 may provide a signal to the one or more processors 100. Although the figures depict the intermediate load wheels 30 only on the loading end legs 20, it is further contemplated that intermediate load wheels 30 may also be disposed on the control end legs 40 or any other position on the cot 10 such that the intermediate load wheels 30 cooperate with the front load wheels 70 to facilitate loading and/or unloading (e.g., the support frame 12). For example, intermediate load wheels can be provided at any location that is likely to be a fulcrum or center of balance during the loading and/or unloading process described herein.

The cot 10 may comprise a back actuator sensor 78 communicatively coupled to the one or more processors 100. The back actuator sensor 78 is a distance sensor operable to detect the distance between the back actuator 18 and the loading surface. In one embodiment, back actuator sensor 78 is operable to detect directly or indirectly the distance from the back actuator 18 to a surface substantially directly beneath the back actuator 18, when the control end legs 40 are substantially fully retracted (FIGS. 4, 5D, and 5E). Specifically, back actuator sensor 78 can provide an indication when a surface is within a definable range of distance from the back actuator 18 (e.g., when a surface is greater than a first distance but less than a second distance).

Referring still to FIGS. 3 and 7, the cot 10 may comprise a front drive light 86 communicatively coupled to the one or more processors 100. The front drive light 86 can be coupled to the front actuator 16 and configured to articulate with the front actuator 16. Accordingly, the front drive light 86 can illuminate an area directly in front of the front end 17 of the cot 10, as the cot 10 is rolled with the front actuator 16 extended, retracted, or any position there between. The cot 10 may also comprise a back drive light 88 communicatively coupled to the one or more processors 100. The back drive light 88 can be coupled to the back actuator 18 and configured to articulate with the back actuator 18. Accordingly, the back drive light 88 can illuminate an area directly behind the back end 19 of the cot 10, as the cot 10 is rolled with the back actuator 18 extended, retracted, or any position there between. The cot 10 may also comprise a pair of surround lights 89 communicatively coupled to the one or more processors 100. Each of the surround lights 89 can be coupled to a respective one of the pair of substantially parallel lateral side members 15 and thus can illuminate an area directly to the sides of the cot 10. The one or more processors 100 can receive input from any of the operator controls described herein and cause the front drive light 86, the back drive light 88, surround lights 89, or any combination thereof to be activated.

In some embodiments, the front drive light 86, the back drive light 88 and the surround lights 89 define together a safety lighting system of the cot 10. In such a safety lighting system of the cot 10, the front drive light 86, the back drive light 88 and the surround lights 89 are either on or off at the same time, and can be controlled by two buttons, such as provided in the button array 52, which each define a different illumination pattern. For example, one of the buttons in the button array 52 can define a "Scene" light pattern in which the front drive light 86, the back drive light 88 and the surround lights 89 turn on/off when pressed, and in which the surround lights 89 illuminate with steady white light when on. Another one of the buttons in the button array 52 can define an "Emergency" light pattern in which the front drive light 86, the back drive light 88 and the surround lights 89 turn on/off when pressed, and in which the surround lights 89 illuminate with flash in a sequence of red-red-white light when on.

Referring collectively to FIGS. 1 and 7, the cot 10 may comprise a line indicator 74 communicatively coupled to the one or more processors 100. The line indicator 74 can be any light source configured to project a linear indication upon a surface such as, for example, a laser, light emitting diodes, a projector, or the like. In one embodiment, the line indicator 74 can be coupled to the cot 10 and configured to project a line upon a surface below the cot 10, such that the line is aligned with the intermediate load wheels 30. The line can run from a point beneath or adjacent to the cot 10 and to a point offset from the side of the cot 10. Accordingly, when the line indicator projects the line, an operator at the back end 19 of the can maintain visual contact with the line and utilize the line as a reference of the location of the center of balance of the cot 10 (e.g., the intermediate load wheels 30) during loading, unloading, or both.

The back end 19 may comprise operator controls 57 for the cot 10. As used herein, the operator controls 57 comprise the input components that receive commands from the operator and the output components that provide indications to the operator. Accordingly, the operator can utilize the operator controls in the loading and unloading of the cot 10 by controlling the movement of the loading end legs 20, the control end legs 40, and the support frame 12. The operator controls 57 may include the control box 50 disposed on the back end 19 of the cot 10. For example, the control box 50 can be communicatively coupled to the one or more processors 100, which is in turn communicatively coupled to the front actuator 16 and the back actuator 18. The control box 50 can comprise a visual display component or graphical user interface (GUI) 58 configured to inform an operator whether the front and back actuators 16, 18 are activated or deactivated. The visual display component or GUI 58 can comprise any device capable of emitting an image such as, for example, a liquid crystal display, a touch screen, or the like.

Referring collectively to FIGS. 2, 7 and 8, the operator controls 57 can be operable to receive user input indicative of a desire to perform a cot function. The operator controls 57 can be communicatively coupled to the one or more processors 100 such that input received by the operator controls 57 can be transformed into control signals that are received by the one or more processors 100. Accordingly, the operator controls 57 can comprise any type of tactile input capable of transforming a physical input into a control signal such as, for example, a button, a switch, a microphone, a knob, or the like. It is noted that, while the embodiments described herein make reference to automated operation of the front actuator 16 and back actuator 18, the embodiments described herein can include operator controls 57 that are configured to directly control front actuator 16 and back actuator 18. That is, the automated processes described herein can be overridden by a user and the front actuator 16 and back actuator 18 can be actuated independent of input from the controls.

In some embodiments, the operator controls 57 can be located on the back end 19 of the cot 10. For example, the operator controls 57 can comprise a button array 52 located adjacent to and beneath the visual display component or GUI 58. The button array 52 can comprise a plurality of buttons used, for example and not limited thereby, to turn on/off lights and lighting modes, e.g., scene lights, emergency lights, etc., to select a particular mode of operation for the cot e.g., one of a number of "Direct Power" modes explained hereafter in later sections, and to select a predetermined positioning/arrangement of the cot e.g., a "Chair Position" that is automatically configured upon pressing of the associated button and which is explained hereafter in later sections. Each button of the button array 52 can comprise an optical element (i.e., an LED) that can emit visible wavelengths of optical energy when the button is activated. Alternatively or additionally, the operator controls 57 can comprise a button array 52 located adjacent to and above the visual display component or GUI 58. It is noted that, while each button array 52 is depicted as consisting of four buttons, the button array 52 can comprise any number of buttons. Moreover, the operator controls 57 can comprise a concentric button array 54 (FIG. 8) comprising a plurality of arc shaped buttons arranged concentrically around a central button. In some embodiments, the concentric button array 54 can be located above the visual display component or GUI 58. In still other embodiments, one or more buttons 53, which can provide the same and/or additional functions to any of the buttons in the button array 52 and/or 54 may be provided on either or both the sides of control box 50. It is noted that, while the operator controls 57 are depicted as being located at the back end 19 of the cot 10, it is further contemplated that the operator controls 57 can be positioned at alternative positions on the support frame 12, for example, on the front end 17 or the sides of the support frame 12. In still further embodiments, the operator controls 57 may be located in a removably attachable wireless remote control that may control the cot 10 without physical attachment to the cot 10.

The operator controls 57 can further comprise a raise button 56 operable to receive input indicative of a desire to raise ("+") the cot 10 and a lower button 60 operable to receive input indicative of a desire to lower ("−") the cot 10. It is to be appreciated that in other embodiments the raising and/or lowering commanding function can be assigned to other buttons, such as ones of the button arrays 52 and/or 54, in addition to buttons 56, 60. As is explained in greater detail herein, each of the raise button 56 and the lower button 60 can generate signals that actuate the loading end legs 20, the control end legs 40, or both in order to perform cot functions. The cot functions may require the loading end legs 20, the control end legs 40, or both to be raised, lowered, retracted or released depending on the position and orientation of the cot 10. In some embodiments, each of the lower button 60 and the raise button 56 can be analog (i.e., the pressure and/or displacement of the button can be proportional to a parameter of the control signal). Accordingly, the speed of actuation of the loading end legs 20, the control end legs 40, or both can be proportional to the parameter of the control signal. Alternatively or additionally, each of the lower button 60 and the raise button 56 can be backlit.

In the illustrated embodiment of FIG. 8, two button sets 161, 163 providing buttons 56, 60 are also shown. The first button set 161 is provided in a fixed position on the support frame 12, such as to or adjacent an end frame member 165. The second button set 163 is provided on a telescoping handle 167 that can be situated adjacent the first button set 161. As indicated by the arrow in FIG. 8, the telescoping handle 167 is movable between a first position in which the second button set 163 is positioned relatively close or proximate to the first button set 161, and a second position in which the second button set 163 is extended relatively away or remote from the first button set 161. In one embodiment the distance between the first and second positions is 225 mm, and in other embodiments the distance may be a distance selected from a range of 120 to 400 mm. It is to be appreciated that the telescoping handle 167 is movable between and lockable in the first and second positions as well as in a number of positions there between. A release button 169 is pressed to unlock the telescoping handling 167 such that the second button set 163 may be extended or retraced relative to the first button set 161. In another embodiment, as best depicted by FIG. 14A, the end frame member 165 may be provided angled downwardly and skewed from the plane in which a pair of telescoping handles 167 extends and retracts. In still other embodiments, either one or both of the sides of the end frame member 165, and either one or both of the telescoping handles 167 may be provided with a respective one of the first and second button sets 161, 163 (FIG. 8).

Turning now to embodiments of the cot 10 being simultaneously actuated, the cot 10 of FIG. 2 is depicted as extended, thus front actuator sensor 62 and back actuator sensor 64 detect that the front actuator 16 and the back actuator 18 are at a first position, i.e., the front and back actuators 16, 18 are in contact and/or close proximate to their respective cross member 63, 65 such as when the loading end legs 20 and the control end legs 40 are in contact with a lower surface and are loaded. The front and back actuators 16 and 18 are both active when the front and back actuator sensors 62, 64 detect both the front and back actuators 16, 18, respectively, are at the first position and can be lowered or raised by the operator using the lower button 60 and the raise button 56.

Figure 4A:
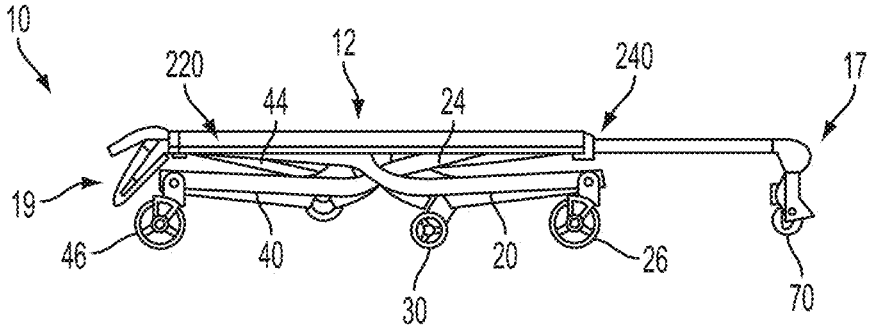
FIGS. 4A-4C is a side view depicting a raising and/or lowering sequence of a roll-in, self-actuating, powered ambulance cot according to one or more embodiments described herein.
Figure 4B:
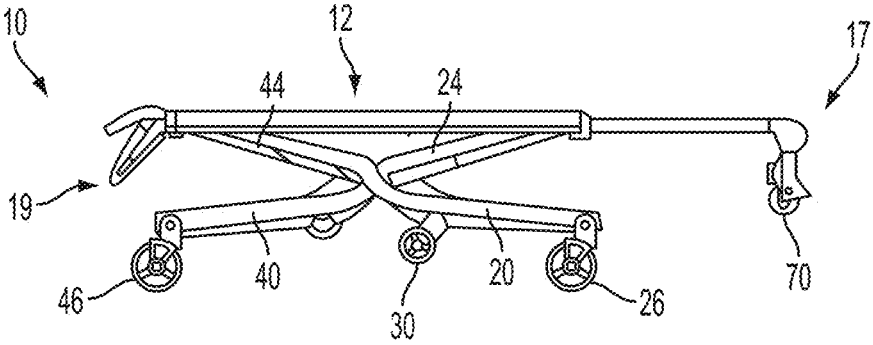
Figure 4C:
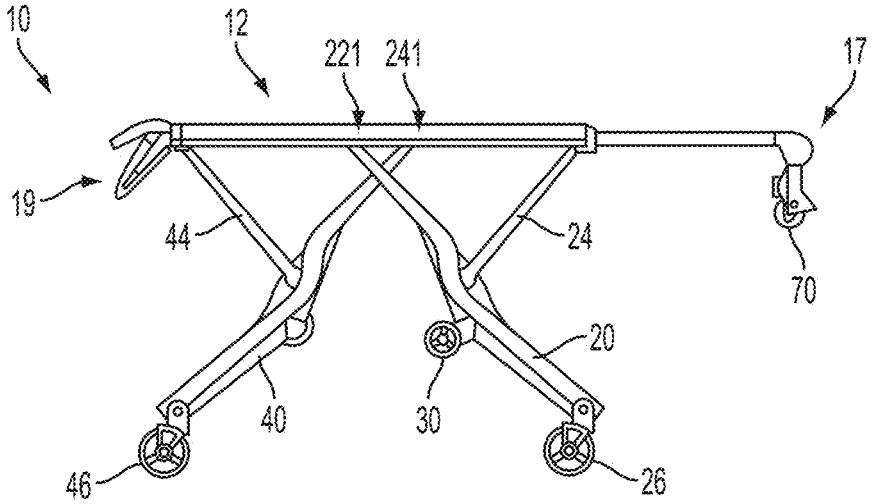
Figure 5D:
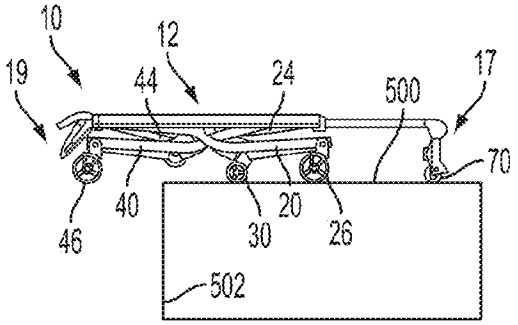
FIGS. 5A-5E is a side view depicting a loading and/or unloading sequence of a roll-in, self-actuating, powered ambulance cot according to one or more embodiments described herein.
Figure 5E:
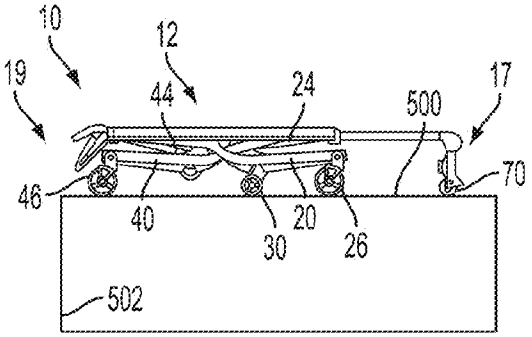

Referring collectively to FIGS. 4A-4C, an embodiment of the cot 10 being raised (FIGS. 4A-4C) or lowered (FIGS. 4C-4A) via simultaneous actuation is schematically depicted (note that for clarity the front actuator 16 and the back actuator 18 are not depicted in FIGS. 4A-4C). In the depicted embodiment, the cot 10 comprises a support frame 12 slidingly engaged with a pair of loading end legs 20 and a pair of control end legs 40. Each of the loading end legs 20 are rotatably coupled to a front hinge member 24 that is rotatably coupled to the support frame 12. Each of the control end legs 40 are rotatably coupled to a back hinge member 44 that is rotatably coupled to the support frame 12. In the depicted embodiment, the front hinge members 24 are rotatably coupled towards the front end 17 of the support frame 12 and the back hinge members 44 that are rotatably coupled to the support frame 12 towards the back end 19.

FIG. 4A depicts the cot 10 in a lowest transport position. Specifically, the back wheels 46 and the front wheels 26 are in contact with a surface, the loading end legs 20 is slidingly engaged with the support frame 12 such that the loading end legs 20 contacts a portion of the support frame 12 towards the back end 19 and the control end legs 40 are slidingly engaged with the support frame 12 such that the control end legs 40 contacts a portion of the support frame 12 towards the front end 17. FIG. 4B depicts the cot 10 in an intermediate transport position, i.e., the loading end legs 20 and the control end legs 40 are in intermediate transport positions along the support frame 12. FIG. 4C depicts the cot 10 in a highest transport position, i.e., the loading end legs 20 and the control end legs 40 positioned along the support frame 12 such that the front load wheels 70 are at a maximum desired height which can be set to height sufficient to load the cot, as is described in greater detail herein.

The embodiments described herein may be utilized to lift a patient from a position below a vehicle in preparation for loading a patient into the vehicle (e.g., from the ground to above a loading surface of an ambulance). Specifically, the cot 10 may be raised from the lowest transport position (FIG. 4A) to an intermediate transport position (FIG. 4B) or the highest transport position (FIG. 4C) by simultaneously actuating the loading end legs 20 and control end legs 40 and causing them to slide along the support frame 12. When being raised, the actuation causes the loading end legs to slide towards the front end 17 and to rotate about the front hinge members 24, and the control end legs 40 to slide towards the back end 19 and to rotate about the back hinge members 44. Specifically, a user may interact with the operator controls 57 (FIG. 8) and provide input indicative of a desire to raise the cot 10 (e.g., by pressing the raise button 56). The cot 10 is raised from its current position (e.g., lowest transport position or an intermediate transport position) until it reaches the highest transport position. Upon reaching the highest transport position, the actuation may cease automatically, i.e., to raise the cot 10 higher additional input is required. Input may be provided to the cot 10 and/or operator controls 57 in any manner such as electronically, audibly or manually.

The cot 10 may be lowered from an intermediate transport position (FIG. 4B) or the highest transport position (FIG. 4C) to the lowest transport position (FIG. 4A) by simultaneously actuating the loading end legs 20 and control end legs 40 and causing them to slide along the support frame 12. Specifically, when being lowered, the actuation causes the loading end legs to slide towards the back end 19 and to rotate about the front hinge members 24, and the control end legs 40 to slide towards the front end 17 and to rotate about the back hinge members 44. For example, a user may provide input indicative of a desire to lower the cot 10 (e.g., by pressing the lower button 60). Upon receiving the input, the cot 10 lowers from its current position (e.g., highest transport position or an intermediate transport position) until it reaches the lowest transport position. Once the cot 10 reaches its lowest height (e.g., the lowest transport position) the actuation may cease automatically. In some embodiments, the control box 50 provides a visual indication that the loading end legs 20 and control end legs 40 are active during movement.

In one embodiment, when the cot 10 is in the highest transport position (FIG. 4C), the loading end legs 20 are in contact with the support frame 12 at a front-loading index 221 and the control end legs 40 are in contact with the support frame 12 at a back-loading index 241. While the front-loading index 221 and the back-loading index 241 are depicted in FIG. 4C as being located near the middle of the support frame 12, additional embodiments are contemplated with the front-loading index 221 and the back-loading index 241 located at any position along the support frame 12. For example, the highest transport position may be set by actuating the cot 10 to the desired height and providing input indicative of a desire to set the highest transport position (e.g., pressing and holding the "+" and "–" buttons 56, 60 simultaneously for 10 seconds).

In another embodiment, any time the cot 10 is raised over the highest transport position for a set period of time (e.g., 30 seconds), the control box 50 provides an indication that the cot 10 has exceeded the highest transport position and the cot 10 needs to be lowered. The indication may be visual, audible, electronic or combinations thereof.

When the cot 10 is in the lowest transport position (FIG. 3A), the loading end legs 20 may be in contact with the support frame 12 at a front-flat index 220 located near the back end 19 of the support frame 12 and the control end legs 40 may be in contact with the support frame 12 a back-flat index 240 located near the front end 17 of the support frame 12. Furthermore, it is noted that the term "index," as used herein means a position along the support frame 12 that corresponds to a mechanical stop or an electrical stop such as, for example, an obstruction in a channel formed in a lateral side member 15, a locking mechanism, or a stop controlled by a servomechanism.

The front actuator 16 is operable to raise or lower a front end 17 of the support frame 12 independently of the back actuator 18. The back actuator 18 is operable to raise or lower a back end 19 of the support frame 12 independently of the front actuator 16. By raising the front end 17 or back end 19 independently, the cot 10 is able to maintain the support frame 12 level or substantially level when the cot 10 is moved over uneven surfaces, for example, a staircase or hill. Specifically, if one of the front actuator 16 or the back actuator 18 is in a second position relative to a first position, the set of legs not in contact with a surface (i.e., the set of legs that is in tension, such as when the cot is being lifted at one or both ends) is activated by the cot 10 (e.g., moving the cot 10 off of a curb). Further embodiments of the cot 10 are operable to be automatically leveled. For example, if back end 19 is lower than the front end 17, pressing the "+" button 56 raises the back end 19 to level prior to raising the cot 10, and pressing the "–" button 60 lowers the front end 17 to level prior to lowering the cot 10.

In one embodiment, depicted in FIG. 2, the cot 10 receives a first location signal from the front actuator sensor 62 indicative of a detected position of the front actuator 16 and a second location signal from the back actuator sensor 64 indicative of a detected position of the back actuator 18. The first location signal and second location signal may be processed by logic executed by the control box 50 to determine the response of the cot 10 to input received by the cot 10. Specifically, user input may be entered into the control box 50. The user input is received as control signal indicative of a command to change a height of the cot 10 by the control box 50. Generally, when the first location signal is indicative of the front actuator being in a first position and the second location signal is indicative of the back actuator being in a second position that is different relatively from the first position, with the first and second positions indicating distance, angles, or locations between two pre-determined relative positions, the front actuator actuates the loading end legs 20 and the back actuator 18 remains substantially static (e.g., is not actuated). Therefore, when only the first location signal indicates the second position, the loading end legs 20 may be raised by pressing the "–" button 60 and/or lowered by pressing the "+" button 56. Generally, when the second location signal is indicative of second position and the first location signal is indicative of the first location, the back actuator 18 actuates the control end legs 40 and the front actuator 16 remains substantially static (e.g., is not actuated). Therefore, when only the second location signal indicates the second position, the control end legs 40 may be raised by pressing the "–" button 60 and/or lowered by pressing the "+" button 56. In some embodiments, the actuators may actuate relatively slowly upon initial movement (i.e., slow start) to mitigate rapid jostling of the support frame 12 prior to actuating relatively quickly.

Referring collectively to FIGS. 4C-5E, independent actuation may be utilized by the embodiments described herein for loading a patient into a vehicle (note that for clarity the front actuator 16 and the back actuator 18 are not depicted in FIGS. 4C-5E). Specifically, the cot 10 can be loaded onto a loading surface 500 according the process described below. First, the cot 10 may be placed into the highest transport position (FIG. 3) or any position where the front load wheels 70 are located at a height greater than the loading surface 500. When the cot 10 is loaded onto a loading surface 500, the cot 10 may be raised via front and back actuators 16 and 18 to ensure the front load wheels 70 are disposed over a loading surface 500. In some embodiments, the front actuator 16 and the back actuator 18 can be actuated contemporaneously to keep the cot level until the height of the cot is at a predetermined position. Once the predetermined height is reached, the front actuator 16 can raise the front end 17 such that the cot 10 is angled at its highest load position. Accordingly, the cot 10 can be loaded with the back end 19 lower than the front end 17. Then, the cot 10 may be lowered until front load wheels 70 contact the loading surface 500 (FIG. 5A).

Figure 5C:
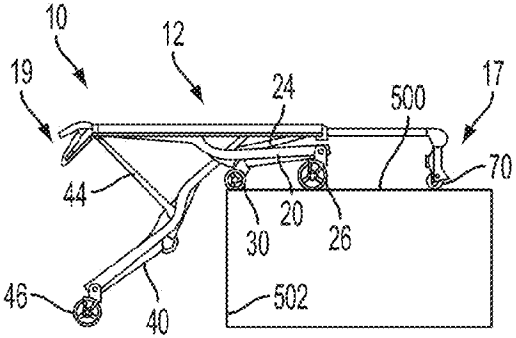
Figure 5A:
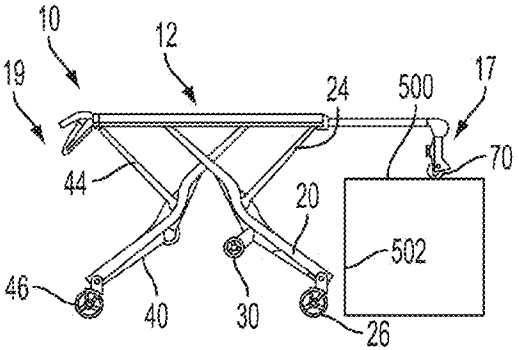
Figure 5B:
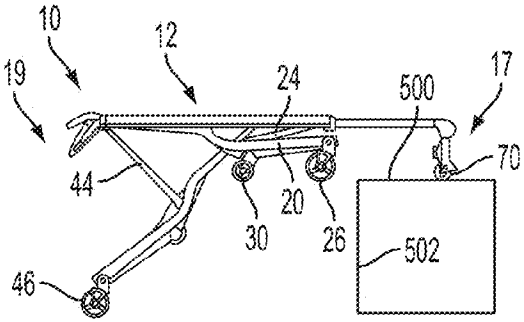

As is depicted in FIG. 5A, the front load wheels 70 are over the loading surface 500. In one embodiment, after the load wheels contact the loading surface 500 the pair of loading end legs 20 can be actuated with the front actuator 16 because the front end 17 is above the loading surface 500. As depicted in FIGS. 5A and 5B, the middle portion of the cot 10 is away from the loading surface 500 (i.e., a large enough portion of the cot 10 has not been loaded beyond the loading edge 502 such that most of the weight of the cot 10 can be cantilevered and supported by the wheels 70, 26, and/or 30). When the front load wheels are sufficiently loaded, the cot 10 may be held level with a reduced amount of force. Additionally, in such a position, the front actuator 16 is in a second position relative to a first position and the back actuator 18 is in a first position relative to a second position. Thus, for example, if the "–" button 60 is activated, the loading end legs 20 are raised (FIG. 5B). In one embodiment, after the loading end legs 20 have been raised enough to trigger a loading state, the operation of the front actuator 16 and the back actuator 18 is dependent upon the location of the self-actuating cot. In some embodiments, upon the loading end legs 20 raising, a visual indication is provided on the visual display component or GUI 58 of the control box 50 (FIG. 2). The visual indication may be color-coded (e.g., activated legs in green and non-activated legs in red). This front actuator 16 may automatically cease to operate when the loading end legs 20 have been fully retracted. Furthermore, it is noted that during the retraction of the loading end legs 20, the front actuator sensor 62 may detect a second position relative to a first position, at which point, front actuator 16 may raise the loading end legs 20 at a higher rate; for example, fully retract within about 2 seconds.

Referring collectively to FIGS. 3, 5B, and 7, the back actuator 18 can be automatically actuated by the one or more processors 100 after the front load wheels 70 have been loaded upon the loading surface 500 to assist in the loading of the cot 10 onto the loading surface 500. Specifically, when the front angular sensor 66 detects that the front angle $\alpha_f$ is less than a predetermined angle, the one or more processors 100 can automatically actuate the back actuator 18 to extend the control end legs 40 and raise the back end 19 of the cot 10 higher than the original loading height. The predetermined angle can be any angle indicative of a loading state or a percentage of extension such as, for example, less than about 10% extension of the loading end legs 20 in one embodiment, or less than about 5% extension of the loading end legs 20 in another embodiment. In some embodiments, the one or more processors 100 can determine if the loading end sensor 76 indicates that the front load wheels 70 are touching the loading surface 500 prior to automatically actuating the back actuator 18 to extend the control end legs 40.

In further embodiments, the one or more processors 100 can monitor the back angular sensor 68 to verify that the back angle $\alpha_b$ is changing in accordance to the actuation of the back actuator 18. In order to protect the back actuator 18, the one or more processors 100 can automatically abort the actuation of the back actuator 18 if the back angle $\alpha_b$ is indicative of improper operation. For example, if the back angle $\alpha_b$ fails to change for a predetermined amount of time (e.g., about 200 ms), the one or more processors 100 can automatically abort the actuation of the back actuator 18.

Referring collectively to FIGS. 5A-5E, after the loading end legs 20 have been retracted, the cot 10 may be urged forward until the intermediate load wheels 30 have been loaded onto the loading surface 500 (FIG. 5C). As depicted in FIG. 5C, the front end 17 and the middle portion of the cot 10 are above the loading surface 500. As a result, the pair of control end legs 40 can be retracted with the back actuator 18. Specifically, an ultrasonic sensor may be positioned to detect when the middle portion is above the loading surface 500. When the middle portion is above the loading surface 500 during a loading state (e.g., the loading end legs 20 and control end legs 40 have an angle delta greater than the loading state angle), the back actuator may be actuated. In one embodiment, an indication may be provided by the control box 50 (FIG. 2) when the intermediate load wheels 30 are sufficiently beyond the loading edge 502 to allow for control end legs 40 actuation (e.g., an audible beep may be provided).

It is noted that, the middle portion of the cot 10 is above the loading surface 500 when any portion of the cot 10 that may act as a fulcrum is sufficiently beyond the loading edge 502 such that the control end legs 40 may be retracted a reduced amount of force is required to lift the back end 19 (e.g., less than half of the weight of the cot 10, which may be loaded, needs to be supported at the back end 19). Furthermore, it is noted that the detection of the location of the cot 10 may be accomplished by sensors located on the cot 10 and/or sensors on or adjacent to the loading surface 500. For example, an ambulance may have sensors that detect the positioning of the cot 10 with respect to the loading surface 500 and/or loading edge 502 and communications means to transmit the information to the cot 10.

Referring to FIG. 5D, after the control end legs 40 are retracted and the cot 10 may be urged forward. In one embodiment, during the back leg retraction, the back actuator sensor 64 may detect that the control end legs 40 are unloaded, at which point, the back actuator 18 may raise the control end legs 40 at higher speed. Upon the control end legs 40 being fully retracted, the back actuator 18 may automatically cease to operate. In one embodiment, an indication may be provided by the control box 50 (FIG. 2) when the cot 10 is sufficiently beyond the loading edge 502 (e.g., fully loaded or loaded such that the back actuator is beyond the loading edge 502).

Once the cot is loaded onto the loading surface (FIG. 5E), the front and back actuators 16, 18 may be deactivated since by being releasably locked/coupled to an ambulance. The ambulance and the cot 10 may each be fitted with components suitable for coupling, for example, male-female connectors. Additionally, the cot 10 may comprise a sensor which registers when the cot is fully disposed in the ambulance, and sends a signal which results in the locking of the actuators 16, 18. In yet another embodiment, the cot 10 may be connected to a cot fastener, which locks the actuators 16, 18, and is further coupled to the ambulance's power system, which charges the cot 10. A commercial example of such ambulance charging systems is the Integrated Charging System (ICS) produced by Ferno-Washington, Inc.

Referring collectively to FIGS. 5A-5E, independent actuation, as is described above, may be utilized by the embodiments described herein for unloading the cot 10 from a loading surface 500. Specifically, the cot 10 may be unlocked from the fastener and urged towards the loading edge 502 (FIG. 5E to FIG. 5D). As the back wheels 46 are released from the loading surface 500 (FIG. 5D), the back actuator sensor 64 detects that the control end legs 40 are unloaded and allows the control end legs 40 to be lowered. In some embodiments, the control end legs 40 may be prevented from lowering, for example if sensors detect that the cot is not in the correct location (e.g., the back wheels 46 are above the loading surface 500 or the intermediate load wheels 30 are away from the loading edge 502). In one embodiment, an indication may be provided by the control box 50 (FIG. 2) when the back actuator 18 is activated (e.g., the intermediate load wheels 30 are near the loading edge 502 and/or the back actuator sensor 64 detects a second position relative to a first position).

Referring collectively to FIGS. 5D and 7, the line indicator 74 can be automatically actuated by the one or more processors to project a line upon the loading surface 500 indicative of the center of balance of the cot 10. In one embodiment, the one or more processors 100 can receive input from the intermediate load sensor 77 indicative of the intermediate load wheels 30 being in contact with the loading surface. The one or more processors 100 can also receive input from the back actuator sensor 64 indicative of back actuator 18 being in a second position relative to a first position. When the intermediate load wheels 30 are in contact with the loading surface and the back actuator 18 is in a second position relative to a first position, the one or more processors can automatically cause the line indicator 74 to project the line. Accordingly, when the line is projected, an operator can be provided with a visual indication on the load surface that can be utilized as a reference for loading, unloading, or both. Specifically, the operator can slow the removal of the cot 10 from the loading surface 500 as the line approaches the loading edge 502, which can allow additional time for the control end legs 40 to be lowered. Such operation can minimize the amount of time that the operator will be required to support the weight of the cot 10.

Referring collectively to FIGS. 5A-5E, when the cot 10 is properly positioned with respect to the loading edge 502, the control end legs 40 can be extended (FIG. 5C). In some embodiments, when the back actuator sensor 64 detects a second position relative to a first position, the control end legs 40 can be extended relatively quickly by opening the logical valve 352 to activate the regeneration fluid path 350 (FIGS. 12A-12D). For example, the control end legs 40 may be extended by pressing the "+" button 56. In one embodiment, upon the control end legs 40 lowering, a visual indication is provided on the visual display component or GUI 58 of the control box 50 (FIG. 2). For example, a visual indication may be provided when the cot 10 is in a loading state and the control end legs 40 and/or loading end legs 20 are actuated. Such a visual indication may signal that the cot should not be moved (e.g., pulled, pushed, or rolled) during the actuation. When the control end legs 40 contact the floor (FIG. 5C), the control end legs 40 become loaded and the back actuator sensor 64 deactivates the back actuator 18.

When a sensor detects that the loading end legs 20 are clear of the loading surface 500 (FIG. 5B), the front actuator 16 is activated. In some embodiments, when the front actuator sensor 62 detects a second position relative to a first position, the loading end legs 20 can be extended relatively quickly by opening the logical valve 352 to activate the regeneration fluid path 350 (FIGS. 12A-12D). In one embodiment, when the intermediate load wheels 30 are at the loading edge 502 an indication may be provided by the control box 50 (FIG. 2). The loading end legs 20 are extended until the loading end legs 20 contact the floor (FIG. 5A). For example, the loading end legs 20 may be extended by pressing the "+" button 56. In one embodiment, upon the loading end legs 20 lowering, a visual indication is provided on the visual display component or GUI 58 of the control box 50 (FIG. 2).

Referring collectively to FIGS. 7 and 8, actuation of any of the operator controls 57 can cause a control signal to be received by the one or more processors 100. The control signal can be encoded to indicate that one or more of the operator controls has been actuated. The encoded control signals can be associated with a pre-programmed cot function. Upon receipt of the encoded control signal, the one or more processors 100 can execute a cot function automatically. In some embodiments, the cot functions can comprise an open door function that transmits an open door signal to a vehicle. Specifically, the cot 10 can comprise a communication circuit 82 communicatively coupled to the one or more processors 100. The communication circuit 82 can be configured to exchange communication signals with a vehicle such as, for example, an ambulance or the like. The communication circuit 82 can comprise a wireless communication device such as, but not limited to, personal area network transceiver, local area network transceiver, radio frequency identification (RFID), infrared transmitter, cellular transceiver, or the like.

The control signal of one or more of the operator controls 57 can be associated with the open door function. Upon receipt of the control signal associated with the open door function, the one or more processors 100 can cause the communication circuit 82 to transmit an open door signal to a vehicle within range of the open door signal. Upon receipt of the open door signal, the vehicle can open a door for receiving the cot 10. Additionally, the open door signal can be encoded to identify the cot 10 such as, for example, via classification, unique identifier or the like. In further embodiments, the control signal of one or more of the operator controls 57 can be associated with a close door function that operates analogously to the open door function and causes the door of the vehicle to close.

Referring collectively to FIGS. 3, 7, and 8, the cot functions can comprise an automatic leveling function that automatically levels the front end 17 and the back end 19 of the cot 10 with respect to gravity. Accordingly, the front angle $\alpha_f$, the back angle $\alpha_b$, or both can be automatically adjusted to compensate for uneven terrain. For example, if back end 19 is lower than the front end 17 with respect to gravity, the back end 19 can be raised automatically to level the cot 10 with respect to gravity, the front end 17 can be lowered automatically to level the cot 10 with respect to gravity, or both. Conversely, if back end 19 is higher than the front end 17 with respect to gravity, the back end 19 can be lowered automatically to level the cot 10 with respect to gravity, the front end 17 can be raised automatically to level the cot 10 with respect to gravity, or both.

Referring collectively to FIGS. 2 and 7, the cot 10 can comprise a gravitational reference sensor 80 configured to provide a gravitational reference signal indicative of an earth frame of reference. The gravitational reference sensor 80 can comprise an accelerometer, a gyroscope, an inclinometer, or the like. The gravitational reference sensor 80 can be communicatively coupled to the one or more processors 100, and coupled to the cot 10 at a position suitable for detecting the level of the cot 10 with respect to gravity, such as, for example, the support frame 12.

The control signal of one or more of the operator controls 57 can be associated with the automatic leveling function. Specifically, any of the operator controls 57 can transmit a control signal associated with enabling or disabling the automatic leveling function. Alternatively or additionally, other cot functions can selectively enable or disable the cot leveling function. When the automatic leveling function is enabled, the gravitational reference signal can be received by the one or more processors 100. The one or more processors 100 can automatically compare the gravitational reference signal to an earth reference frame indicative of earth level. Based upon the comparison, the one or more processors 100 can automatically quantify the difference between the earth reference frame and the current level of the cot 10 indicated by the gravitational reference signal. The difference can be transformed into a desired adjustment amount to level the front end 17 and the back end 19 of the cot 10 with respect to gravity. For example, the difference can be transformed into an angular adjustment to the front angle $\alpha_f$, the back angle $\alpha_b$, or both. Thus, the one or more processors 100 can automatically actuate the actuators 16, 18 until the desired amount of adjustment has been achieved, i.e., the front angular sensor 66, the back angular sensor 68, and the gravitational reference sensor 80 can be used for feedback.

Referring collectively to FIGS. 1, 9 and 10, one or more of the front wheels 26 and back wheels 46 can comprise a wheel assembly 110 for automatic actuation. Accordingly, while the wheel assembly 110 is depicted in FIG. 9 as being coupled to the linkage 27, the wheel assembly can be coupled to a linkage 47. The wheel assembly 110 can comprise a wheel steering module 112 for directing the orientation of a wheel 114 with respect to the cot 10. The wheel steering module 112 can comprise a control shaft 116 that defines a rotational axis 118 for steering, a turning mechanism 90 for actuating the control shaft 116, and a fork 121 that defines a rotational axis 123 for the wheel 114. In some embodiments, the control shaft 116 can be rotatably coupled to the linkage 27 such that the control shaft 116 rotates around the rotational axis 118. The rotational motion can be facilitated by a bearing 124 located between the control shaft 116 can the linkage 27.

The turning mechanism 90 can be operably coupled to the control shaft 116 and can be configured to propel the control shaft 116 around the rotational axis 118. The turning mechanism 90 can comprise a servomotor and an encoder. Accordingly, the turning mechanism 90 can directly actuate the control shaft 116. In some embodiments, the turning mechanism 90 can be configured to turn freely to allow the control shaft 116 to swivel around the rotational axis 118 as the cot 10 is urged into motion. Optionally, the turning mechanism 90 can be configured to lock in place and resist motion of the control shaft 116 around the rotational axis 118.

Referring collectively to FIGS. 7 and 9-10, the wheel assembly 110 can comprise a swivel locking module 130 for locking the fork 121 in a substantially fixed orientation. The swivel locking module 130 can comprise a bolt member 132 for engagement with a catch member 134, a bias member 136 that biases the bolt member 132 away from the catch member 134, and a cable 138 for transmitting mechanical energy between a lock actuator 92 and the bolt member 132. The lock actuator 92 can comprise a servomotor and an encoder.

The bolt member 132 can be received with a channel formed through the linkage 27. The bolt member 132 can travel into the channel such that the bolt member 132 is free of the catch member 134 and out of the channel into an interference position within the catch member 134. The bias member 136 can bias the bolt member 132 towards the interference position. The cable 138 can be coupled to the bolt member 132 and operably engaged with the lock actuator 92 such that the lock actuator 92 can transmit a force sufficient to overcome the bias member 136 and translate the bolt member 132 from the interference position to free the bolt member 132 of the catch member 134.

In some embodiments, the catch member 134 can be formed in or coupled to the fork 121. The catch member 134 can comprise a rigid body that forms an orifice that is complimentary to the bolt member 132. Accordingly, the bolt member 132 can travel in and out of the catch member via the orifice. The rigid body can be configured to interfere with motion of the catch member 134 that is caused by motion of the control shaft 116 around the rotational axis 118. Specifically, when in the inference position, the bolt member 132 can be constrained by the rigid body of the catch member 134 such that motion of the control shaft 116 around the rotational axis 118 is substantially mitigated.

Referring collectively to FIGS. 7 and 9-10, the wheel assembly 110 can comprise a braking module 140 for resisting rotation of the wheel 114 around the rotational axis 123. The braking module 140 can comprise a brake piston 142 for transmitting braking force to a brake pad 144, a bias member 146 that biases the brake piston 142 away from the wheel 114, and a brake mechanism 94 that provides braking force to the brake piston 142. In some embodiments, the brake mechanism 94 can comprise a servomotor and an encoder. The brake mechanism 94 can be operably coupled to a brake cam 148 such that actuation of the brake mechanism 94 causes the brake cam 148 to rotate around a rotational axis 151. The brake piston 142 can act as a cam follower. Accordingly, rotational motion of the brake cam 148 can be converted to linear motion of the brake piston 142 that moves the brake piston 142 towards and away from the wheel 114 depending upon the direction of rotation of the brake cam 148.

The brake pad 144 can be coupled to the brake piston 142 such that motion of the brake piston 142 towards and away from the wheel 114 causes the brake pad 144 to engage and disengage from the wheel 114. In some embodiments, the brake pad 144 can be contoured to match the shape of the portion of the wheel 114 that the brake pad 144 contacts during braking. Optionally, the contact surface of the brake pad 144 can comprise protrusions and grooves.

Referring again to FIG. 7, each of the turning mechanism 90, the lock actuator 92, and the brake mechanism 94 can be communicatively coupled to the one or more processors 100. Accordingly, any of the operator controls 57 can be encoded to provide control signals that are operable to cause any of the operations of the turning mechanism 90, the lock actuator 92, the brake mechanism 94, or combinations thereof to be performed automatically. Alternatively or additionally, any cot function can cause the any of the operations of the turning mechanism 90, the lock actuator 92, the brake mechanism 94, or combinations thereof to be performed automatically.

Referring collectively to FIGS. 3 and 7-10, any of the operator controls 57 can be encoded to provide control signals that are operable to cause the turning mechanism 90 to actuate the fork 121 into an outboard position (depicted in FIG. 10 as dashed lines). Alternatively or additionally, the cot functions (e.g., a chair function) can be configured to selectively cause the turning mechanism 90 to actuate the fork 121 into the outboard position. When arranged in the outboard position, the fork 121 and the wheel 114 can be oriented orthogonally with respect to the length of the cot 10 (direction from the front end 17 to back end 19). Accordingly, the front wheels 26, the back wheels 46, or both can be arranged in the outboard position such that the front wheels 26, the back wheels 46, or both are directed towards the support frame 12.

Referring collectively to FIGS. 8, and 11-12, the cot functions can include an escalator function configured to maintain a patient supported by a patient support 14 level while the cot 10 is supported by an escalator. Accordingly, any of the operator controls 57 can be encoded to provide control signals that are operable to cause the elevator function to be activated, deactivated, or both. In some embodiments, the escalator function can be configured to orient the cot 10 such that a patient is facing in the same direction with respect to the slope of the escalator, while riding an up escalator 504 or a down escalator 506. Specifically, the escalator function can ensure that the back end 19 of the cot 10 facing a downward slope of the up escalator 504 and the down escalator 506. In other words, the cot 10 can be configured such that the back end 19 of the cot is loaded last upon the up escalator 504 or the down escalator 506.

Referring now to FIG. 13, the elevator function can be implemented according to a method 301. It is noted that, while the method 301 is depicted in FIG. 13 as comprising a plurality of enumerated processes, any of the processes of the method 301 can be performed in any order or omitted without departing from the scope of the present disclosure. At process 303, the support frame 12 of the cot 10 can be retracted. In some embodiments, the cot 10 can be configured to detect automatically that the support frame 12 is retracted prior to continuing with the elevator function. Alternatively or additionally, the cot 10 can be configured to automatically retract the support frame 12.

Referring collectively to FIGS. 7, 8, 11 and 13, the cot can be loaded upon the up escalator 504. The up escalator 504 can form an elevator slope θ with respect to the landing immediately preceding the up escalator 504. At process 305, the front wheels 26 can be loaded upon the up escalator 504. Upon loading the front wheels 26 upon the up escalator 504, the raise button 56 can be actuated. While the escalator function is active, the control signal transmitted from the raise button 56 can be received by the one or more processors 100. In response to the control signal transmitted from the raise button 56, the one or processors can execute machine readable instructions to automatically actuate the brake mechanism 94. Accordingly, the front wheels 26 can be locked to prevent the front wheels from rolling. As the raise button 56 is held active, the one or more processors can automatically cause the visual display component provide an image indicative of the loading end legs 20 being active.

At process 307, the raise button 56 can be held active. In response to the control signal transmitted from the raise button 56, the one or processors can execute machine readable instructions to automatically activate the cot leveling function. Accordingly, the cot leveling (equalization) function can dynamically actuate the loading end legs 20 to adjust the front angle $\alpha_f$. Thus, as the cot 10 is gradually urged onto the up escalator 504, the front angle $\alpha_f$ can be changed to keep the support frame 12 substantially level.

At process 309, the raise button 56 can be deactivated upon the back wheels 46 being loaded upon the up escalator 504. In response to the control signal transmitted from the raise button 56, the one or processors can execute machine readable instructions to automatically actuate the brake mechanism 94. Accordingly, the back wheels 46 can be locked to prevent the back wheels 46 from rolling. With the front wheels 26 and the back wheels 46 loaded upon the up escalator 504, the cot leveling function can adjust the front angle $\alpha_f$ to match the escalator angle θ.

At process 311, the raise button 56 can be activated upon the front wheels 26 approaching the end of the up escalator 504. In response to the control signal transmitted from the raise button 56, the one or processors can execute machine readable instructions to automatically actuate the brake mechanism 94. Accordingly, the front wheels 26 can be unlocked to allow the front wheels 26 to roll. As the front wheels 26 exit the up escalator 504, the cot leveling function can adjust the front angle $\alpha_f$ dynamically to keep the support frame 12 of the cot 10 level.

At process 313, the position of the loading end legs 20 can be determined automatically by the one or more processors 100. Accordingly, as the front end 17 of the cot 10 exits the up escalator 504, the front angle $\alpha_f$ can reach a predetermined angle such as, but not limited to, an angle corresponding to full extension of the loading end legs 20. Upon reaching the predetermined level, the one or processors 100 can execute machine readable instructions to automatically actuate the brake mechanism 94. Accordingly, the back wheels 46 can be unlocked to allow the back wheels 46 to roll. Thus, as the back end 19 of the cot 10 reaches the end of the up escalator 504, the cot 10 can be rolled away from the up escalator 504. In some embodiments, the escalator mode can be deactivated by actuating one of the operator controls 57. Alternatively or additionally, the elevator mode can be deactivated a predetermined time period (e.g., about 15 seconds) after the back wheels 46 are unlocked.

Referring collectively to FIGS. 7, 8, 12 and 13, the cot 10 can be loaded upon a down escalator 506 in a manner analogous to loading upon an up escalator 504. At process 305, the back wheels 46 can be loaded upon the down escalator 506. Upon loading the back wheels 46 upon the down escalator 506, the lower button 60 can be actuated. While the escalator function is active, the control signal transmitted from the lower button 60 can be received by the one or more processors 100. In response to the control signal transmitted from lower button 60, the one or processors can execute machine readable instructions to automatically actuate the brake mechanism 94. Accordingly, the back wheels 46 can be locked to prevent the back wheels 46 from rolling. As the lower button 60 is held active, the one or more processors can automatically cause the visual display component provide an image indicative of the loading end legs 20 being active.

At process 307, the lower button 60 can be held active. In response to the control signal transmitted from the lower button 60, the one or processors can execute machine readable instructions to automatically activate the cot leveling function. Accordingly, the cot leveling function can dynamically actuate the loading end legs 20 to adjust the front angle $\alpha_f$. Thus, as the cot 10 is gradually urged onto the down escalator 506, the front angle $\alpha_f$ can be changed keep the support frame 12 substantially level.

At process 309, the lower button 60 can be deactivated upon the front wheels 26 being loaded upon the down escalator 506. In response to the control signal transmitted from the lower button 60, the one or processors 100 can execute machine readable instructions to automatically actuate the brake mechanism 94. Accordingly, the front wheels 26 can locked to prevent the front wheels 26 from rolling. With the front wheels 26 and the back wheels 46 loaded upon the down escalator 506, the cot leveling function can adjust the front angle $\alpha_f$ to match the escalator angle θ.

At process 311, the lower button 60 can be activated upon the back wheels 46 approaching the end of the down escalator 506. In response to the control signal transmitted from the lower button 60, the one or processors can execute machine readable instructions to automatically actuate the brake mechanism 94. Accordingly, the back wheels 46 can be unlocked to allow the back wheels 46 to roll. As the back wheels 46 exit the down escalator 506, the cot leveling function can adjust the front angle $\alpha_f$ dynamically to keep the support frame 12 of the cot 10 substantially level.

At process 313, the position of the loading end legs 20 can be determined automatically by the one or more processors 100. Accordingly, as the back end 19 of the cot 10 exits the down escalator 506, the front angle $\alpha_f$ can reach a predetermined angle such as, but not limited to, an angle corresponding to full extension of the loading end legs 20. Upon reaching the predetermined level, the one or processors 100 can execute machine readable instructions to automatically actuate the brake mechanism 94. Accordingly, the front wheels 26 can be unlocked to allow the front wheels 26 to roll. Thus, as the front end 17 of the cot 10 reaches the end of the down escalator 506, the cot 10 can be rolled away from the down escalator 506. In some embodiments, the elevator mode can be deactivated a predetermined time period (e.g., about 15 seconds) after the front wheels 26 are unlocked.

Referring collectively to FIGS. 4B, 7, and 8, the cot functions can comprise a cardiopulmonary resuscitation (CPR) function operable to automatically adjust the cot 10 to an ergonomic position for the medical personnel to perform effective CPR in the event of a cardiac arrest. Any of the operator controls 57 can be encoded to provide control signals that are operable to cause the CPR function to be activated, deactivated, or both. In some embodiments, the CPR function can be automatically deactivated when the cot is within an ambulance, connected to a cot fastener, or both.

Upon activation of the CPR function, a control signal can be transmitted to and received by the one or more processors 100. In response to the control signal, the one or processors can execute machine readable instructions to automatically actuate the brake mechanism 94. Accordingly, the front wheels 26, the back wheels 46, or both can be locked to prevent the cot 10 from rolling. The cot 10 can be configured to provide an audible indication that the CPR function has been activated. Additionally, the height of the support frame 12 of the cot 10 can be slowly adjusted to an intermediate transport position (FIG. 4B) corresponding to a substantially level height for administering CPR such as, for example, a chair height, a couch height, between about 12 inches (about 30.5 cm) and about 36 inches (about 91.4 cm), or any other predetermined height suitable for administering CPR. In some embodiments, one or more of the operator controls 57 can be configured to lock or unlock the front wheels 26, the back wheels 46, or both. Actuating the operator controls 57 to lock or unlock the front wheels 26, the back wheels 46, or both, can automatically deactivate the CPR function. Accordingly, normal operation of the cot 10 via the lower button 60 and the raise button 56 can be restored.

Referring collectively to FIGS. 3, 7, and 8, the cot functions can comprise a extracorporeal membrane oxygenation (ECMO) function operable to automatically maintain the front end 17 at a higher elevation than the back end 19 of the cot 10 during operation of the cot 10. Upon activation of the ECMO function, a control signal can be transmitted to and received by the one or more processors 100. In response to the control signal, the one or processors 100 can execute machine readable instructions to automatically actuate the lock actuator 92. Accordingly, the front wheels 26, the back wheels 46, or both can be prevented from swiveling or turning. Additionally, the front angle $\alpha_f$, the back angle $\alpha_b$, or both can be adjusted such that the support frame 12 is at a predetermined downward slope angle from the front end 17 to the back end 19. The adjustment can be achieved in a manner substantially similar to the cot leveling function, with the exception that the support frame 12 is adjusted to the downward slope angle with respect to gravity, instead of level with respect to gravity. Moreover, while the ECMO function is activated, the lower button 60 and the raise button 56 can be utilized to adjust the average height of the support frame 12 while the downward slope angle is maintained automatically. Upon deactivation of the ECMO function, normal operation of the cot 10 can be restored.

Referring collectively to FIGS. 14A and 14B, embodiments of the cot 10 can comprise a patient support member 400 for supporting patients upon the cot 10. In some embodiments, the patient support member 400 can be coupled to the support frame 12 of the cot 10. The patient support member 400 can comprise a head supporting portion 402 for supporting the back and head and neck regions of a patient, and a foot supporting portion 404 for supporting lower limb region of a patient. The patient support member 400 can further comprise a middle portion 406 located between the head supporting portion 402 and the foot supporting portion 404. Optionally, the patient support member 400 can comprise a support pad 408 for providing cushioning for patient comfort. The support pad 408 can include an outer layer formed from material that is non-reactive to biological fluids and materials.

Referring now collectively to FIGS. 14A and 14B, the patient support member 400 can be operable to articulate with respect to the support frame 12 of the cot 10. For example, the head supporting portion 402, the foot supporting portion 404, or both can be rotated with respect to the support frame 12. The head supporting portion 402 can be adjusted to elevate the torso of a patient with respect to a flat position, i.e., substantially parallel with the support frame 12. Specifically, a head offset angle $\theta_H$ can be defined between the support frame 12 and the head supporting portion 402. The head offset angle $\theta_H$ can increase as the head supporting portion 402 is rotated away from the support frame 12. In some embodiments, the head offset angle $\theta_H$ can be limited to a maximum angle that is substantially acute such as, for example, about 85° in one embodiment, or about 76° in another embodiment. The foot supporting portion 404 can be adjusted to elevate the lower limb region of a patient with respect to a flat position, i.e., substantially parallel with the support frame 12. A foot offset angle $\theta_F$ can be defined between the support frame 12 and the foot supporting portion 404. The foot offset angle $\theta_F$ can increase as the foot supporting portion 404 is rotated away from the support frame 12. In some embodiments, the foot offset angle $\theta_F$ can be limited to a maximum angle that is substantially acute such as, for example, about 35° in one embodiment, about 25° in another embodiment, or about 16° in a further embodiment.

Referring collectively to FIGS. 1 and 14, the cot 10 can be configured to automatically actuate to a seated loading position (or also referred to hereinafter as a "chair position"). Specifically, the front actuator 16 can actuate the loading end legs 20, the back actuator 18 can actuate the control end legs 40, or both the front actuator 16 and the back actuator 18 can actuate to lower the back end 19 of the cot 10 with respect to the front end 17 of the cot 10. When the back end 19 of the cot 10 is lowered, a seated loading angle $\alpha$ can be formed between the support frame 12 and a substantially level surface 503. In some embodiments, the seated loading angle $\alpha$ can be limited to a maximum angle that is substantially acute such as, for example, about 35° in one embodiment, about 25° in another embodiment, or about 16° in a further embodiment. In some embodiments, the seated loading angle $\alpha$ can be substantially the same as the foot offset angle $\theta_F$ such that the foot supporting portion 404 of the patient support member 400 is substantially parallel to the level surface 503.

Referring again to FIGS. 14A and 14B, the head supporting portion 402 and the foot supporting portion 404 of the patient support member 400 can be raised away from the support frame 12 prior to automatically actuating the cot 10 to the seated loading position. Additionally, the front wheels 26 and the back wheels 46 can be oriented in a substantially similar direction. Once aligned, the front wheels 26 and the back wheels 46 can be locked in place. In some embodiments, the cot 10 can comprise an input configured to receive a command to actuate the cot to the seated loading position. For example, the visual display component or GUI 58 can include a touch screen input for receiving tactile input. Alternatively or additionally, various other buttons, or audio inputs can be configured to receive the command to actuate the cot 10 to the seated loading position.

Once the control box 50 receives the command, the cot 10 can be set into a seated loading position (chair position) mode. In some embodiments, the cot 10 can automatically actuate to the seated loading position upon entering the seated loading position mode without additional input. Alternatively, the cot 10 can require additional input prior to transitioning to the seated loading position. For example, the back end 19 of the cot 10 can be lowered by pressing the "–" button 60 (FIG. 2), while in the seated loading position mode. In further embodiments, a time limit can be applied to the seated loading position mode to limit the total time the mode remains active. Accordingly, the seated loading position mode can automatically be deactivated upon an expiration of the time limit such as, for example, about 60 seconds in one embodiment, about 30 seconds in another embodiment, or about 15 seconds in further embodiment. In still further embodiments, upon entering the seated loading position mode, a confirmation that indicates that the cot 10 is in the seated loading position mode can be provided such as, for example, an audible indication or a visual indication upon the visual display component or GUI 58.

Referring now to FIG. 15, the cot 10 (generally depicted in block diagram) in another embodiment includes an on-board, networked, cot control system, generally indicated by reference symbol 1000. The cot control system 1000 enables electrical messages to be sent to and received from various electronic control circuits or digital controllers provided on the cot 10. It is to be appreciated that the digital controllers may each be a microprocessor or microcontroller, such as processor 100 (FIG. 7) that includes a central processing unit, memory and other functional elements, all provided on a single semiconductor substrate, or integrated circuit that provides the hereafter disclosed specialized operations. In addition it is to be appreciated that while the particular disclosed embodiments of the controllers utilize programmed processors and/or special-purpose integrated circuits, these devices can be implemented using discrete devices, or any analog or hybrid counterpart including logical or software implementations (e.g., emulations) of any of these devices.

In some embodiments the cot control system 1000 has one or more controllers, e.g., a motor controller 1002, a graphical user interface (GUI) controller 1004, and/or a battery unit or controller 1006. It will be understood by those skilled in the art that the number of controllers may be fewer, such the one or more processors 100 depicted by FIG. 7, or greater than what is shown in FIG. 15. It will also be understood that the numbering of the controllers in FIG. 15 is arbitrary, and that the specialized functions described for various ones of the controllers have been done for illustrative purposes only. That is, the specialized functions of various ones of the controllers may be changed and/or combined with other controllers and/or eliminated in some embodiments of the cot 10. For example, in one embodiment the cot control system 1000 has at least one controller, sensors, a user display unit, the battery unit 1006, and a wired communication network 1008 configured to transport messages between the at least one controller, sensors, the user display unit, and the battery unit. In one embodiment, the battery unit 1006 is a battery management system integrated with a battery pack (i.e., the batteries) that provides portable power to the cot 10, wherein that battery management system controls the charging and discharging of the battery pack and communicates with the at least one controller over the communication network.

In other embodiments, the various controllers 1002, 1004, 1006 may be communicatively connected via the wired network 1008, such as for example, a controller area network (CAN), a LONWorks network, a LIN network, an RS-232 network, a Firewire network, a DeviceNet network, or any other type of network or fieldbus that provides a communication system for communication between such electronic control circuits. Regardless of the specific type of the wired network 1008, the wired link may be between a physical network node (i.e., an active electronic device or circuit that is attached to the cot control system 1000, and which is capable of sending, receiving, or forwarding information over the wired network 1008) and an electronic control circuit (controller) programmed and/or designed to control the movement of at least the leg actuators of the cot, and optionally, the illuminating of cot drive and/or height indicator lights, locking and unlocking of wheel locks, unlocking of an external cot fastener, data logging, and error monitoring, correcting and signaling.

Each physical network node typically includes a circuit board that contains the electronics necessary for controlling a user interface, one or more actuators, one or more sensors, and/or one or more other electrical components as well as the associated electronic necessary for allowing each node to communicate within the cot control system 1000. For example, in FIG. 15, a first node in the cot control system 1000 may be the motor controller 1002 for controlling one or more motors, actuators, and/or each swivel castor lock (brake) of cot 10 e.g., actuators 16, 18, turning mechanism 90, locking actuator 92, and/or braking mechanism 94 (FIGS. 1 and 7). The motor controller 1002 includes the associated electronic necessary for allowing the controller to communicate using the wired network 1008 with any other networked electronics. In one embodiment, the one or more processors may be embodied as the motor controller 1002.

The GUI controller 1004 may be a second node that is configured to control a graphical user interface 1005, and in one embodiment can be embodied as control box 50 provided with the visual display component or GUI 58, i.e., as a user display unit. The graphical user interface 1005 may include one or more buttons or switches, or the like, such as any one of the buttons in button array 52 and/or 54 (FIG. 8) or it may include a touch screen, or other device for allowing a patient or caregiver to control one or more aspects of the cot 10 as well as an output display to provide visual/graphical feedback of cot status along with a corresponding audio and/or tactile output from included audio and/or tactile output generating devices. The GUI controller 1004 includes the associated electronic necessary for allowing the GUI controller 1004 to communicate using the wired network 1008 with any other networked electronics.

A third node in the cot control system 1000 may be the battery unit or controller 1006 for controlling one or more battery based power supplies of the cot 10. The battery controller 1006 likewise includes the associated electronic necessary for allowing controller 1006 to communicate using the wired network 1008 with any other networked electronics. In other embodiments, other nodes in the cot control system 1000 are, e.g., one or more sensors that can be connected to the wired network 1008 and/or directed to any of the controller 1002, 1004, and 1006.

In the illustrated embodiment, the hereafter described sensors have their respective outputs connected to inputs of the motor controller 1002. The one or more sensors may include one or more position sensors 1010 for detecting a relative position/location of a component of the cot 10, such as the load and control end legs either being in an opened position (i.e., the cot raised above its lowest position by the associated leg) or in an closed position (i.e., the associated leg is in its lowest position placing the cot in its lowest position). The one or more sensors may also include one or more temperature sensing sensors 1012 for detecting a motor's operating temperature. The one or more sensors may include one or more proximity sensors 1014 and/or 1016 for detecting a position/location of a first component of the cot 10 relative to an external support surface, such as the ground or a transport bay of an emergency vehicle, and/or to another component of the cot, such as for detecting proximity of the intermediate load wheel to another exterior surface and relatively location of an operator (control end) leg actuator mount to a support bracket. The one or more sensors may include one or more angle sensors 1018 for detecting the angular orientation of one or more components of cot 10, such as an angle of the load and control end legs. The one or more sensors may include one or more detection sensors 1020 for detecting the proximity and/or a connection to an external cot fastener, such as provided in an emergency transport vehicle. The one or more sensors may include one or more voltage sensing sensors 1022 for detecting a voltage such as the charge voltage. It is to be appreciated that the motor controller 1002 in the illustrated embodiment is responsible for processing the outputs of these sensors 1010, 1012, 1014, 1016, 1018, 1020 and/or 1022 and forwarding messages containing the sensed information to other networked electronic such as controller 1004 and 1006 in the cot control system 1000 via the wired network 1008.

In still another embodiment, the cot control system 1000 of the cot 10 can also include a wireless controller 1024 this is networked via the wired network 1008 to the other controllers 1002, 1004 and 1006 to at least provide to an external wireless receiver the forwarded messages as well as any other messages communicated via the wired network 1008 as desired. For example, as hospitals are starting to utilize music to help with pain management, the GUI controller 1004 can be loaded with a music player application 1009 that syncs with, via the wireless controller 1024, and plays the same music being transmitted/broadcasted/streamed over a hospital network. In such an embodiment, the operator can use the GUI 1005 to operate the music player application 1009 (to sync with the hospital music system, automatically if desired, stop, select, change, etc.), and play music through an audio speaker 1011 with volume control provided on cot 10. A preload selection of music may also be selected and played by the music player application 1009 from memory 102 (FIG. 7), if desired. It is to be appreciated that the wireless controller 1024 includes and/or is electronically coupled to a wireless transceiver 1126 which provides a wireless communication link 1028 to the external wireless receiver 1030. The wireless communication link 1028 may be a Bluetooth connection, a ZigBee connection, a RuBee connection, a WiFi (IEEE 802.11) connection, an infrared (IR) connection, or any other suitable wireless communication connection.

The cot 10 has a number of operating modes with five (5) being operator selected, powered motion, operating modes: Awake, Direct Power—Both Legs, Direct Power—Loading end Legs Mode, Direct Power—Control end Legs Mode, and Chair Position Mode. These five (5) modes are selectable from the GUI 1005 in one embodiment, the control box 50 in another embodiment, via button(s) 53, and/or via the button array 52 and/or 54. Visual and/or audible cues may be provided by the GUI 1005 as to the current operation of the cot 10, such as audibly stating "Raising" or "Lowering" through the speaker 1011 when the cot is operating in a powered mode the is either raising or lowering the cot 10. A discussion of the five operator selected, powered motion, operating modes now follows hereafter.

The "Awake" mode is the fully operational mode of the cot 10, which allows for independent leg movement of the control and loading end legs. Depending on the state of the cot 10, one or both legs may respond to the "+/raise/extend" and "–/lower/retract" operator control buttons 1035, 1037, respectively, that may be provided, e.g., via a user interface 1039. The user interface 1039 may also include a power control 1041, e.g., push button, toggle switch, selector, etc., to provide the "On/Power" and ("Off/No Power") when the operator commands either turning on or off the power to the cot control system 1000 of the cot 10. Manipulating the power control 1041 to turn on the cot control system 1000 to an active state (i.e., the Awake mode) sends to the motor controller 1002 a power voltage (PWR) signal. The control buttons 1035, 1037 may be also provided as a selector position or throw position of a selector or toggle switch, such as may be provided by buttons 56, 60, button array 52 and/or 54 depicted in FIG. 8. Additionally, in other embodiments, the GUI controller 1004, the GUI 1005, and/or the user interface 1039 may be provided as an integrated part of or separately from the control box 50 (FIG. 1).

The Direct Power modes allow the operator to directly (and independently) control the motion of the cot's legs via the user interface 1039 and/or GUI 1005. For example, selection of one of the Direct Power modes allows the operator to independently control one or both sets of legs to raise, lower, load or unload the cot. In the following direct power modes, the cot 10 will not use any of its sensors to determine which leg should be moved in response to a button press of one the operator control buttons 1035, 1037, such as the raise button 56 or the lower button 60. "Direct Power-Both Legs" mode allows the operator to directly power the control and loading leg motors by selecting "Direct Power mode-Both Legs" with the Direct Power mode button, e.g., a button in button array 52 on the GUI 1005 and/or button(s) 53, and then pressing the raise/extend operator control ("+") button 1035 or retract/lower operator control ("–") button 1037, regardless of other sensor values. "Direct Power—Loading End Legs Mode" allows the operator to directly power the loading end (load) leg motor by pressing the "+" button 1035 or "–" button 1037, regardless of other sensor values. "Direct Power—Control End Legs Mode" allows the operator to directly power the control end (operator) leg motor by pressing the "+" button 1035 or "–" button 1037, regardless of other sensor values. "Chair Position Mode" allows the operator to easily move the cot 10 into a position where the patient surface is angled to allow the patient to more easily sit on the cot, as was explained in greater detail above in earlier sections in reference to FIGS. 13 and 14. The cot 10 may be set with an individual load height which matches the height at which the cot may be loaded onto an external support surface such as above the ground, e.g., the floor of a transport vehicle. When the operator is using the "+" button 1035 to raise the cot 10, it will automatically stop at this height. It is to be appreciated that in each Direct Power mode, a countdown timer counts down from a predetermined amount of time, e.g., 15 seconds, after the operator places the cot in a particular Direct Power mode. If no further action i.e., pressing of one of the buttons 1035 or 1037, is taken by the operator after selecting the Direct Power mode, the motor controller 1002 reverts to its standard operating mode upon expiration of the countdown timer. In some embodiments, a graphical image may be provided on the GUI 1005 showing a countdown timer 59 (FIG. 8) and the corresponding count.

"Sleep Mode" is a reduced power consumption state for periods of time when the cot 10 is left dormant. "Manual Operation" is used to retract the cot legs without powered control. Manual Operation exists independently of any motor controller operation or input signal. The motor controller 1002 will not know that manual operation has been engaged and will behave exactly as if manual operation had not been engaged. Operation in this mode has no software requirements. When the cot's power control 1041, such as provided by one of the button arrays 52 or 54 (FIG. 8) is in the off position/state ("Off Mode"), the motor controller 1002 is powered down (off) and the display of the GUI 1005, position indicator and drive lights 1032, 1034, and the loading and control end solenoid actuators 1036, 1038 are not powered. Operation in this mode also has no software requirements. "Charge Mode" is used when the cot 10 is connected to a charger 1040 for charging the battery, which is detected by the charge voltage sensor 1022. A graphical image may be provided to the GUI 1005 or 58 to show a corresponding voltage/charge level of the battery 1007 as well as a visual indication if the battery is currently being charged, e.g., via a color change and/or pulsation, etc., of a battery voltage/charge level graphical image 61 (FIG. 8). It is to be appreciated that the charger is external to the cot 10 and may be connected to an outlet within the emergency transport vehicle or directly to the vehicles' electrical system. In other embodiments, when the cot 10 is docked into a cot fastener (not shown), which may be detected by the cot fastener detection sensor 1020, wireless remote in-vehicle controls (not shown) can become active for controlling the extension and retraction of the cot's legs, via command messaging received via the wireless controller 1024 and sent to the motor controller 1002 for execution via the wired network 1008, if desired.

With reference to FIG. 16, a communications messaging protocol for the motor controller 1002 is illustrated showing the information provided from the motor controller 1002 over the wired network 1008. Each message following the protocol is composed of a header frame which indicates the originator and type of message that is being provided over the cot control system 1000, a byte count frame which indicates the length of the message for message error detection, and the data frame. The data frame in the message from the motor controller 1002 may include a B1 bit, B2 bit, C1 Floor Conditions bit, C2 Floor Conditions bit, D1 bit, D2 bit, Awake bit, Light Cutoff bit, Logging bit, Charge Voltage Present bit, Lights On bit, Fastener Detect bit, USB Activity bit, A1 Extension bits, A2 Extension bits, Motor State bits, Voltage Bin bits, and/or Motor Controller Error Code bits.

The B1 bit is set by the motor controller 1002 and broadcasted over the wired network 1008 while the "+" button 1035 is pressed. The B2 bit is set by the motor controller 1002 and broadcasted over the wired network 1008 while "–" button 1037 is pressed. The C1 Floor Conditions bit is set by the motor controller 1002 and broadcasted over the wired network 1008 while the C1 Floor Conditions bit of the Input Code signal is set. The C2 Floor Conditions bit is set by the motor controller 1002 and broadcasted over the wired network 1008 while the C2 Floor Conditions bit of the Input Code signal is set. The D1 bit is set by the motor controller 1002 and broadcasted over the wired network 1008 while D1 is set (when closed). The D2 bit is set by the motor controller 1002 and broadcasted over the wired network 1008 while D2 is set (when closed). The Awake bit is set by the motor controller 1002 and broadcasted over the wired network 1008 while the operating mode is Awake or Charge, or if there is a "Stuck Button Error" active (even when the motor controller 1002 is in Sleep mode). The Light Cutoff bit is set by the motor controller 1002 and broadcasted over the wired network 1008 while the battery voltage is less than a Light Minimum Voltage Threshold. In one embodiment, the Light Minimum Voltage Threshold is 5 volts, but may be set to any other desired voltage level via a change to such value set in a configuration file 1106 or script 1100 (FIG. 19). The Logging bit is set by the motor controller 1002 and broadcasted over the wired network 1008 when the motor controller is configured to log to a removable flash memory card, e.g., such as a memory stick, SD card, compact flash, and the likes.

The Charge Voltage Present bit is set by the motor controller 1002 and broadcasted over the wired network 1008 when the motor controller detects a non-zero voltage (Charge+) via charge voltage sensor 1022. The Lights On bit is set by the motor controller 1002 and broadcasted over the wired network 1008 while the lights are being commanded to be on via a button of the button arrays 52 and/or 54, and/or via a remote control signal received via wireless controller 1024 commanding the lights to be on. The USB Activity bit is set by the motor controller 1002 and broadcasted over the wired network 1008 when a software utility tool is connected to the controller (e.g., for programming, diagnostics, updating, etc). The A1 Extension (32 bits) is set by the motor controller 1002 and broadcasted over the wired network 1008 to indicate the amount of extension of the load (loading end) leg actuator rod. The A1 Extension is expressed in mils with a range from 0 to 18000, with 0 mils being full retraction and 18000 mils being full extension. The A2 Extension (32 bits) is set by the motor controller 1002 and broadcasted over the wired network 1008 to indicate the amount of extension of the operator (control end) leg actuator rod. The A2 Extension is expressed in mils with a range from 0 to 18000, with 0 mils being full retraction and 18000 mils being full extension.

The Motor State bits (32 bits in one embodiment, other desired bit lengths in other embodiments) is set by the motor controller 1002 and broadcasted over the wired network 1008 to indicated the current Motor State with the following enumeration: 0=Motor State 0; 1=Motor State 1; 2=Motor State 2; 3=Motor State 3; 4=Motor State 1–; 5=Motor State 2–; 6=Motor State 3–; 7=Motor State 4; 8=Motor State 5; 9=Motor State 6; 10=Motor State 7; 11=Motor State 8; and 12=Motor State 9. Each of these motor states is discussed in greater details hereafter in later sections. For any condition where leg movement is locked out, the motor controller 1002 will report a Motor State 0 to the GUI controller 1004 for indication of the display 1005. The Voltage Bin bits (32 bits in one embodiment, other desired bit lengths in other embodiments) is set by the motor controller 1002 and broadcasted over the wired network 1008 to indicate the current Voltage Bin. The Motor Controller Error Code bits (64 bits in one embodiment, other desired bit lengths in other embodiments) is set by the motor controller 1002 and broadcasted over the wired network 1008 when detected. The conditions which result in providing a particular Motor Controller Error Code are discussed in greater details in later sections.

With reference to FIG. 17, a communications messaging protocol for the battery controller 1006 is illustrated showing the information provided from the battery controller 1006 over the wired network 1008. Each message following the protocol is composed of a header frame which indicates the originator and type of message that is being provided over the cot control system 1000, a byte count frame which indicates the length of the message for message error detection, and a data frame. The data frame in the message from the battery controller 1006 may includes a Charging bit, a Fully Charged bit, a Battery Error Code bits, a High Temperature bit, a Battery Temperature byte, Battery Voltage bytes, and/or Under Voltage bit. The Charging bit is set by the battery controller 1006 in a message and broadcasted over the wired network 1008 periodically while the battery 1007 is being charged via charger 1040. This information is used by the motor controller 1002 to detect charging errors when compared with the value of Charge Voltage sensor 1022 that should likewise indicate that the battery 1007 is a below a voltage level which indicates the current need for charging. The Fully Charged bit is set by the battery controller 1006 in a message and broadcasted over the wired network 1008 when the battery 1007 is at full charge voltage. This information is used by the motor controller 1002 to detect charging errors when compared with the value of the Charge Voltage sensor 1022 that should likewise indicate that the battery is no longer below the voltage level which indicates a current need for charging.

The Battery Error Code bits (16 bits in one embodiment, other desired bit lengths in other embodiments) is set by the battery controller 1006 in a message and broadcasted over the wired network 1008 in response to detecting an error in the current and/or voltage supplied by battery 1007 when electrically powering the operations of the cot 10. The motor controller 1002 uses the Battery Error Code to set the Motor Controller Error Code for the display 1005 as will be discussed in later sections. The High Temperature bit is set by the battery controller 1006 in a message and broadcasted over the wired network 1008 when the battery 1007 is at a temperature above 55° C. This information is likewise used by the motor controller 1002 to set the Motor Controller Error Code for the display 1005. The Battery Temperature byte and Battery Voltage bytes are set by the battery controller 1006 in a message and broadcasted over the wired network 1008 periodically after reading the temperature and voltage of the battery. If the least significant bits in the messages from the battery controller 1006 do not change after a certain time, then the motor controller 1002 will read the battery voltage (ChargeV) from the input of the Charge Voltage sensor 1022. The Under Voltage bit is set by the battery controller 1006 in a message and broadcasted over the wired network 1008 when the total voltage of battery 1007 is lower than 33.5 V in one embodiment, which may be higher or lower in other embodiments as is desired and set in the configuration file 1106. At this voltage and while remaining below this voltage, the motor controller 1002 will read the battery voltage (ChargeV) from the input of the Charge Voltage sensor 1022 instead of reading from the messages from the battery controller 1006.

With reference to FIG. 18, a communications messaging protocol for the GUI controller 1004 is illustrated showing the information provided from the GUI controller 1004 over the wired network 1008. Each message following the protocol is composed of a header frame which indicates the originator and type of message that is being provided over the cot control system 1000, a byte count frame which indicates the length of the message for message error detection, and a data frame. The data frame in the message from the GUI controller 1004 includes Drive Light bit, Direct Power Mode Code bits, Display Software Version bits, Display Config Version bits, and Display Graphics Version bits.

When an operator commands that the drive lights 1034, such as lights 86, 88, and 89 of the cot 10 be activated via the GUI 1005, the Drive Light bit is set by the GUI controller 1004 in a message and broadcasted over the wired network 1008. The motor controller 1002, in response to reading the message from the GUI controller with the Drive Light bit set, turns on the Drive Light 1034, such as lights 86, 88 and 89. As explained in later sections, the Direct Power Mode Code bits (3 bits in one embodiment, other desired bit lengths in other embodiments) when set by the GUI controller 1004 in a message in response to operator input via the GUI 1005 and broadcasted over the wired network 1008, is read and used by the motor controller 1002 in selecting the operating mode. The remaining data providing by the GUI controller 1004, such as the Display Software Version bits, the Display Config Version bits and the Display Graphics Version bits are set by the GUI controller 1004 in a message in response to a query and used by the motor controller 1002 to set and provide such version values to a querying external utility tool connected to the motor controller via USB for diagnostic/updating purposes.

The I/O signals between the motor controller 1002 and the rest of the system 1000 are shown in Table 1: Motor Controller I/O and FIG. 15.

TABLE 1

Motor Controller I/O

| Signal Designation | I/O | Description |
|---|---|---|
| PWR | I | Power Switch |
| A1 Ch1 | I | Load Leg Angle Sensor Channel 1 signal - used to determine leg position |
| A1 Ch2 | I | Load Leg Angle Sensor Channel 2 signal - used for validating sensor operation (Ch1 + Ch2 = 5 V) |
| A2 Ch1 | I | Operator Leg Angle Sensor Channel 1 signal - used to determine leg position |
| A2 Ch2 | I | Operator Leg Angle Sensor Channel 2 signal - used for validating sensor operation (Ch1 + Ch2 = 5 V) |
| +(B1) | I | Push Button"+" signal (on/off) (signals from lower and upper handle buttons come in as one input) |
| −(B2) | I | Push Button"−" signal (on/off) (signals from lower and upper handle buttons come in as one input) |
| C1 | I | Proximity Sensor - Intermediate Load Wheel signal |
| C2 | I | Proximity Sensor - Operator Leg Actuator Mount signal |
| D1 | I | Load Leg open/closed Sensor signal (on/off) |
| D2 | I | Operator Leg open/closed Sensor signal (on/off) |
| M1Temp | I | Motor1 Temperature signal (analog) |
| M2Temp | I | Motor2 Temperature signal (analog) |
| Charge Voltage | I | Charger Voltage (input voltage from PCB connector) |
| Position Indicator Light | O | Enables Position Indicator Light (on/off) |
| Drive Light | O | Enables Drive Lights (on/off) |
| Load Leg Solenoid | O | Open Load Leg Solenoid |
| Operator Leg Solenoid | O | Open Operator Leg Solenoid |
| CAN | I/O | Wired Network (e.g., CANbus) |
| USB | I/O | USB |
| Charger Detect− | I | Charger detect ground |
| Charger Detect+ | I | Charger detect signal (on/off) |

TABLE 1-continued

| Motor Controller I/O | |
|---|---|
| Signal Designation | I/O Description |
| Cot Fastener Unlock | O Unlock Cot Fastener |
| Cot Fastener | I Detect Cot Fastener |
| Swivel lock | O Electronic control of wheel swivel lock (on/off) |

The modes are selected by the motor controller 1002 based on input signals received, see Table 1 and FIG. 19. In this illustrated embodiment, the motor controller 1002 follows program instructions provided via one or more scripts 1100. Each script provides program codes or bytecodes that are saved into, and run from memory of the motor controller 1002, such as memory 102 (FIG. 7). Each bytecode for example, and not limited there to, can be a logic expression, a statement, or a value inputted to the motor controller 1002 for execution. For example, an Awake timer 1104 (FIG. 19) in one embodiment is implemented via a script which uses one or more timer registers of the controller 1002. The timer registers are counters that can be loaded with a value using a script command from the script 1100. The counters are then counting down every millisecond independently of execution status of any other script. Functions are included in the script's program code to load a timer, read its current count value, pause and resume the count, and check if the count has reached zero (0).

There are a number of other scripts 1100 provided in the controller's memory 1102 which enable the cot 10 to provide all the above mentioned movements, operations and indications, and which are discussed in greater detail in the sections that follow hereafter. The motor controller 1002 also uses a configuration file 1106, also stored in memory (e.g. memory 102), to read from and use for comparisons and/or setting particular preset/predetermined parameters/variables that are discussed herein. It is to be appreciated that any of the presets discussed herein may be provided in and read from the configuration file 1106 or script 1100 by the motor controller 1002 and is customizable by the operator if such a preset is provided in the configuration file 1106. Once stored in the controller's memory, such as memory 102, particular scripts can be executed either manually or automatically every time the controller 1002 is started. Manual launch is done by sending commands via the USB port. Scripts can be launched automatically after controller power up, e.g., via the PWR signal from the user interface 1039, or after reset by setting an auto script configuration to enable in the controller's configuration memory, e.g., a bootstrap. When enabled, if a script is detected in memory after reset, script execution is enabled and the script will run.

FIG. 20 shows via a flow chart, a main script (i.e., program instructions) 2000 carried out by the motor controller 1002 to automatically determine a motor mode selection based on the above mentioned inputs and issue a motor command in real time (i.e., in less than 1 second). In process step 2002, the motor controller 1002 checks to see if the PWR signal from the user interface 1039 is low, and if so then the mode maintained by the motor controller 1002 is an "Off" mode 2004. If the PWR signal from the user interface 1039 is high in process step 2002, then in process step 2006 the motor controller 1002 checks to see if the charge voltage (ChargeV) from the charger is non-zero, and if so then the mode selected by the motor controller 1002 is a "Charge" mode 2008. If the ChargeV voltage is zero in process step 2006, then in process step 2010 the motor controller 1002 checks to see if the previous mode was the "Charge" mode 2008. If so, then the motor controller 1002 checks to see if an Awake timer 1104 being run by the motor controller 1002 has expired in step 2012, and if so then the motor controller 1002 places the cot 10 into a "Sleep" mode 2014. If the motor controller 1002 determines that if an Awake Time of the Awake timer 1104 has not expired in process step 2012, then the motor controller 1002 will place the cot an "Awake" mode 2016. It is to be appreciated that the Awake Time is configurable via the configuration file 1106, but in one embodiment may be, for example, select from the range 0 to 10000 seconds, and in one specific embodiment is 600 seconds. However, if in process step 2010, the previous mode was not the Charge mode 2008, then the motor controller 1002 checks in process step 2018 to see if the previous mode was the "Off" mode 2004, and if so then the motor controller 1002 places the cot into the "Sleep" mode 2014. In other words, after a pre-set amount of time of non-use, the motor controller 1002 will enter the "Sleep" mode 2014 to conserve power.

Figure 24A:
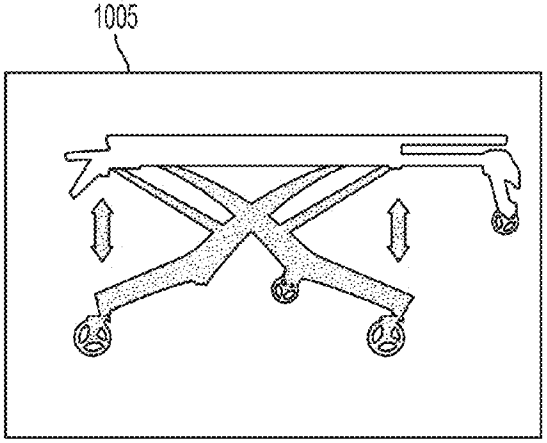
Figure 24B:
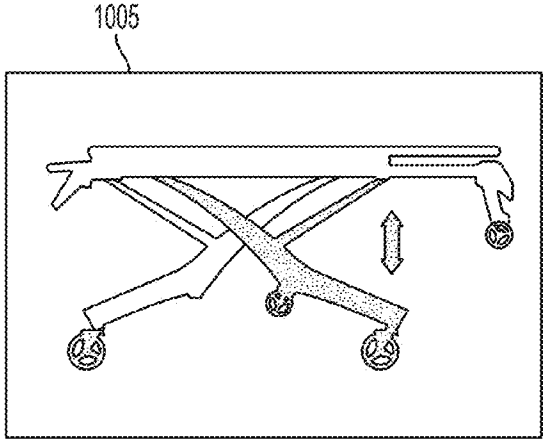
Figure 24C:
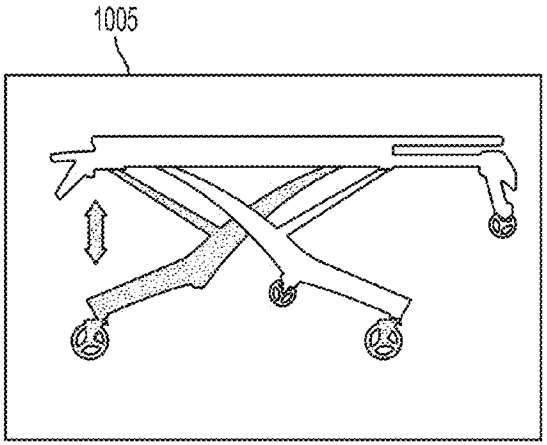
Figure 24D:
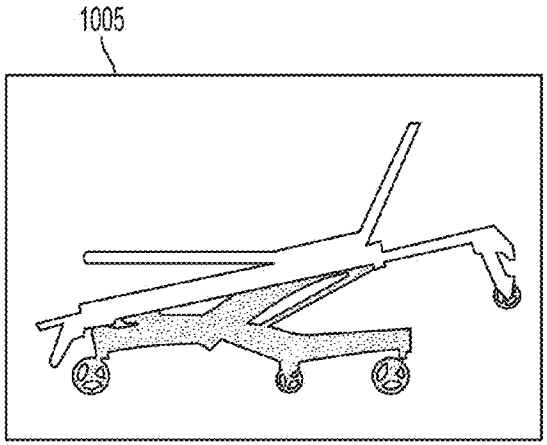

In process step 2018, the determination is that the previous mode was not the "Off" mode 2004, then in process step 2020, the motor controller 1002 checks to see if it has been more than the time specified by Awake Time since the last press of a "+" or "−" button 1035 or 1037, and if so then the motor controller 1002 place the cot into the "Sleep" mode 2014. A press of a "+" or "−" button 1035 or 1037 while the cot is in the Sleep mode 2014 in step 2022, will then cause the motor controller 1002 to place the cot into the Awake mode 2016. If in process step 2020 it has been less than the time specified by Awake Time since the last press of a "+" or "−" button 1035 or 1037, then the motor controller 1002 checks to see if the Direct Power Mode Code is 0 (i.e., via an "Awake" button selection on control box 50 and/or GUI 1005) in step 2024. If the Direct Power Mode Code is 0, then the motor controller 1002 checks to see if a press of a "+" or "−" button 1035 or 1037 is present in step 2026, and if not then the motor controller 1002 places the cot in the "Awake" mode 2016. If the Direct Power Mode Code is not 0 in process step 2024, then the motor controller 1002 checks to see if the Direct Power Mode Code is 1 (i.e., via an "Direct Power-Both Legs" button selection on control box 50, e.g., via a push on a button of the button array 52, 54 or button 53, and/or GUI 1005) in process step 2028, and if so actuates the cot in the "Direct Power-Both Legs" mode. If the Direct Power Mode Code is not 1 in process step 2028, then the motor controller 1002 checks to see if the Direct Power Mode Code is 2 (i.e., via an "Direct Power-Loading end legs" button selection on control box 50, button 53 and/or GUI 1005) in process step 2030, and if so actuates the cot in the "Direct Power—Loading end legs" mode. If the Direct Power Mode Code is not 2 in process step 2030, then the motor controller 1002 checks to see if the Direct Power Mode Code is 3 (i.e., via an "Direct Power—Control end legs" button selection on control box 50, button 53 and/or GUI 1005) in process step 2032, and if so actuates the cot in the "Direct Power—Control end legs" mode. If the Direct Power Mode Code is not 3 in process step 2032, then the motor controller 1002 checks to see if the Direct Power Mode Code is 4 (i.e., via an "Set Load Height" button selection on control box 50, button 53 and/or GUI 1005) in process step 2034, and if so actuates the cot in the "Set Load Height" mode. If the Direct Power Mode Code is not 4 in process step 2034, then the motor controller 1002 checks to see if the Direct Power Mode Code is 5 (i.e., via an "Chair Position" button selection on control box 50, button 53 and/or GUI 1005) in process step 2036, and if so actuates the cot in the Chair Position Mode. If the Direct Power Mode Code is not 5 in process step 2036, then the motor controller 1002 places the cot in the Awake mode. If in process step 2026 the motor controller 1002 detects the presence of a press of a "+" or "−" button 1035 or 1037, then the motor controller 1002 determines and selects in process step 2038 a motor state command based on the inputs received as is explained in greater detail hereafter in later sections. It is to be appreciated that in some embodiments, one of the buttons of the button array 52, 54 or button 53 may function as a mode selection button which allows a user to cycle through a mode selection sequence each having an associated one of the Direct Power Mode Code values discussed herein. For example, in some embodiments each button press cycles to the next mode and causes the motor controller 1002 to have a matching image of the selected mode displayed on the GUI 58 or 1005. For example, FIG. 24A depicts the matching image for the selection of Direct Power-Both Legs mode displayed on GUI 1005, FIG. 24B depicts the matching image for the selection of Direct Power-Loading end legs mode displayed on GUI 1005, and FIG. 24C depicts the matching image for the selection of Direct Power-Control end legs mode displayed on GUI 1005. FIG. 24D depicts the matching image for the selection of the Chair Position mode that the motor controller 1002 displays on GUI 1005, which is discussed in later sections. In some embodiments, the button press sequence is: Direct Power-Both Legs, which corresponds to a DirectPowerModeCode=1, Direct Power-Loading end legs, which corresponds to a DirectPowerModeCode=2, Direct Power-Control end legs, which corresponds to a DirectPowerModeCode=3, Set Load Height, which corresponds to a DirectPowerModeCode=4, and Standard (Normal) operating mode, which places the motor controller 1002 back in control of operating automatically the sequence of moving the legs based on sensor inputs and pushing of other button(s) on the control box 50 and/or pressing of the "+" or "−" button 1035 or 1037 as discussed herein.

Off Mode and Charge Mode Operations

In the Off Mode and Charge Mode Operation, the motor controller 1002 is powered, but no power is delivered to the actuators 16, 18, and no illumination is provided by the lights 86, 88, 89. The motor controller 1002 ignores any input of the "+" and "−" operator control buttons 1035, 1037. Error Detection, error logging, and updating of the Error Code shall continue as described in a later section. As mentioned previously above, if the PWR signal from the user interface 1039 is high, then if the charge voltage (ChargeV) from the charger 1040 is non-zero the mode is "Charge", which sets the Charge Voltage Present bit in the message sent from the motor controller 1002 over the wired network 1008.

Sleep Mode Operation

In the Sleep Mode Operation, the motor controller 1002 is powered down to minimize power consumption of the battery's energy. In this mode, no power is delivered to the actuators, and no illumination is provided by the lights 1032, 1034. If input, i.e., a pressing of either the raise/extend operator control ("+") button 1035 or the lower/retract operator control ("−") button 1037 occurs, then the motor controller 1002 is placed in the Awake Mode Operation once the pressing of either of the buttons 1035, 1037 is released. The next "+"/"−" button press then operates the cot 10 as described in later sections hereafter as long as the Awake timer 1104 has not expired, sending the motor controller 1002 back to "Sleep" mode as discussed previously above. In the Sleep Mode the motor controller 1002 continues to monitor for error conditions. Any detected error is logged in the error log file, but no other error handling occurs again to minimize power consumption of the battery's energy.

Direct Power—Both Legs, Loading End Legs, or Control End Legs

In the Direct Power—Both Legs mode, Direct Power—Loading end legs mode, and the Direct Power—Control end legs mode, the motor controller 1002 continues to monitor for error conditions. Any detected error is logged in an error log file. The associated Error Code bit is set for any detected error. No other error handling occurs in this mode. All sensors (including angle sensors, proximity sensors, and leg state sensors) are ignored by the motor controller 1002 for controlling motion of the legs in these modes. The Motor State is 5 for the Direct Power—Control end legs mode. The Motor State is 6 for the Direct Power—Both Legs mode. The Motor State is 7 for the Direct Power—Loading end legs mode.

Chair Position Mode

In the Chair Position Mode, the motor controller 1002 displays the image depicted in FIG. 24D on the GUI 1005, and ignores the "+" button 1035. While the "−" button 1037 is held, the motor controller 1002 moves the cot 10 in a level condition to a Chair Position height parameter preset in the configuration file 1106. Once the cot has reached the level of the Chair Position height, the loading end legs will stop moving and the control end legs will retract at a controlled power to Operator Chair height. If the loading end legs 20 are already at the level of the Chair Position height when the "−" button 1037 is pressed, then the motor controller 1002 will go straight to retracting the control end legs 40 at a controlled power rate to the Operator Chair height preset in the configuration file 1106 while the loading end legs 20 are not moved. The Motor State is 9 for the Chair Position Mode.

Set Load Height

While the mode selection Set Load Height is set, the motor controller 1002 stores in memory (e.g., memory 102) the current A1 value as the preset Load Height provided in the configuration file 1106. The setting is stored in the configuration file 1106 in terms relative to the actuator rod extension, not the raw voltage reading. While in this mode, the motor controller 1002 ignores the operator control buttons 1035, 1037.

Awake Mode

The Awake mode is the standard (fully) operational mode of the cot. This mode allows for independent leg movement of the control end legs and the loading end legs.

Referring to FIG. 21, the motor controller 1002 uses the value of bits in an Input Code signal according to the shown mapping to determine automatically the Motor State in process step 2038 (FIG. 20). The motor state commands are defined in later sections provided hereafter. The bits of the Input Code signal are defined as the following: Bit 0=D1, and Bit 1=D2. With reference made also to FIGS. 22 and 23, showing in cross section cross member 64 (taken along section line A-A depicted in FIG. 2) to which an upper actuator cross member 299 (FIG. 6) is attached rotatably. As depicted by FIGS. 22 and 23, the cross member 64 provides a pivot plate 2200 in a cavity 2202 defined by its underside 2203. The pivot plate 2200 is attached rotatably to the cross member 64 adjacent a first end 2204 and attached rotatable to the upper actuator cross member 299 adjacent a second end 2206, which is spaced from (i.e., remote) and below the first end 2204.

As depicted by FIG. 23, the pivot plate 2200 can rotate about the first end 2204 in an angle r, which in one embodiment ranges from 0 to 15 degrees, in other embodiment ranges from 0 to 30 degrees, and in still another embodiment ranges from 0 to 45 degrees, or ranging from anything else in between 0 and 90 degrees. As depicted by FIG. 22, when a side 2208 of the pivot plate, which is spaced from (i.e., remote) and above the actuator cross member 299, is closely adjacent (i.e., angle r <3 degrees), parallel to or abutting against the underside 2203 of the cross member 64, the pivot plate 2200 is in a first position $X_1$. The first position $X_1$ is detected and communicated to the motor controller 1002 by the open/close sensor 1010 (FIG. 15), which may be, for example, a reed switch sensor, a Hall-effect sensor, an angle sensor, or a contact switch. Accordingly, the bit D1 is set to 1 when pivot plate 2200 of the load leg is detected by the sensor 1010 in the location of the first position $X_1$ as depicted by FIG. 22, and set to 0 when the pivot plate 2200 is in the location of the second position $X_2$ as depicted by FIG. 23.

In one embodiment, the second position $X_2$ is indicated by the sensor 1010 when angle r>3 degrees in one embodiment. In still another embodiment, the second position $X_2$ is indicated by the sensor 1010 when the upper actuator cross-member 299 drops 2.5 mm below its relative position when the pivot plate 2200 is in the first position $X_1$. Likewise, as the pivot plate for the control end legs (not shown) is the same as pivot plate 2200, bit D2 is set to 1 when the pivot plate for the control end legs is in first position $X_1$ as depicted by FIG. 22, and set to 0 when in the second position $X_2$ as depicted by FIG. 23.

In still other embodiments, it is to be appreciated that as the cot actuation system 34, which is under the automated control of the cot control system 1000, interconnects the support frame 12 and each of the pair of legs 20, 40 together, and is configured as explained above in previous sections to effect changes in elevation of the support frame 12 relative to the wheels 26, 46 of each of the legs 20, 40. The cot control system 1000 controls activation of the cot actuation system 34, and is configured as explained above to detect one or both actuators 16, 18 of the cot actuation system 34 being at a first location or position $X_1$ relative to the support frame 12, where the first location is remote from a second location or position $X_2$ and which situates an end (i.e., cross member 299) of the actuator 16 and/or 18 that is remote from the wheels 26, 46 closer to the support frame 12. When a signal requesting a change in elevation of the support frame 12 relative to the wheels 26, 46 of each of the legs 20 and/or 40 is present, such as a pressing of the control button 56 or 60 and/or an Input Code signal indicating such a change in elevation as explained hereafter in later sections, the cot actuation system 1000 causes the one or both actuators 16, 18 of the cot actuation system 34 to orientate the support frame 12 and legs 20 and/or 40 either closer or further apart depending on the input received from the one or more sensors of the conditions sensed that have been previously discussed herein.

Referring back to FIG. 21, Bit 2 of the Input Code signal indicates to the motor controller 1002 the status of the C1 Floor Conditions, and is determined according to the following equation: C1 && A1<5%, wherein C1 is 1 when the load wheel proximity sensor is detecting the floor and 0 when it is not detecting the floor. The expression A1<5% is true (1) when the loading end actuator rod is less than 5% extended. Bit 3 of the Input Code signal indicates to the motor controller 1002 the status of the C2 Floor Conditions and is determined according to the following equation: C2 && A1<1% && A2<5%, wherein C2 is 1 when the control end legs mounted proximity sensor is detecting the floor and 0 when it is not detecting the floor. The expression A1<1% is true when the loading end actuator rod is less than 1% extended. The expression A2<5% is true when the control end actuator rod is less than 5% extended. Bit 4 of the Input Code signal indicates to the motor controller 1002 the status of the Mid-Load Conditions or Loading Angle and is determined according to the following equation: A2−A1>37% && A1<5%, wherein the expression A2−A1>37% is true when the control end actuator rod extension is 37% greater than the loading end actuator rod extension relative to the total possible extension. The expression A1<5% is true when the loading end actuator rod is less than 5% extended. Bit 5 of the Input Code signal indicates to the motor controller 1002 the status of the cot height at maximum, and is determined by according to the following equation: A2&&A1>99% leveled range, which indicates that both the control and loading end actuator rods are greater than 99% extended.

As depicted by FIG. 21, Motor State 0 is selected automatically by the motor control 1002 when the Input Code signal bits have a decimal value ranging from 24-63. Motor State 1 is selected automatically by the motor control 1002 when the Input Code signal bits have a decimal value selected from 2, 6, 10, 14, and 18. Motor State 1− is selected automatically by the motor control 1002 when the Input Code signal bits have a decimal value of 19. Motor State 2 is selected automatically by the motor control 1002 when the Input Code signal bits have a decimal value selected from 1, 4, 5, 9, 17, 20, and 21. Motor State 2− is selected automatically by the motor control 1002 when the Input Code signal bits have a decimal value selected from 22 and 23. Motor State 3 is selected automatically by the motor control 1002 when the Input Code signal bits have a decimal value selected from 3, 7, 11, and 15. Motor State 3− is selected automatically by the motor control 1002 when the Input Code signal bits have a decimal value selected from 8, 12, and 13. Motor State 8 is selected automatically by the motor control 1002 when the Input Code signal bits have a decimal value selected from 0 and 16. It is to be appreciated that Motor States 5-9 are selected manually by the operator as previously discussed above in reference to the Chair Position mode and the Direct Power modes.

Automatic stops due to Leg State Change. When the Input Code signal changes due to a change in either the D1 or the D2 state, the motor controller 1002 stops moving the cot's legs until a re-press of either of the buttons 1035, 1037.

Position Indicator Light. The Position Indicator Light 1032, such as embodiment in one example as line indicator 74 (FIG. 7), is illuminating (on) when the cot 10 is not attached to the charger 1040 and conditions in two situations have been meet. For the first situation, the following conditions need to be met: a Load bit of the Input Code signal is set, and the control end legs are in the first position $X_1$. The Load bit is set when the Load Leg is <5% extended and the difference between the Load and Control end legs is >40%. For the second situation, the following conditions need to be met: when the loading end sensor 76 "sees" the loading surface, and the Control end legs are in extension (>5%).

Motion within Motor States

Motor State 0: In this motor state, any pressing of the buttons 1035, 1037 is ignored by the motor controller 1002 such that neither the loading end solenoid actuator 1036 nor the control end solenoid actuator 1038 is activated such that the legs 20, 40 are neither extended nor retracted.

Motor State 1: While the "+" button 1035 is pressed, the motor controller 1002 causes the loading end solenoid actuator 1036 to extend the loading end legs 20 in open loop mode at the maximum possible rate. The control end solenoid actuator 1038 is not activated by the motor controller 1002 such that the control end legs 40 do not move. While the "–" button 1037 is pressed, the motor controller 1002 causes the loading end solenoid actuator 1036 to retract the loading end legs 20 in open loop mode at the maximum possible rate. The control end solenoid actuator 1038 is not activated by the motor controller 1002 such that the control end legs 40 do not move unless Kickup Mode conditions described hereafter are met.

Kickup Mode: When the Input Code signal transitions from a 2 to an 18 (i.e., the loading end legs 20 retract sufficiently for Mid-Load Conditions to be set), the motor controller 1002 will automatically extend the control end legs 40 to a Kickup Height defined in the configuration file 1106. If the control end legs 40 have not been extended to the Kickup Height after expiration of a KickupTime (a countdown timer time predefined in the configuration file 1106), the motor controller 1002 will stop trying to extend the control end legs 40. This action prevents the motor controller 1002 from continuously trying to extend the control end legs 40 that are already at their maximum possible extension. The loading end legs 20 will continue to be retracted by the motor controller 1002 during the Kickup mode as long as the "–" button 1037 is being pressed and the loading end legs 20 have not reached their maximum retraction. The motor controller 1002 stops the load actuator 18 after expiration of the KickupTime timer and when the loading end legs 20 have reached their maximum retraction.

Motor State 1–: In this motor state, pressing of the "+" button 1035 does not cause the motor controller 1002 to active the solenoid actuators 1036, 1038, but pressing the "–" button 1037 will cause the motor controller 1002 to active the loading end solenoid actuator 1036 such that the loading end legs 20 retract in open loop mode at the maximum possible rate. Additionally, the control end solenoid actuator 1038 does not move, such that the control end legs 40 stays at the same height.

Motor State 2: In this motor state, pressing of the "+" button 1035 causes the motor controller 1002 to active only the control end solenoid actuator 1038 such that the control end legs 40 extend in open loop mode at the maximum possible rate. While the "–" button 1037 is pressed, the motor controller 1002 actives only the control end solenoid actuator 1038 such that the control end legs 40 retract in open loop mode at the maximum possible rate.

Motor State 2–: In this motor state, any pressing of the "+" button 1035 is ignored by the motor controller 1002 such that neither the loading end solenoid actuator 1036 nor the control end solenoid actuator 1038 is activated such that the legs 20, 40 are not extended. While "–" button 1037 is pressed, the motor controller 1002 will active the control end solenoid actuator 1038 such that the control end legs 40 retract in an open loop mode at the power setting specified by KickDownPower parameter provided in the configuration file 1106.

Motor State 3: While "+" button 1035 is pressed and the loading end legs 20 and control end legs 40 extensions are equal to within 2% of the operating range, the motor controller 1002 causes the loading end solenoid actuator 1036 to extend the loading end legs 20 at the power setting specified by Up Power in the configuration file 1106. Additionally, the motor controller 1002 actives the control end solenoid actuator 1038 such that the control end legs 40 extend in tracking mode (tracking the position of the load leg). The motor controller 1002 stops the extending of the legs 20, 40 when they reach a first stop position determined by the Transport Height parameter that is preset in and read from the configuration file 1106 or script 1100. To continue the extending of the legs 20, 40, the "+" button 1035 has been released and re-pressed. Upon the re-pressing of the "+" button 1035 after stopping at the Transport Height stop position, the motor controller 1002 will again extend the legs 20, 40 until they reach a Load Height stop position. To continue the extending of the legs 20, 40 beyond the Load Height stop position up to it maximum possible extension, a Highest Level Height stop position (A1=99%, A2=99%), the "+" button 1035 will again have to be released and re-pressed.

It is to be appreciated that if the Load Height stop position is set within 0.2 inches (5.08 mm) (measured on the actuator rod) of the Transport Height stop position, the stopping at the Load Height stop position is ignored by the motor controller 1002. This feature is useful during field operations when it may become necessary to disable the Load Height stop positions due to errors and/or for current care requirements. When the motor controller 1002 starts to move the legs 20, 40 via activation of the solenoid actuators 1036, 1038, the rate of leg extension will ramp from a Start Up Power rate (i.e., a first power setting parameter) to a rate set by a Up Power parameter (a second power setting parameter that is greater than the first power setting parameter, which cause a faster raising of the cot relative to when the cot is being raised under the first power setting parameter) over a time period specified by a Soft Start Acceleration Up parameter, all of which parameters are preset and read from the configuration file 1106 or script 1100 by the motor controller 1002. After the operator has released the "+" button 1035, the motor controller 1002 will ramp down the rate of leg extension to the Start Up Power rate (i.e., the first power rating parameter) over a time period specified by a SoftStop parameter, all of which parameters are also preset and read from the configuration file 1106 or script 1100 by the motor controller 1002. If the value of the ChargeV signal from sensor 1022 (or as reported by the battery controller 1006 via a battery communication message) is less than the Start Up Power, then output power to the solenoid actuators 1036, 1038 is set to zero (0) volts by the motor controller 1002. As the Transport Height stop position is approaching, the motor controller 1002 will ramp down the rate of leg retraction (i.e., the power output to the solenoid actuators 1036, 1038) to zero (0) over the distance specified by a UpDistanceCorrector parameter preset in the configuration file 1106 or script 1100. The motor controller 1002 will not move the Load or Control end legs past the Highest Level Height parameter. If the Load or Control end legs are already outside of Highest Level Height range when motor state 3 is entered, then the motor controller 1002 will not retract them back into level range until the "–" button 1037 is pressed.

While the "–" button 1037 is pressed and the loading end legs 20 and control end legs 40 extensions are equal to within 2% of the operating range, the motor controller 1002 will active the loading end solenoid actuator 1036 such that the loading end legs 20 retract at the power setting specified by Down Power parameter preset and read from the configuration file 1106 or script 1100. The motor controller 1002 also causes the control end solenoid actuator 1038 to retract the control end legs 40 in tracking mode (tracking the position of the load leg). The motor controller 1002 will stop retracting the legs 20, 40 when they reach the Transport Height stop position, and will not continue with the retracting below the Transport Height stop position until the "–" button 1037 has been released and re-pressed.

When the motor controller 1002 starts to move the legs 20, 40 via activation of the solenoid actuators 1036, 1038, the rate of leg retraction will ramp from a Start Down Power rate (a third power setting parameter) to a rate set by Down Power rate (a fourth power setting parameter that is greater than the third power setting parameter, which causes a faster lowering of the cot relative to when the cot is being lowered under the third power setting parameter) over a time period specified by a Soft Down Acceleration Down parameter, all of which parameters are preset in and read from the configuration file 1106 or script 1100 by the motor controller 1002. After the operator has released the "–" button 1037, the motor controller 1002 will ramp down the rate of leg retraction to a Start Down Power rate parameter over a time period specified by the SoftStop parameter. As above, if the power reported by the sensor 1002 or the battery controller 1006 is less than StartDownPower parameter, then the output power to the solenoid actuators 1036, 1038 is set to zero (0) volts by the motor controller 1002. As a Lowest Level Height stop position (which is preset and read from the configuration file 1106 or script 1100 by the motor controller 1002) is approaching, the rate of leg retraction will ramp down to zero (0) volts by the motor controller 1002 over the distance specified by a DownDistanceCorrector parameter, which is also preset in and read from the configuration file 1106 or script 1100 by the motor controller 1002. The motor controller 1002 will not move either of the loading end legs 20 or control end legs 40 past the Lowest Level Height stop position. If either of the loading end legs 20 or control end legs 40 are already outside of the Lowest Level Height stop position range when motor state 3 is entered, the motor controller 1002 will not retract them back into a level range until the "+" button 1035 is pressed. While "+" or "–" button 1035 or 1037 is held and the legs 20, 40 are extended unequally by more than 2% of the operating range of the respective solenoid actuators 1036, 1038, only the legs, i.e., either legs 20 or 40, which needs to travel in the direction of the button press to equalize the leg extensions is moved automatically by the motor controller 1002. Once the legs 20, 40 have reached equal extensions as sensed by angle sensor 1018 (A1=A2), the motor controller 1002 will then extend/retract the legs 20, 40 simultaneously as described previously above in earlier sections. The above auto-equalize function performed by the controller 1002 to ensure a level raising or lowering of the cot 10. It is to be appreciated that the Lowest Level Height stop position is a set value, and the cot 10 will stop lowering at this height based on feedback from the angle sensor(s). If the cot 10 stops lowering above this height, a press of the "–" button 1037 will lower the unit to the stop position height. At this height, further pressing of the "–" button 1037 will do nothing, whereas a pressing of the "+" button 1035 will raise the cot 10 if the herein discussed extending conditions are met. This functionality of the cot 10 prevents button 1035 or 1037 from moving the cot 10 while fully retracted and loaded in an emergency vehicle.

Motor State 3–: When in this motor state, the motor controller 1002 will not response to any press on the "+" button 1035 such that neither the loading end legs 20 nor control end legs 40 move. While the "–" button 1037 is pressed and the loading end legs 20 and control end legs 40 extensions are equal to within 2% of the operating range (e.g., 10 mm), the motor controller 1002 will cause the loading end solenoid actuator 1036 to retract the loading end legs 20 at the power setting specified by the Down Power parameter provided in the configuration file 1106 or script 1100. Additionally, the motor controller 1002 with cause the control end solenoid actuator 1038 to retract the control end legs 40 in tracking mode (tracking the position of the load leg). The motor controller 1002 will stop retracting the legs 20, 40 when they reach the Transport Height stop position and will not continue to retract the legs 20, 40 until the "–" button 1037 has been released and re-pressed. After the "–" button 1037 has been released and re-pressed, when starting again to move the legs 20, 40, the motor controller 1002 will ramp the rate of leg retraction from the Start Down Power rate to the rate set by the Down Power rate parameter over the time period specified by the Soft Down Acceleration Down parameter. After the operator has released the "–" button 1037, the rate of leg retraction is ramped-down by the motor controller 1002 to the Start Down Power rate parameter over the time period specified by SoftStop parameter. If the power as indicated by the ChargeV signal from sensor 1022 or as indicated in a communication message by the battery controller 1006 is less than the Start Down Power rate, then the output power provided by the motor controller 1002 to the solenoid actuators 1036, 1038 is set to zero (0) volts. As a Lowest Level Height stop position is approaching, the rate of leg retraction will ramp down to zero (0) volts by the motor controller 1002 over the distance specified by a DownDistanceCorrector parameter. The motor controller 1002 will not move either of the loading end legs 20 or control end legs 40 past the Lowest Level Height stop position.

The motor controller 1002 will not move the legs 20, 40 past Lowest Level Height stop position. If either or both of the legs 20, 40 are already outside of Lowest Level Height range when motor state 3 is entered, the motor controller 1002 will not retract them back into level range until the "+" button 1035 is pressed. While the "–" button 1037 is held and the legs are extended unequally by more than 2% of the operating range, only the pair of legs 20 or 40 which needs to retract to equalize the leg extensions will move. Once the legs have reached equal extensions (i.e., A1=A2), they will retract as described previously above in earlier sections by the motor controller 1002.

Motor State 5: In this motor state, while the "+" button 1035 pressed, the motor controller 1002 responses by activating only the control end solenoid actuator 1038 such that the control end legs 40 extend at a power level set by a Reduced Up Power parameter preset in and read from the configuration file 1106 or script 1100 by the motor controller 1002. When the motor controller 1002 starts to move the control end legs 40, the rate of leg extension is ramped from the Start Up Power rate to the rate set by the Reduced Up Power parameter over the time period specified by the Soft Start Acceleration Up parameter. While the "–" button 1037 is pressed, the motor controller 1002 activates only the control end solenoid actuator 1038 such that the control end legs 40 retracts at a power level set by the Reduced Down Power parameter. When the motor controller 1002 starts to move the control end legs 40, the rate of leg retraction is ramped from the Start Down Power rate to the rate set by Down Power parameter over the time period specified by Soft Down Acceleration Down parameter.

Motor State 6: When in this motor state, while the "+" button 1035 is pressed, the motor controller 1002 actives both solenoid actuators 1036, 1038 such that both legs 20, 40 extend at a power level set by Reduced Up Power parameter. When the motor controller 1002 starts to move the legs 20, 40, the rate of leg extension is ramped by the motor controller 1002 from the Start Up Power rate to the rate set by Reduced Up Power parameter over the time period specified by the Soft Start Acceleration Up parameter. While the "–" button 1037 pressed, the motor controller 1002 actives both solenoid actuators 1036, 1038 such that both legs 20, 40 retract at a power level set by the Reduced Down Power parameter. When the motor controller 1002 starts to move the legs 20, 40, the rate of leg extension is ramped by the motor controller 1002 from the Start Down Power rate to the rate set by Reduced Down Power parameter over the time period specified by the Soft Down Acceleration Down parameter.

Motor State 7: In this motor state, while the "+" button 1035 is pressed, the motor controller 1002 responses by activating only the loading end solenoid actuator 1036 such that the loading end legs 20 extend at a power level set by a Reduced Up Power parameter preset in and read from the configuration file 1106 or script 1100 by the motor controller 1002. When the motor controller 1002 starts to move the loading end legs 20, the rate of leg extension is ramped from the Start Up Power rate to the rate set by the Reduced Up Power parameter over the time period specified by the Soft Start Acceleration Up parameter. While the "–" button 1037 is pressed, the motor controller 1002 activates only the loading end solenoid actuator 1036 such that the loading end legs 20 retracts at a power level set by the Reduced Down Power parameter. When the motor controller 1002 starts to move the loading end legs 20, the rate of leg retraction is ramped from the Start Down Power rate to the rate set by Down Power parameter over the time period specified by Soft Down Acceleration Down parameter.

Motor State 8: When in this motor state, while the "+" button 1035 is pressed, the motor controller 1002 actives both solenoid actuators 1036, 1038 such that the legs 20, 40 extend at maximum power. While "–" button 1037 is pressed, the motor controller 1002 actives both solenoid actuators 1036, 1038 such that the legs 20, 40 are retracted at maximum power.

Motor State 9: In this motor state, while the "–" button 1037 is pressed, if the control end legs 40 are not within a Chair Position Tolerance distance parameter of the Chair Position height parameter (both parameters preset in and read from the configuration file 1106 or script 1100 by the motor controller 1002), and if the loading end legs 20 and control end legs 40 extensions are equal to within 2% of the operating range and the loading end legs 20 is less extended than the result of the Chair Position height parameter–Chair Position Tolerance distance, then the motor controller 1002 causes the loading end solenoid actuator 1036 to extend the loading end legs 20 at the power setting specified by Up Power parameter preset in and read from the configuration file 1106 or script 1100 by the motor controller 1002. Additionally, the motor controller 1002 causes the control end solenoid actuator 1038 to extend the control end legs 40 in tracking mode (tracking the position of the load leg). The motor controller 1002 stops extending the legs 20, 40 when they reach the Chair Height position. As in other modes, when the legs are starting to move, the motor controller 1002 ramps the rate of leg extension from the Start Up Power rate to the rate set by Up Power parameter over the time period specified by the Soft Start Acceleration Up parameter. After the operator has released the "–" button 1037, the rate of leg extension is ramped-down by the motor controller 1002 to the StartUpPower rate parameter over the time period specified by the SoftStop parameter. If the power reported by the sensor 1022 or by the battery controller 1006 is less than the StartUpPower rate parameter, then output power to the solenoid actuators 1036, 1038 is set to zero (0) volts by the motor controller 1002.

As the Chair Position height is approaching, the rate of leg retraction is ramped down by the motor controller 1002 to zero (0) volts over the distance specified by UpDistanceCorrector parameter. If the loading end legs 20 and control end legs 40 extensions are equal to within 2% of the operating range (?) and the loading end legs 20 are extended more than the Chair Position height+the Chair Position Tolerance, then the motor controller 1002 causes the loading end solenoid actuator 1036 to retract the loading end legs 20 at the power setting specified by Down Power parameter provided in the configuration file 1106 or script 1100. Additionally, the motor controller 1002 cause the control end solenoid actuator 1038 to retract the control end legs 40 in tracking mode (tracking the position of the load leg). The cot's legs stop retracting when they reach the position of Chair Position height parameter.

As in other modes, when the motor controller 1002 starts to move the legs 20, 40, the rate of leg retraction will ramp from the Start Down Power rate to the rate set by Down Power parameter over the time period specified by the Soft Down Acceleration Down parameter. After the operator has released the "–" button 1037, the rate of leg retraction will ramp-down to the Start Down Power rate over the time period specified by the SoftStop parameter. If the power reported by the sensor 1022 or battery controller 1006 is less than the power required by the StartDownPower rate, then output power is set by the motor controller 1002 to zero (0) volts. As position of the Chair Position height parameter is approaching, the rate of leg retraction will ramp down to zero (0) over the distance specified by the DownDistanceCorrector parameter. If the legs 20, 40 are extended unequally by more than 2% of the operating range (?), further leg movement will depend on the position of the loading end legs 20 with respect to the control end legs 40 and the Chair Position height. If the cot 10 is in a position such that the loading end legs 20 are above the Chair Position height and the control end legs 40 are lower than the loading end legs 20 and lower than the Chair Position height, then the motor controller 1002 retracts the loading end legs 20 to its Chair Position height, and then retracts the control end legs 40 to its Operator Chair height.

If the cot 10 is in a position such that the loading end legs 20 are above the Chair Position height and the control end legs is lower than the loading end legs 20 but above the Chair Position height, then the motor controller 1002 retracts the loading end legs 20 to be level with the control end legs 40, then both the legs 20, 40 are retracted evenly by the motor controller 1002 until Chair Position height, and then the control end legs 40 are retracts by the motor controller 1002 to its Operator Chair height. If the cot is in a position such that the loading end legs are above the Chair Position height and the control end legs 40 are above the loading end legs 20, the control end legs 40 are retracted by the motor controller 1002 to be level with the loading end legs 20, and then both the legs are retracted evenly by the motor controller 1002 until the Chair Position height, and then the control end legs 40 are retracts to its Operator Chair height.

If the cot is in a position such that the loading end legs 20 are below the Chair Position height and the control end legs are below the loading end legs 20, the control end legs 40 are extended to be level with the loading end legs 20, then both legs are extended evenly until the Chair Position height, and then the control end legs 40 are retracted to Operator Chair height. If the cot 10 is in a position such that the loading end legs 20 are below the Chair Position height and the control end legs 40 are above the loading end legs 20 but below the Chair Position height, then the loading end legs 20 are extended to be level with the control end legs 40, then both legs 20, 40 are extended evenly until Chair Position height, and then the control end legs 40 are retracted to its Operator Chair height.

If the cot is in a position such that the loading end legs 20 are below the Chair Position height and the control end legs 40 are above the loading end legs 20 and also above the Chair Position height, the loading end legs 20 are extended to Chair Position height and then the control end legs 40 are retracted to the Operator Chair height. If the loading end legs 20 are within Chair Position tolerance of Chair Position height, then the motor controller 1002 will not cause the loading end solenoid actuator 1036 to move the loading end legs 20 as the control end solenoid actuator 1038 is activated by the motor controller 1002 to cause the control end legs 40 to retract at a reduced power level to the Operator Chair height.

Mode Independent Operation

The following modes of operation are independent of any motor mode operation, a USB Data Transfer State, Battery Voltage Monitoring, Data Logging, Error Detection, and Configuration File execution and updating. While in the USB Data Transfer Mode, an external controller utility tool such as provided on a personal computer or smart electronic device is able to read the motor controller log files. One suitable example of such a controller utility tool is Roborunt from RoboteQ (Scottsdale, Ariz.). From the controller utility tool, software versions updates can be implemented to the controller as well as calibrate the maximum height and minimum height for the angle sensors. The controller utility tool also can display the states and values of the analog/digital inputs and outputs to the motor controller 1002 depicted in FIG. 15.

For Battery Voltage Monitoring, the motor controller 1002 is responsible for monitoring the battery's voltage level. The voltage level is read after a pre-defined idle time, which is defined by a Voltage Reading Idle Time parameter that starts counting down following a pressing of the "+" button 1035 or the "−" button 1037. The Voltage Reading Idle Time parameter is preset to 15 seconds, but which is configurable via the configuration file 1106. If the idle voltage level is less than an Actuator Minimum Voltage Threshold (preset in and read from the configuration file 1106 or script 1100) the actuators are disabled. Once the actuators have been disabled for low voltage, the battery voltage must become greater than Actuator Minimum Voltage Threshold by one volt (1V) before the actuators will be enabled. If the idle voltage level is less than Light Minimum Voltage Threshold (preset in and read from the configuration file 1106 or script 1100), the LightCutoff bit will be set. Once the lights have been disabled for low voltage, the battery voltage must become greater than Light Minimum Voltage Threshold by one volt (1V) before the lights will be enabled.

Voltage Bins: If the idle voltage is >=VThresh3, the bin is 3. If the idle voltage is <VThresh3 and >=VThresh2, the bin is 2. If the idle voltage is <VThresh2 and >=VThresh1, the bin is 1. If the idle voltage is <VThresh1, the bin is 0.

Data Logging

A text readable log file is written to memory, such as memory 102 or to a flash memory card, such as a memory stick, SD card, and/or compact flash card connected to the motor controller's USB. The log file shall contain an entry capturing each time an Error Code occurs or clears. The log file shall contain entries during cot operation capturing the cot status every fifty milliseconds (50 ms). The log file shall contain entries during idle periods at a period controlled by IdleLogTime. The following cot status fields are provided in the data log file by the motor controller: Battery Voltage, values for A1, A2, D1, D2, C1, C2, Time Stamp, +Button Status Display, −Button Status Display, +Button Telescopic Handle, −Button Telescopic Handle, Motor Controller Error Code, Motor1 Current, Motor2 Current, Motor Command 1, Motor Command 2, Direct Power Code, Motor State, Battery message, A1 Speed, A2 Speed, Motor1 Temp, Motor2 Temp, Controller Channel Temperature, Controller IC Temperature, Fault Flag, Battery Temperature, and Error Detection.

Error Conditions

The motor controller 1002 monitors for the below error/warning conditions and takes the actions specified by the error's associated Priority Class Category. The designated "Error Code Bit" value for the detected "Condition" as well as the "Clearing" action(s), if any, are also provided in the discussion provided hereafter. "Additional Actions" may be listed for specific errors which are also discussed hereafter. It is to be appreciated that the associated Error Code bit is set in a message and broadcasted over the wired network 1008 by the motor controller 1002. For each Error Code, a related error icon 51 (FIG. 8) is provided to the GUI 58 to alert the operator to a function or safety issue that may be related to the associated Error Code. The related error icon 51 in some embodiments may by color coded in which high-priority error codes are displayed in a first color, such as red, and all other error codes may be displayed in a second color, such as yellow. A discussion of the error conditions and their associated priority now follows.

Error Conditions—Priority Class: None.

Condition: Low Battery (battery voltage less than Battery Bin 1 voltage as specified in the configuration file 1106 or script 1100)=Error Code Bit 0. Clearing: Cleared when the battery voltage goes above Battery Bin 1.

Condition: Battery Below Actuator Minimum Voltage Threshold after idle for VoltageReadingIdleTime=Error Code Bit 1. Additional Actions: Disable Actuators. Clearing: Cleared when the battery voltage goes above Actuator Minimum Voltage+1V.

Condition: Battery Below Light Minimum Voltage Threshold after idle for VoltageReadingIdleTime=Error Code Bit 2 Additional Actions: Set Light Cutoff bit Clearing: Cleared when the battery voltage goes above Light Minimum Voltage+1V.

Condition: Push button detected on (closed) for more than Maximum Pushbutton Pressed=Error Code Bit 3. Clearing: Cleared when the pushbutton is detected off (open).

Condition: |A1−A2| out of level operating range for greater than MaxLevellingTime during leveled operation=Error Code Bit 4. Clearing: Cleared when leg extensions become level.

Condition: Battery Charge Detection Failure (zero Voltage detected at Charge+ pin while the battery's Charging bits is set)=Error Code Bit 5.

Condition: Both "+" and "−" pushbuttons detected on simultaneously=Error Code Bit 6. Additional Actions: Both buttons are ignored (motor controller 1002 will not command extension or retraction of the legs 20, 40). Clearing: Cleared when one or both buttons is released.

Error Conditions—Priority Class: Low. Error Handling—Priority Class: Low, takes precedence over all None priority error class handling.

Condition: Improper Charge Voltage detected at Charge+ (>1.48 mV at Charge+; equates to >44.1V charger voltage)=Error Code Bit 16. Clearing: Cleared when voltage at Charge+ is <1.48 mV.

Condition: Cot goes above Transport Height (A1 or A2 is extended beyond Transport Height while D1 and D2 are both closed)=Error Code Bit 17. Clearing: Cleared when cot is no longer above Transport Height, or after High Priority Above Transport Height error active.

Condition: Charging Failure (non-zero Voltage detected at Charge+ pin while neither the battery's Charging nor Fully Charged bits are set=Error Code Bit 19. Clearing: Cleared when Charge+ pin voltage goes away or the battery's Charging or Fully Charged bit is set.

Condition: Battery High Temperature (battery charger high temperature error bit is set)–Error Code Bit 21. Clearing: Cleared when battery's high temperature error bit is cleared.

Error Conditions—Priority Class: Medium. Error Handling—Priority Class: Medium takes precedence over all None and Low priority error class handling, and causes the deactivation of the solenoid actuators 1036, 1038 (e.g., within 50 milliseconds) and prevents actuation until such an error condition is cleared.

Condition: Motor Temperature detected above MotorOverTemp=Error Code Bit 32. Additional Actions: The sensor temperature will continue to be monitored and logged while the overheat error is occurring. Clearing: This error is cleared when the motor temp goes below Motor Restart Temp.

Condition: Motor sensor disconnected=Error Code Bit 33. Clearing: This error is cleared when the motor temp sensor is detected.

Error Conditions—Priority Class: High. Error Handling—Priority Class: High takes precedence over all None, Low, and Medium priority class error handling and causes the deactivation of the solenoid actuators 1036, 1038 (e.g., within 50 milliseconds) and prevents actuation until such an error condition is cleared. A power cycle will clear all errors. A transition to sleep mode will suspend all alarms. Actuators are disabled if the current in either of the motors exceeds 40 A for more than 500 milliseconds.

Condition: Leg Moving State Velocity Error (exceeds Maximum Speed or falls below Minimum Speed)=Error Code Bit 48. Clearing: Cleared after Leg Speed Error Timeout.

Condition: Leg Moving State Velocity Error (falls below Minimum Speed)=Error Code Bit 49. Actuators and – button is disabled for ButtonDisableTime. The error icon is displayed during this time. Clearing: Cleared if + button is pressed, and/or after the Leg Speed Error times out.

Condition: Angle Sensor Malfunction (A1 or A2 has either: Ch1 or Ch2 voltage outside of sensor's rated range of 0.5V to 4.5 V; or Ch1+Ch2 is not 5V+/−0.5V) =Error Code Bit 50. Clearing: Cleared after voltage returns to expected range.

Condition: Cot has been above Transport Height (A1 or A2 is extended beyond Transport Height while D1 and D2 are both closed) for >30 seconds=Error Code Bit 51. Additional Actions: Do not disable "–" button 1037 (allow actuators to retract, but not extend). Clearing: Cleared after cot is no longer above Transport Height.

It should now be understood that the embodiments described herein may be utilized to transport patients of various sizes by coupling a support surface such as a patient support surface to the support frame. For example, a lift-off stretcher or an incubator may be removably coupled to the support frame. Therefore, the embodiments described herein may be utilized to load and transport patients ranging from infants to bariatric patients. Furthermore the embodiments described herein, may be loaded onto and/or unloaded from an ambulance by an operator holding a single button to actuate the independently articulating legs (e.g., pressing the "–" button 1037 to load the cot onto an ambulance or pressing the "+" button 1035 to unload the cot from an ambulance). Specifically, the cot 10 may receive an input signal such as from the operator controls. The input signal may be indicative a first direction or a second direction (lower or raise). The pair of loading end legs and the pair of control end legs may be lowered independently when the signal is indicative of the first direction or may be raised independently when the signal is indicative of the second direction.

It is further noted that terms like "preferably," "generally," "commonly," and "typically" are not utilized herein to limit the scope of the claimed embodiments or to imply that certain features are critical, essential, or even important to the structure or function of the claimed embodiments. Rather, these terms are merely intended to highlight alternative or additional features that may or may not be utilized in a particular embodiment of the present disclosure.

For the purposes of describing and defining the present disclosure it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having provided reference to specific embodiments, it will be apparent that modifications and variations are possible without departing from the scope of the present disclosure defined in the appended claims. More specifically, although some aspects of the present disclosure are identified herein as preferred or particularly advantageous, it is contemplated that the present disclosure is not necessarily limited to these preferred aspects of any specific embodiment.

What is claimed is:

1. A powered ambulance cot for transporting a patient above a surface, comprising:

a support frame;

four legs, each leg having a wheel for supporting the cot on the surface;

an actuator of a cot actuation system which interconnects the support frame and a pair of the legs, and effects changes in elevation of the support frame relative to the wheel of each of the legs; and a cot control system operably connected to the cot actuation system to control activation of the cot actuation system, and which detects both the actuator at a first location relative to the support frame, where the first location is remote from a second location and which situates an end of the actuator that is remote from each wheel closer to the support frame, and a presence of a signal requesting a change in elevation of said support frame relative to the wheel of each of the legs to cause the cot actuation system to move the pair of the legs relative to the support frame at a first speed that is different from a second speed at which the cot actuation system moves the pair of the legs relative to the support frame when the end of said actuator is at the second location.

2. The powered ambulance cot according to claim 1, wherein the cot control system comprises at least one controller, sensors, a user display unit, a battery unit, and a wired communication network configured to transport messages between the at least one controller, sensors, the user display unit, and the battery unit.

3. The powered ambulance cot according to claim 2, wherein said wired communication network is selected from a controller area network (CAN), a LONWorks network, a LIN network, an RS-232 network, a Firewire network, and a DeviceNet network.

4. The powered ambulance cot according to claim 2, wherein the battery unit is a battery management system integrated with a battery pack that provides portable power to the cot, wherein that battery management system controls charging and discharging of the battery pack and communicates with the at least one controller over the communication network.

5. The powered ambulance cot according to claim 2, wherein the at least one controller is a first controller and the cot control system comprises a second controller, wherein the first controller is a motor controller for controlling the raising and lowering of said support frame with respect to each wheel, and the second controller is a graphical user interface controller for receiving input from and providing output to an operator.

6. The powered ambulance cot according to claim 5, wherein the cot control system comprises a third controller selected from a wireless controller for sending and receiving wireless communications, a battery controller for controlling a battery which supplies power to all powered components of the powered ambulance cot, and combinations thereof.

7. The powered ambulance cot according to claim 5, wherein said motor controller is programmed by a script of program logic to control activation of the cot actuation system to raise and lower said support frame with respect to each wheel of the legs.

8. The powered ambulance cot according to claim 1, wherein the cot control system includes a manually operable, user interface device for providing the signal requesting the change in elevation of said support frame relative to the wheel of each of the legs to the cot control system; and wherein said cot control system is configured to effect movement of legs at maximum power in response to the end of the actuator being detected at the second location and in response to the signal being present via manual operation of said user interface device.

9. The powered ambulance cot according to claim 1, wherein the actuator is a first actuator, the pair of the legs is a first pair of the legs, wherein the first actuator interconnects the first pair of the legs with the support frame, and wherein the cot actuation system comprises a second actuator which interconnects a second pair of the legs with the support frame, the cot actuation system being configured to effect changes in elevation of the support frame relative to the wheel of each of the legs via independent operation of the first and second actuators, and wherein the cot actuation system will equalize the elevation of the support frame between a loading end and a control end of the cot by the independent operation of the first and second actuator in response to the signal being present via manual operation of said user interface device, and while the end of the first actuator is in the first location.

10. The powered ambulance cot according to claim 9, wherein the cot control system further comprises a mode-selection button in which to cycle through and select a direct-power mode from a number of direct power modes, and wherein selection of a direct-power mode causes the cot actuation system to display the selection of the direct power mode graphically on a display of the cot control system and to not equalize the elevation of the support frame between the loading end and the control end of the cot by the independent operation of the first and second actuator in response to the signal being present via manual operation of said user interface device.

11. The powered ambulance cot according to claim 10, wherein one of the direct power modes is a both legs direct power mode which the selection of which causes the cot control system to change the evaluation of the support frame at both the loading end and the control end in response the signal being present via the manual operation of said user interface device.

12. The powered ambulance cot according to claim 11, wherein another one of the direct power modes is a loading end legs only direct power mode which the selection of which causes the cot control system to change the evaluation of the support frame at only the loading end in response to the signal being present via the manual operation of said user interface device.

13. The powered ambulance cot according to claim 12, wherein still another one of the direct power modes is a control end legs only direct power mode which the selection of which causes the cot control system to change the evaluation of the support frame at only the control end in response the signal being present via the manual operation of said user interface device.

14. The powered ambulance cot according to claim 13, wherein the cot control system reverts back to a normal operating state in which the cot control system will equalize the elevation of the support frame between the loading end and the control end of the cot by the independent operation of the first and second actuator in response to the signal being present via the manual operation of said user interface device after expiration of a countdown timer that was started after selection of the direct power mode and the signal not being present before the expiration of the countdown timer.

15. A method of transporting a patient above a surface comprising utilizing a powered ambulance cot according to claim 1.

* * * * *